US007175956B2

(12) United States Patent
Obata et al.

(10) Patent No.: US 7,175,956 B2
(45) Date of Patent: Feb. 13, 2007

(54) ORGANIC PHOTOCONDUCTIVE MATERIAL, ELECTROPHOTOGRAPHIC PHOTORECEPTOR COMPRISING THE SAME, AND IMAGE-FORMING APPARATUS

(75) Inventors: Takatsugu Obata, Nara (JP); Akihiro Kondoh, Nara (JP); Kazuya Ishida, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 182 days.

(21) Appl. No.: 10/653,293

(22) Filed: Sep. 3, 2003

(65) Prior Publication Data

US 2004/0101770 A1 May 27, 2004

(30) Foreign Application Priority Data

Sep. 4, 2002 (JP) ..... P2002-259320
Jan. 22, 2003 (JP) ..... P2003-013595

(51) Int. Cl.
*G03G 15/02* (2006.01)

(52) U.S. Cl. ..... 430/58.5; 430/59.4; 430/72; 430/73; 430/75; 430/76; 430/77; 430/78; 399/159

(58) Field of Classification Search ..... 430/58.5, 430/59.4, 72, 73, 75, 76, 77, 78; 399/159
See application file for complete search history.

(56) References Cited

U.S. PATENT DOCUMENTS 3,824,099 A 7/1974 Champ et al.

(Continued)

FOREIGN PATENT DOCUMENTS

JP 52-4188 2/1977

(Continued)

OTHER PUBLICATIONS

Chemical Abstracts 138:47243 of JP 2002-365820, 23-28-2002.*
Translation of JP2002-365820.*

*Primary Examiner*—Mark A. Chapman
(74) *Attorney, Agent, or Firm*—Nixon & Vanderhye P.C.

(57) ABSTRACT

The invention is to provide an organic photoconductive material capable of realizing electrophotographic photoreceptors of high reliability that have high charge potential, high sensitivity, good responsiveness to light and good durability, of which the characteristics do not lower even when they are driven at low temperatures or at high speed and even when they are exposed to light, and to provide an electrophotographic photoreceptor that comprises the material and an image-forming apparatus. An organic photoconductive material of the following general formula (1), for example, an enamine compound of the following structural formula (1-1) is produced. Using the organic photoconductive material for the charge-transporting substance to be in a photosensitive layer on a conductive support, an electrophotographic photoreceptor is fabricated, and this is mounted on an image-forming apparatus (1)

(1-1)

14 Claims, 14 Drawing Sheets

U.S. PATENT DOCUMENTS

| | | | |
|---|---|---|---|
| 4,123,269 | A | 10/1978 | Von Hoene et al. |
| 4,150,987 | A | 4/1979 | Anderson et al. |
| 4,278,747 | A | 7/1981 | Murayama et al. |
| 4,338,388 | A | 7/1982 | Sakai et al. |
| 4,859,556 | A | 8/1989 | Sasaki |
| 4,892,949 | A | 1/1990 | Sasaki |

FOREIGN PATENT DOCUMENTS

| | | |
|---|---|---|
| JP | 54-150128 | 11/1979 |
| JP | 54-151955 | 11/1979 |
| JP | 55-52063 | 4/1980 |
| JP | 55-42380 | 10/1980 |
| JP | 58-32372 | 7/1983 |
| JP | 58-198043 | 11/1983 |
| JP | 6-43674 | 2/1984 |
| JP | 2-51162 | 2/1990 |
| JP | 2-190862 | 7/1990 |
| JP | 7-48324 | 2/1995 |
| JP | 7-134430 | 5/1995 |
| JP | 10-69107 | 3/1998 |
| JP | 2002-365820 | * 12/2002 |

* cited by examiner

ORGANIC PHOTOCONDUCTIVE MATERIAL, ELECTROPHOTOGRAPHIC PHOTORECEPTOR COMPRISING THE SAME, AND IMAGE-FORMING APPARATUS

BACKGROUND OF THE INVENTION

1. Field of the Invention

The present invention relates to an organic photoconductive material, an electrophotographic photoreceptor comprising the same, and an image-forming apparatus.

2. Description of the Related Art

Recently, organic photoconductive materials have been widely researched and developed, and they are not only utilized in electrophotographic photoreceptors (hereinafter the term may be simply referred to as "photoreceptors") but also are being applied to electrostatic recording apparatuses, sensor materials, organic electroluminescent (EL) elements, etc. In addition, electrophotographic photoreceptors that comprise organic photoconductive material are utilized not only in the field of copiers but also in other fields of printing plate materials, slide films and microfilms for which photographic technology has heretofore been used, and they are further applied to high-speed printers having a light source of lasers, light emitting diodes (LED) or cathode ray tubes (CRT). Accordingly, the demand for such organic photoconductive materials and electrophotographic photoreceptors comprising the material is increasing highly and widely.

Heretofore, inorganic photoreceptors have been widely used for electrophotographic photoreceptors, in which the photosensitive layer comprises, as the essential ingredient, an inorganic photoconductive material such as selenium, zinc oxide or cadmium. Though having the basic characteristics for themselves in some degree, inorganic photoreceptors are problematic in that films for the photosensitive layer are difficult to form and are poorly plasticized and their production costs are high. In general, in addition, inorganic photoconductive materials are highly toxic and are significantly limited in point of their production and treatment.

As opposed to these, organic photoreceptors that comprise organic photoconductive material have various advantages in that films for the photosensitive layer thereof are easy to form, and are flexible, lightweight and transparent and those of good sensitivity to wavelengths in a broad range are readily planned through suitable sensitization. Accordingly, such organic photoreceptors are being developed as the mainstream of electrophotographic photoreceptors. In the initial stage thereof, organic photoreceptors have some defects in point of their sensitivity and durability, but such defects have now been significantly overcome by the development of function-separated electrophotographic photoreceptors of which the charge-generating function and the charge-transporting function thereof are separately attained by different substances. Such function-separated photoreceptors have broad latitude in selecting the materials for the charge-generating substances that participate in the charge-generating function thereof and the charge-transporting substances that participate in the charge-transporting function thereof, and have the advantage in that those having any desired characteristics are relatively readily produced.

A variety of substances have heretofore been investigated for the charge-generating substances that may be used in the function-separated photoreceptors, including, for example, phthalocyanine pigments, squarylium dyes, azo pigments, perylene pigments, polycyclic quinone pigments, cyanine dyes, squaric acid dyes and pyrylium salt dyes, and various materials of good light fastness and good charge-generating ability have been proposed.

On the other hand, various compounds are known for the charge-transporting substances, including, for example, pyrazoline compounds (e.g., those in Japanese Examined Patent Publication JP-B2 52-4188 (1977)), hydrazone compounds (e.g., those in Japanese Unexamined Patent Publication JP-A 54-150128 (1979), Japanese Examined Patent Publication JP-B2 55-42380 (1980), Japanese Unexamined Patent Publication JP-A 55-52063 (1980), triphenylamine compounds (e.g., those in Japanese Examined Patent Publication JP-B2 58-32372 (1983) and Japanese Unexamined Patent Publication JP-A 2-190862 (1990)) and stilbene compounds (e.g., those in Japanese Unexamined Patent Publications JP-A 54-151955 (1979) and JP-A 58-198043 (1983)). Recently, pyrene derivatives, naphthalene derivatives and terphenyl derivatives that have a condensed polycyclic hydrocarbon structure as the center nucleus have been developed (e.g., those in Japanese Unexamined Patent Publication JP-A 7-48324 (1995)).

The charge-transporting substances must satisfy the following requirements:

(1) they are stable to light and heat;

(2) they are stable to ozone, nitrogen oxides (NOx) and nitric acid that may be generated in corona discharging on the surface of photoreceptors;

(3) they have good charge-transporting ability;

(4) they are compatible with organic solvents and binders;

(5) they are easy to produce and are inexpensive. Though partly satisfying some of these, however, the charge-transporting substances mentioned above could not satisfy all of these at high level.

Of the requirements mentioned above, the good charge-transporting ability is especially important for the substances. For example, in order to use a charge transportation layer that is formed by dispersing a charge-transporting substance along with a binder resin, as the surface layer of a photoreceptor, the charge-transporting substance must have good charge-transporting ability for ensuring sufficient responsiveness of the layer to light. Through the use of a photoreceptor mounted on copiers or laser beam printers, a surface layer of the photoreceptor is subject to partly cutting off by a contact part such as a cleaning blade or a charge roller that is in kept contact therewith. For enhancing the durability of copiers and laser beam printers, the surface layer of the photoreceptor must be tough to the contact part, or that is, it should be hardly cut away by the contact part and have good printing durability. For strengthening the surface layer to improve the durability of the machines, when the binder resin content of the surface layer, charge transportation layer is increased, then the responsiveness thereof to light lowers. This is because, since the charge-transporting ability of the charge-transporting substance in the charge transportation layer is low and since the charge-transporting substance in the layer is diluted to a higher degree with the increase in the binder resin content of the layer, the charge-transporting ability of the charge transportation layer is further lowered and the responsiveness thereof to light is therefore lowered. In case where the responsiveness of the layer to light is low, the residual potential thereof increases and, as a result, the photoreceptor shall be used repeatedly while the surface potential thereof is not sufficiently attenuated. In that condition, the surface charge in the part that shall be erased through exposure to light could not be fully erased, and it causes a drawback in that the image quality worsens in early stages. Accordingly, for ensuring good responsiveness of the surface layer to light, it is desired that the charge-transporting substance to be in the layer shall have good charge-transporting ability.

The recent tendency in the art of electrophotographic apparatuses such as digital copiers and printers is toward down-sizing and high-speed operability, and photoreceptors for these apparatuses are desired to have higher sensitivity enough for such high-speed operation. Accordingly, charge-transporting substances for these apparatuses are desired to have much better charge-transporting ability. In a high-speed process, the time from exposure to light to development is short, and photoreceptors of good responsiveness to light are desired. As so mentioned hereinabove, the responsiveness to light of charge-transporting substances depends on the charge-transporting ability thereof. From this viewpoint, therefore, charge-transporting substances having better charge-transporting ability are desired.

For the charge-transporting substances that satisfy the requirement, proposed are enamine compounds having higher charge mobility than that of the charge-transporting substances mentioned above (e.g., those in Japanese Unexamined Patent Publications JP-A 2-51162 (1990), JP-A 6-43674 (1994) and JP-A 10-69107 (1998)).

Also proposed is a photoreceptor which has been made to have an increased charge-transporting ability by adding thereto a polysilane, and has been improved in point of the chargeability and the film strength thereof by further adding thereto an enamine compound having a specific structure (Japanese Unexamined Patent Publication JP-A 7-134430 (1995)).

However, the properties of the photoreceptors that comprise the enamine compound described in JP-A 2-51162, JP-A 6-43674 or JP-A 10-69107 are still unsatisfactory.

Containing a polysilane, the photoreceptors described in JP-A 7-134430 are problematic in that they are too much sensitive to light and, when exposed to light during their maintenance, their photoreceptive properties are worsened.

Regarding the characteristics of photoreceptors, it is desired that their sensitivity does not lower even though they are driven at low temperatures and the change of their characteristics is small in any different conditions, or that is, their reliability is high in every condition. However, no one has heretofore succeeded in obtaining such charge-transporting substances that realize the characteristics.

SUMMARY OF THE INVENTION

An object of the invention is to provide an organic photoconductive material capable of realizing electrophotographic photoreceptors of high reliability that have high charge potential, high sensitivity, good responsiveness to light and good durability, of which the characteristics do not lower even when they are driven at low temperatures or at high speed and even when they are exposed to light, and to provide an electrophotographic photoreceptor that comprises the material and an image-forming apparatus.

The invention provides an organic photoconductive material of the following general formula (1):

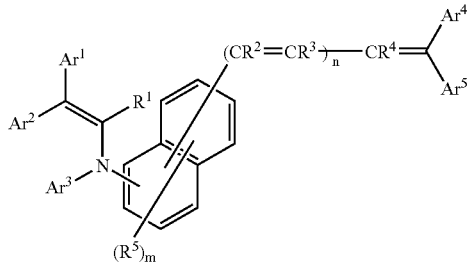

wherein $Ar^1$ and $Ar^2$ each represent an optionally-substituted aryl group or an optionally-substituted heterocyclic group; $Ar^3$ represents an optionally-substituted aryl group, an optionally-substituted heterocyclic group, an optionally-substituted aralkyl group, or an optionally-substituted alkyl group; $Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ are hydrogen atoms at the same time; $Ar^4$ and $Ar^5$ may bond to each other via an atom or an atomic group to form a cyclic structure; $R^5$ represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, then the $R^5$s may be the same or different and may bond to each other to form a cyclic structure; R' represents a hydrogen atom, a halogen atom, or an optionally-substituted alkyl group; $R^2$, $R^3$ and $R^4$ each represent a hydrogen atom, an optionally-substituted alkyl group, an optionally-substituted aryl group, an optionally-substituted heterocyclic group, or an optionally-substituted aralkyl group; n indicates an integer of from 0 to 3; when n is 2 or 3, then the $R^2$s may be the same or different and the $R^3$s may be the same or different, but when n is 0, $Ar^3$ is an optionally-substituted heterocyclic group.

According to the invention, the organic photoconductive material of formula (1) is an enamine compound, and therefore has high charge mobility. When the organic photoconductive material having such high charge mobility is used as a charge-transporting substance, then an electrophotographic photoreceptor of high reliability can be realized which has high charge potential, high sensitivity, good responsiveness to light and good durability, of which the characteristics do not lower even when it is driven at low temperatures or at high speed and even when it is exposed to light. In addition, when the organic photoconductive material is used in sensor materials, EL elements or electrostatic recording elements, then apparatuses of good responsiveness can be provided.

As mentioned above, the organic photoconductive material of the invention has a specific structure, and therefore has high charge mobility.

In the invention it is preferable that the organic photoconductive material of formula (1) is of the following general formula (2):

(2)

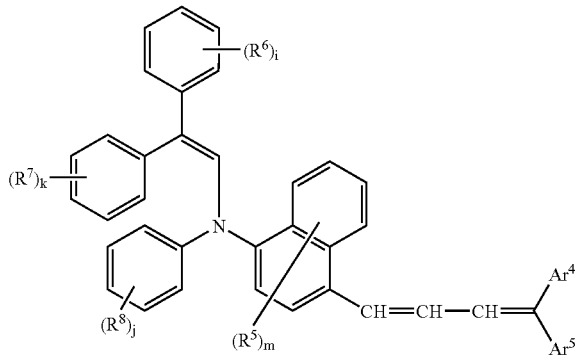

wherein $R^6$, $R^7$c and $R^8$ each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the $R^6$s may be the same or different and may bond to each other to form a cyclic structure; when k is 2 or more, then the $R^7$s may be the same or different and may bond to each other to form a cyclic structure; and when j is 2 or more, then the $R^8$s may be the same or different and may bond to each other to form a cyclic structure; $Ar^4$, $Ar^5$, $R^5$ and m represent the same as those defined in formula (1).

According to the invention, the organic photoconductive material of formula (1) is an enamine compound of formula (2), and accordingly its charge mobility is especially high. When the organic photoconductive material having such higher charge mobility is used as a charge-transporting substance, then an electrophotographic photoreceptor of high reliability can be realized which has high charge potential, high sensitivity, good responsiveness to light and good durability, of which the characteristics do not lower even when it is driven at low temperatures or at high speed and even when it is exposed to light. In addition, when the organic photoconductive material is used in sensor materials, EL elements or electrostatic recording elements, then apparatuses of good responsiveness can be provided.

The invention also provides an electrophotographic photoreceptor comprising a conductive support of a photoconductive material and a photosensitive layer formed on the conductive support and containing a charge-generating substance and a charge-transporting substance, the charge-transporting substance comprising the organic photoconductive material as mentioned above.

According to the invention, the photosensitive layer of the electrophotographic photoreceptor contains, as the charge-transporting substance therein, the organic photoconductive material of formula (1) or (2) of high charge mobility, and therefore the photoreceptor has high charge potential, high sensitivity, good responsiveness to light and good durability, of which the characteristics do not lower even when it is driven at low temperatures or at high speed. In addition, the photosensitive layer may realize good charge-transporting ability, not requiring a polysilane, and its characteristics do not lower even when it is exposed to light, and the reliability of the photoreceptor is therefore high.

In the invention it is preferable that the charge-generating substance comprises oxotitanium phthalocyanine.

According to the invention, the photosensitive layer in the photoreceptor may contain oxotitanium phthalocyanine as the charge-generating substance therein. Oxotitanium phthalocyanine is a charge-generating substance that has high charge-generating efficiency and charge-injecting efficiency. Therefore, when oxotitanium phthalocyanine absorbs light, then a large number of charges are generated, which are efficiently injected into a charge-transporting substance without being accumulated therein. As so mentioned above, in addition, the photosensitive layer in the photoreceptor contains, as the charge-transporting substance therein, the organic photoconductive material of formula (1) or (2) of high charge mobility. Therefore, in the electrophotographic photoreceptor, the charges generated by the charge-generating substance that has absorbed light are efficiently injected into the charge-transporting substance and are smoothly transported, and the photoreceptor enjoys high sensitivity and high resolution power.

In the invention it is preferable that the photosensitive layer in the photoreceptor has a laminate structure comprising a charge generation layer that contains the charge-generating substance as above and a charge transportation layer that contains a charge-transporting substance.

According to the invention, the photosensitive layer has a laminate structure comprising a charge generation layer that contains a charge-generating substance and a charge transportation layer that contains a charge-transporting substance. In this, the two layers separately attain the charge-generating function and the charge-transporting function. Having the laminate structure where the two layers separately attain the charge-generating function and the charge-transporting function, optimum materials may be selected for the charge-generating function and the charge-transporting function. Therefore, the electrophotographic photoreceptor may have higher sensitivity, good stability even in repeated use, and increased durability.

Since the photosensitive layer therein has a laminate structure comprising a charge generation layer that contains a charge-generating substance and a charge transportation layer that contains a charge-transporting substance, an electrophotographic photoreceptor can be provided which has higher sensitivity, good stability even in repeated use, and increased durability.

In the invention it is preferable that the charge transportation layer contains a binder resin, and in the charge transportation layer, A/B, which is a ratio of the charge-transporting substance (A) to the binder resin (B) by weight, falls between 10/12 and 10/30.

According to the invention, the ratio of the charge-transporting substance (A) to the binder resin (B) by weight in the charge transportation layer falls between 10/12 and 10/30. As so mentioned above, since the charge-transporting substance therein contains the organic photoconductive material of high charge mobility, the photosensitive layer can maintain good responsiveness to light even when its binder resin content is higher than that of conventional photosensitive layers containing a known charge-transporting substance. Accordingly, the printing durability of the charge transportation layer can be improved and the durability itself of the electrophotographic photoreceptor can be therefore improved with no reduction in the responsiveness thereof to light.

Moreover, according to the invention, since the photosensitive layer may maintain good responsiveness to light even when the binder resin content is higher than that of conventional photosensitive layers containing a known charge-transporting substance, the printing durability of the charge transportation layer therein can be improved and the durability itself of the electrophotographic photoreceptor can be therefore improved with no reduction in the responsiveness thereof to light.

In the invention it is preferable that an interlayer is disposed between the conductive support and the photosensitive layer.

According to the invention, an interlayer is disposed between the conductive support and the photosensitive layer. Accordingly, in this, charge injection from the conductive support to the photosensitive layer is prevented, and the chargeability of the photosensitive layer is therefore prevented from lowering. This means that the surface charges in the area except that to be erased through exposure to light are prevented from being decreased and the image to be formed is prevented from having defects of fogging, etc. In addition, the interlayer may cover the surface defects of the conductive support to thereby make the support have a uniform surface, and the film-forming ability of the photosensitive layer is therefore enhanced. Further, the interlayer prevents the photosensitive layer from being peeled off from the conductive support, and the adhesiveness between the conductive support and the photosensitive layer is thereby enhanced.

The interlayer disposed between the conductive support and the photosensitive layer in this embodiment prevents the chargeability of the photosensitive layer from lowering and prevents the image to be formed is prevented from having defects of fogging, etc. In addition, the film-forming ability of the photosensitive layer is enhanced and the adhesiveness between the conductive support and the photosensitive layer is therefore enhanced.

The invention also provides an image-forming apparatus comprising the electrophotographic photoreceptor as above.

According to the invention, as so mentioned hereinabove, the electrophotographic photoreceptor has high charge potential, high sensitivity, good responsiveness to light and good durability, of which the characteristics do not lower even when it is driven at low temperatures or at high speed. Accordingly, the image-forming apparatus has high reliability and forms images of high quality. In addition, since the properties of the photoreceptor do not worsen even through exposure to light, the photoreceptor exposed to light during maintenance thereof does not worsen the image quality, and the reliability of the image-forming apparatus is therefore high.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
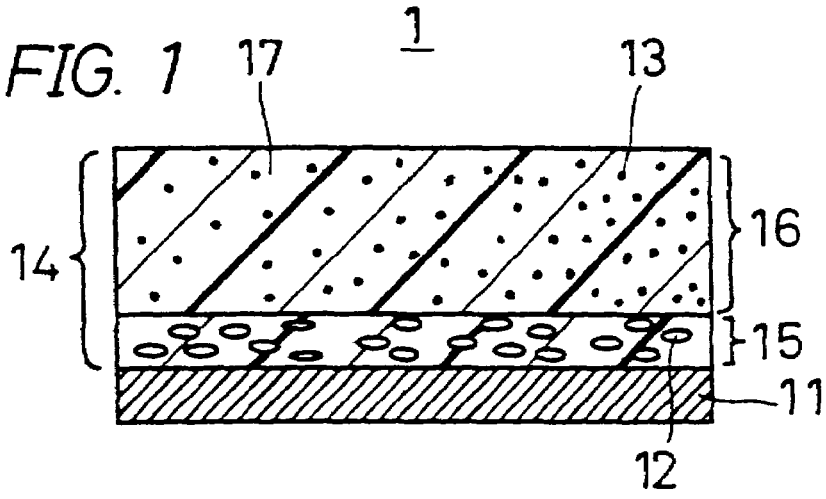
FIG. 1 is a schematic cross-sectional view showing, in a simplified manner, the constitution of an electrophotographic photoreceptor, one embodiment of the electrophotographic photoreceptor of the invention.

Now referring to the drawings, preferred embodiments of the invention are described below.

The organic photoconductive material of the invention is an enamine compound of the following general formula (1):

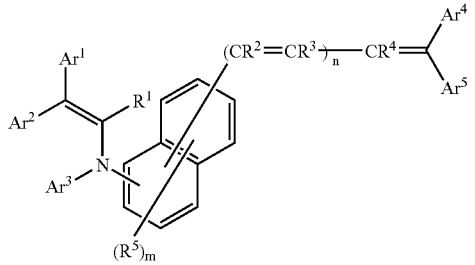

(1)

In formula (1), $Ar^1$ and $Ar^2$ each represent an optionally-substituted aryl group or an optionally-substituted heterocyclic group. Specific examples of $Ar^1$ and $Ar^2$ are an aryl group such as phenyl, tolyl, methoxyphenyl, naphthyl and biphenylyl; and a heterocyclic group such as furyl, thienyl, thiazolyl, benzofuryl and N-methylindolyl.

In formula (1), $Ar^3$ represents an optionally-substituted aryl group, an optionally-substituted heterocyclic group, an optionally-substituted aralkyl group, or an optionally-substituted alkyl group. Specific examples of $Ar^3$ are an aryl group such as phenyl, tolyl, methoxyphenyl, naphthyl, pyrenyl, biphenylyl, phenoxyphenyl and p-(phenylthio)phenyl; a heterocyclic group such as furyl, thienyl, thiazolyl, benzofuryl, benzothiophenyl, N-methylindolyl, benzothiazolyl, benzoxazolyl and N-ethylcarbazolyl; an aralkyl group such as benzyl, p-methoxybenzyl and 1-naphthylmethyl; and an alkyl group such as isopropyl, t-butyl, cyclohexyl and cyclopentyl.

In formula (1), $Ar^4$ and $Ar^5$ each represent a hydrogen atom, an optionally-substituted aryl group, an optionally-substituted heterocyclic group, an optionally-substituted aralkyl group, or an optionally-substituted alkyl group, but $Ar^4$ and $Ar^5$ are not hydrogen atoms at the same time. Specific examples except hydrogen atom of $Ar^4$ and $Ar^5$ are an aryl group such as phenyl, tolyl, methoxyphenyl, naphthyl, pyrenyl, biphenylyl, phenoxyphenyl, p-(phenylthio) phenyl and p-styrylphenyl; a heterocyclic group such as furyl, thienyl, thiazolyl, benzofuryl, benzothiophenyl, N-methylindolyl, benzothiazolyl, benzoxazolyl and N-ethylcarbazolyl; an aralkyl group such as benzyl, p-methoxybenzyl and 1naphthylmethyl; and an alkyl group such as methyl, ethyl, trifluoromethyl, fluoromethyl, isopropyl, t-butyl, cyclohexyl, cyclopentyl and 2-thienylmethyl.

$Ar^4$ and $Ar^5$ may bond to each other via an atom or an atomic group to form a cyclic structure. Specific examples of the atom that bonds $Ar^4$ and $Ar^5$ are oxygen and sulfur atoms. Specific examples of the atomic group that bonds $Ar^4$ and $Ar^5$ are a divalent atomic group such as a nitrogen atom having an alkyl group, and other divalent groups, for example, an alkylene group such as methylene, ethylene and methylethylene; an unsaturated alkylene group such as vinylene and propenylene; a hetero atom-containing alkylene group such as oxymethylene (chemical formula, —O—$CH_2$—); and a hetero atom-containing unsaturated alkylene group such as thiovinylene (chemical formula: —S—CH═CH—).

In formula (1) $R^5$ represents an optionally-substituted alkyl group, an optionally-substituted alkoxy group, an optionally-substituted dialkylamino group, an optionally-substituted aryl group, a halogen atom, or a hydrogen atom, and m indicates an integer of from 1 to 6. When m is 2 or more, then the $R^5$s may be the same or different and may bond to each other to form a cyclic structure. Specific examples except hydrogen atom of $R^5$ are an alkyl group such as methyl, ethyl, n-propyl, isopropyl, trifluoromethyl, fluoromethyl and 1-methoxyethyl; an alkoxy group such as methoxy, ethoxy, n-propoxy and isopropoxy; a dialkylamino group such as dimethylamino, diethylamino and diisopropylamino; an aryl group such as phenyl, tolyl, methoxyphenyl and naphthyl; and halogen atom such as fluorine and chlorine atoms.

In formula (1), $R^1$ represents a hydrogen atom, a halogen atom, or an optionally-substituted alkyl group. Specific examples except hydrogen atom of $R^1$ are an alkyl group such as methyl, ethyl, n-propyl, isopropyl and trifluoromethyl; and a halogen atom such as fluorine and chlorine atoms.

In formula (1), $R^2$, $R^3$ and $R^4$ each represent a hydrogen atom, an optionally-substituted alkyl group, an optionally-substituted aryl group, an optionally-substituted heterocyclic group, or an optionally-substituted aralkyl group. Specific examples except hydrogen atom of $R^2$, $R^3$ and $R^4$ are an alkyl group such as methyl, ethyl, n-propyl, isopropyl, trifluoromethyl and 2-thienylmethyl; an aryl group such as phenyl, tolyl, methoxyphenyl and naphthyl; a heterocyclic group such as furyl, thienyl and thiazolyl; and an aralkyl group such as benzyl and p-methoxybenzyl.

In formula (1), n indicates an integer of from 0 to 3. When n is 2 or 3, then the $R^2$s may be the same or different and the $R^3$s may be the same or different.

In formula (1), however, when n is 0, then $Ar^3$ is an optionally-substituted heterocyclic group.

The organic photoconductive material of the invention is an enamine compound of formula (1), and therefore has high charge mobility. When the organic photoconductive material having such high charge mobility of the invention is used as a charge-transporting substance, it realizes an electrophotographic photoreceptor of high reliability that has high charge potential, high sensitivity, good responsiveness to light and good durability, of which the characteristics do not lower even when they are driven at low temperatures or at high speed and even when they are exposed to light. When the organic photoconductive material is used in sensor materials, EL elements or electrostatic recording elements, it provides apparatuses of good responsiveness.

Of the organic photoconductive material of formula (1), preferred are enamine compounds of the following general formula (2):

(2)

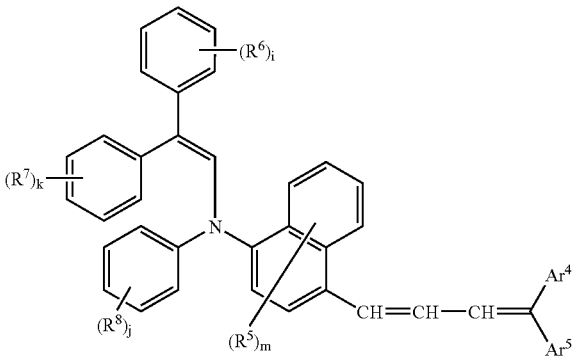

In formula (2), $R^6$, $R^7$ and $R^8$ each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the $R^6$s may be the same or different and may bond to each other to form a cyclic structure; when k is 2 or more, then the $R^7$s may be the same or different and may bond to each other to form a cyclic structure; and when j is 2 or more, then the $R^8$s may be the same or different and may bond to each other to form a cyclic structure. Specific examples except hydrogen atom of $R^6$, $R^7$ and $R^8$ are an alkyl group such as methyl, ethyl, n-propyl, isopropyl, trifluoromethyl, fluoromethyl and 1-methoxyethyl; an alkoxy group such as methoxy, ethoxy, n-propoxy and isopropoxy; a dialkylamino group such as dimethylamino, diethylamino and diisopropylamino; an aryl group such as phenyl, tolyl, methoxyphenyl and naphthyl; and a halogen atom such as fluorine and chlorine atoms.

In formula (2), $Ar^4$, $Ar^5$, $R^5$ and m represent the same as those defined in formula (1).

Enamine compounds of formula (2) have especially high charge mobility and are easy to produce. Accordingly, the enamine compounds of formula (2) falling within the scope of formula (1) give organic photoconductive materials of especially high charge mobility.

Of the organic photoconductive material of formula (1), those where $Ar^1$ and $Ar^2$ are phenyl groups, $Ar^3$ is any of phenyl, tolyl, p-methoxyphenyl, biphenylyl, naphthyl or thienyl group, at least one of $Ar^4$ and $Ar^5$ is any of phenyl, p-tolyl, p-methoxyphenyl, naphthyl, thienyl or thiazolyl group; $R^1$, $R^2$, $R^3$ and $R^4$ are all hydrogen atoms and n is 1 are especially preferred in view of their characteristics, production costs and the productivity.

Specific examples of the organic photoconductive material of formula (1) of the invention are the compounds having the groups listed in Table 1 to Table 32 below, which, however, are not intended to restrict the scope of the photoconductive material of the invention. The groups in Table 1 to Table 32 correspond to those in formula (1). For example, Compound No. 1 in Table 1 is an enamine compound having the following structural formula (1-1):

(1-1)

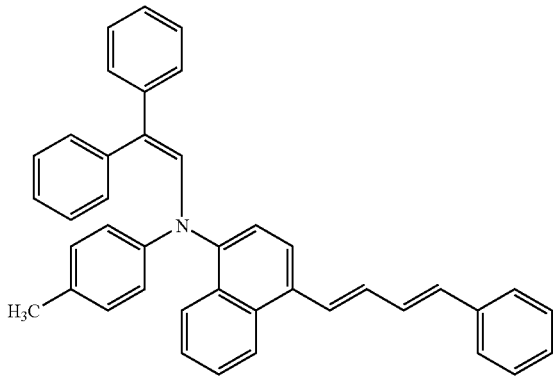

The cyclic structure to be formed by $Ar^4$ and Ar 5 that bond to each other is shown in the fused column for $Ar^4$ and $Ar^5$. The cyclic-structured group shown in the column comprises the carbon-carbon double bond to which $Ar^4$ and $Ar^5$ bond and the cyclic structure formed by $Ar^4$ and $Ar^5$ along with the carbon-carbon double bond.

TABLE 1

| Compound No. | $Ar^1$ | $Ar^2$ | $R^1$ | $Ar^3$ | 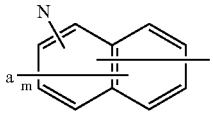 |
|---|---|---|---|---|---|
| 1 | 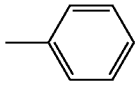 | 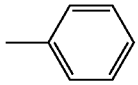 | H | 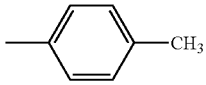 | 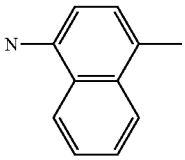 |
| 2 | 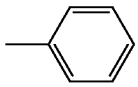 | 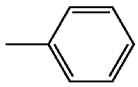 | H | 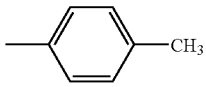 | 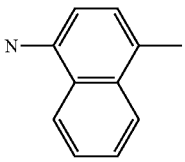 |
| 3 | 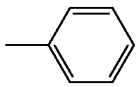 | 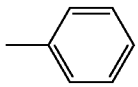 | H | 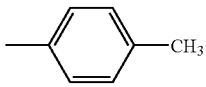 | 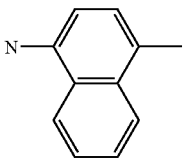 |
| 4 | 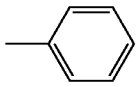 | 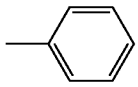 | H | 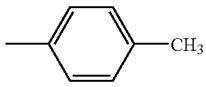 | 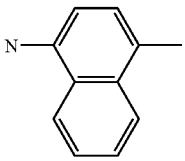 |

TABLE 1-continued
| | | | | |
|---|---|---|---|---|
| 5 | 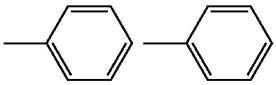 | H | 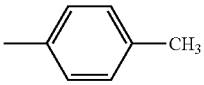 | 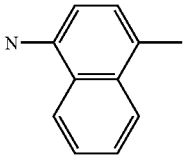 |
| 6 | 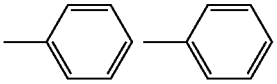 | H | 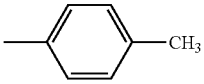 | 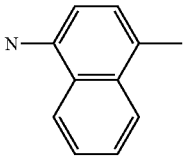 |
| 7 | 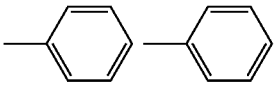 | H | 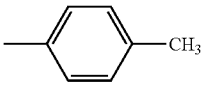 | 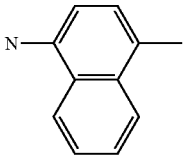 |
| Compound No. | n | $-(CR^2{=}CR^3)_n-$ | $R^4$ | $Ar^4$ | $Ar^5$ |
|---|---|---|---|---|---|
| 1 | 1 | CH═CH | H | H | 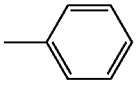 |
| 2 | 1 | CH═CH | H | H | 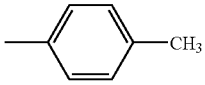 |
| 3 | 1 | CH═CH | H | $-CH_3$ | 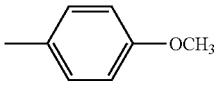 |
| 4 | 1 | CH═CH | H | H | 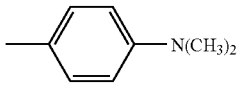 |
| 5 | 1 | CH═CH | H | H | 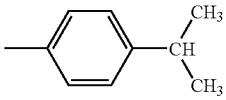 |
| 6 | 1 | CH═CH | H | H | 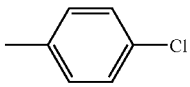 |
| 7 | 1 | CH═CH | H | $-CH_3$ | 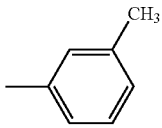 |

TABLE 2
| Compound No. | $Ar^1$ | $Ar^2$ | $R^1$ | $Ar^3$ | 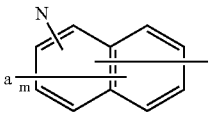 |
|---|---|---|---|---|---|
| 8 | 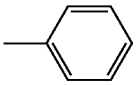 | 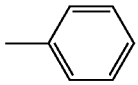 | H | 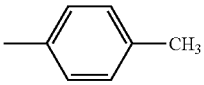 | 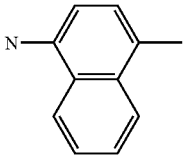 |
| 9 | 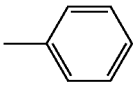 | 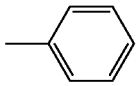 | H | 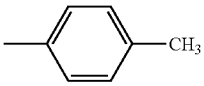 | 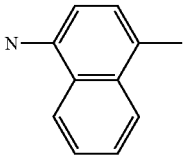 |
| 10 | 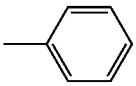 | 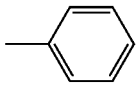 | H | 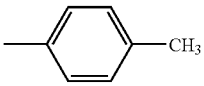 | 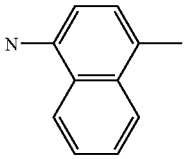 |
| 11 | 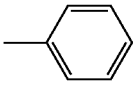 | 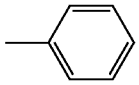 | H | 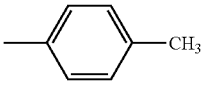 | 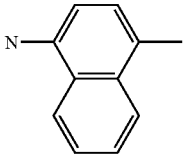 |
| 12 | 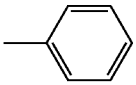 | 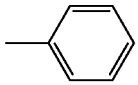 | H | 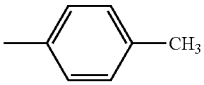 | 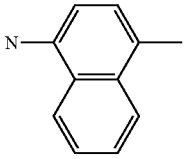 |
| 13 | 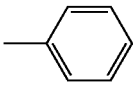 | 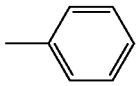 | H | 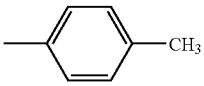 | 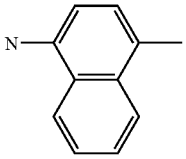 |
| 14 | 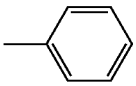 | 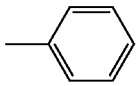 | H | 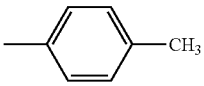 | 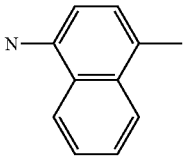 |
| Compound No. | n | $-(CR^2{=}CR^3)_n-R^4$ | $Ar^4$ | $Ar^5$ |
|---|---|---|---|---|
| 8 | 1 | CH=CH | H | H | 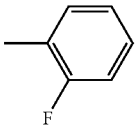 |

TABLE 2-continued
| | | | | | |
|---|---|---|---|---|---|
| 9 | 1 | CH═CH | H | —$CH_3$ | 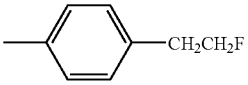 |
| 10 | 1 | CH═CH | H | —$CH_3$ | 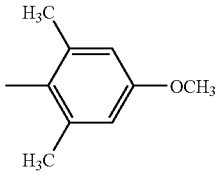 |
| 11 | 1 | CH═CH | H | H | 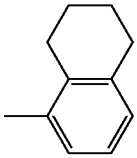 |
| 12 | 1 | CH═CH | H | H | 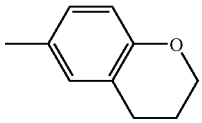 |
| 13 | 1 | CH═CH | H | H | 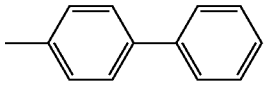 |
| 14 | 1 | CH═CH | H | H | 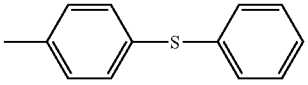 |
TABLE 3
| Compound No. | $Ar^1$ | $Ar^2$ | $R^1$ | $Ar^3$ | 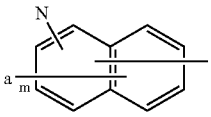 |
|---|---|---|---|---|---|
| 15 | 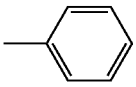 | 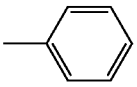 | H | 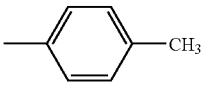 | 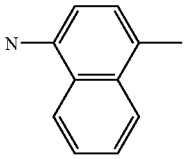 |
| 16 | 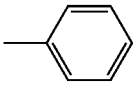 | 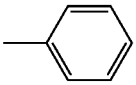 | H | 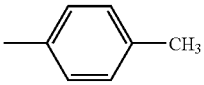 | 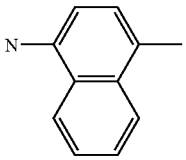 |
| 17 | 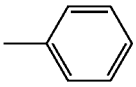 | 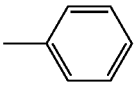 | H | 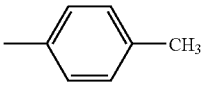 | 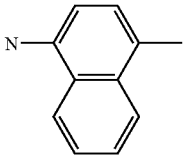 |

TABLE 3-continued
| | | | | |
|---|---|---|---|---|
| 18 | 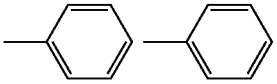 | H | 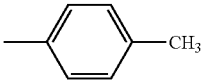 | 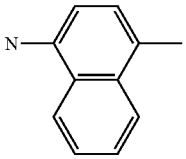 |
| 19 | 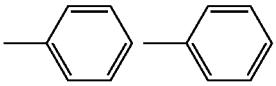 | H | 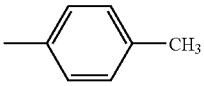 | 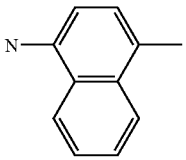 |
| 20 | 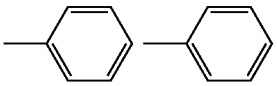 | H | 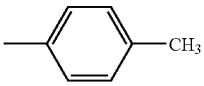 | 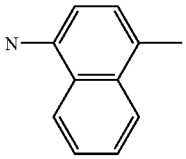 |
| 21 | 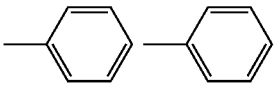 | H | 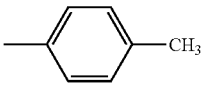 | 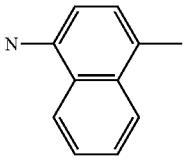 |
| Compound No. | n | —(CR²=CR³)ₙ— | R⁴ | Ar⁴ | Ar⁵ |
|---|---|---|---|---|---|
| 15 | 1 | CH=CH | H | H | 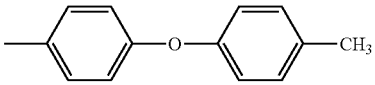 |
| 16 | 1 | CH=CH | H | —CH₃ | 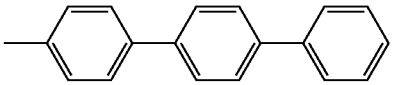 |
| 17 | 1 | CH=CH | H | H | 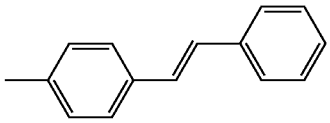 |
| 18 | 1 | CH=CH | H | —CH₃ | 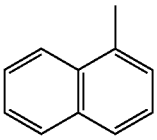 |
| 19 | 1 | CH=CH | H | H | 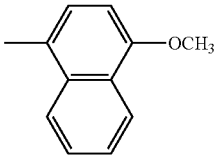 |
| 20 | 1 | CH=CH | H | H | 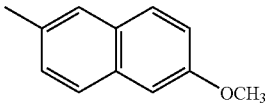 |

TABLE 3-continued
| | | | | | |
|---|---|---|---|---|---|
| 21 | 1 | CH═CH | H | H | 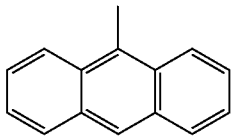 |
TABLE 4
| Compound No. | $Ar^1$ | $Ar^2$ | $R^1$ | $Ar^3$ | 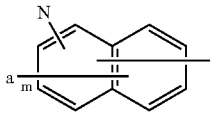 |
|---|---|---|---|---|---|
| 22 | 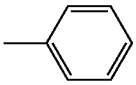 | 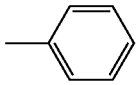 | H | 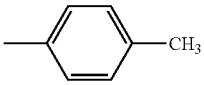 | 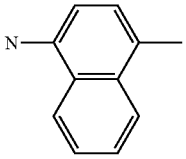 |
| 23 | 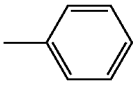 | 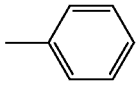 | H | 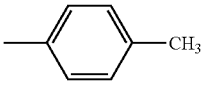 | 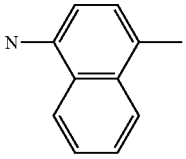 |
| 24 | 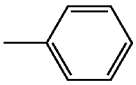 | 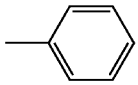 | H | 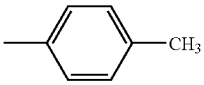 | 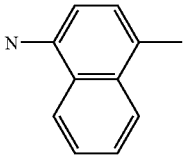 |
| 25 | 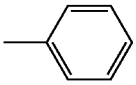 | 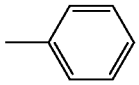 | H | 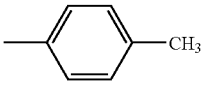 | 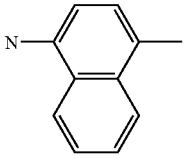 |
| 26 | 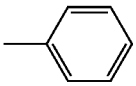 | 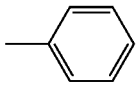 | H | 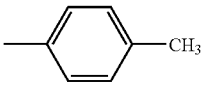 | 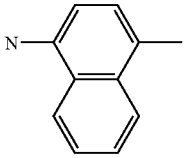 |
| 27 | 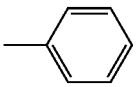 | 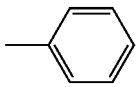 | H | 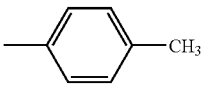 | 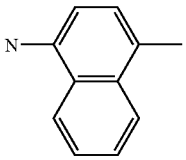 |
| 28 | 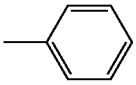 | 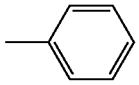 | H | 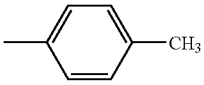 | 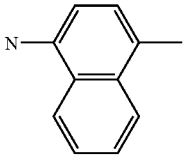 |

TABLE 4-continued
| Compound No. | n | $-(CR^2{=}CR^3)_n-R^4$ | | $Ar^4$ | $Ar^5$ |
|---|---|---|---|---|---|
| 22 | 1 | CH=CH | H | H | 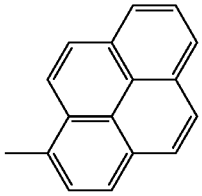 |
| 23 | 1 | CH=CH | H | $-CH_3$ | 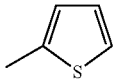 |
| 24 | 1 | CH=CH | H | $-CH_3$ | 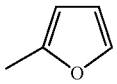 |
| 25 | 1 | CH=CH | H | H | 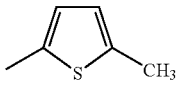 |
| 26 | 1 | CH=CH | H | H | 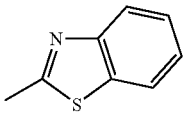 |
| 27 | 1 | CH=CH | H | H | 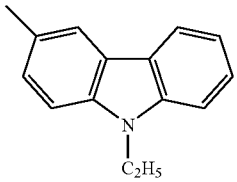 |
| 28 | 1 | CH=CH | H | 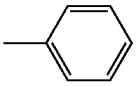 | 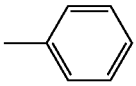 |
TABLE 5
| Compound No. | $Ar^1$ | $Ar^2$ | $R^1$ | $Ar^3$ | 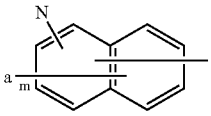 |
|---|---|---|---|---|---|
| 29 | 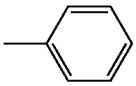 | 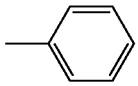 | H | 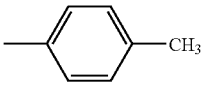 | 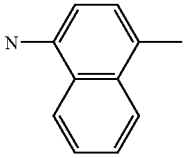 |
| 30 | 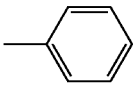 | 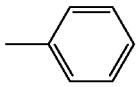 | H | 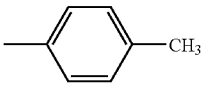 | 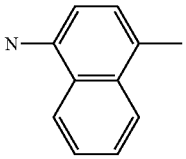 |

TABLE 5-continued

| | | | | |
|---|---|---|---|---|
| 31 | | H | $CH_3$ | N |
| 32 | | H | $CH_3$ | N |
| 33 | | H | $CH_3$ | N |
| 34 | | H | $CH_3$ | N |
| 35 | | H | $CH_3$ | N |

| Compound No. | n | $—(CR^2{=}CR^3)_n—R^4$ | | $Ar^4$ | $Ar^5$ |
|---|---|---|---|---|---|
| 29 | 1 | CH=CH | H | $CH_3$ | $CH_3$ |
| 30 | 1 | CH=CH | H | $OCH_3$ | $OCH_3$ |
| 31 | 1 | CH=CH | H | $N(CH_3)_2$ | $N(CH_3)_2$ |
| 32 | 1 | CH=CH | H | | |
| 33 | 1 | CH=CH | H | | S |
| 34 | 1 | CH=CH | H | | |

TABLE 5-continued
| | | | | |
|---|---|---|---|---|
| 35 | 1 | CH═CH | H | 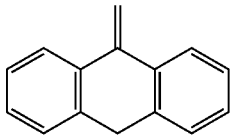 |
TABLE 6
| Compound No. | $Ar^1$ | $Ar^2$ | $R^1$ | $Ar^3$ | 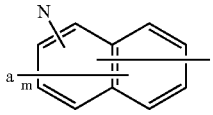 |
|---|---|---|---|---|---|
| 36 | 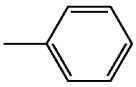 | 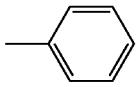 | H | 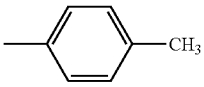 | 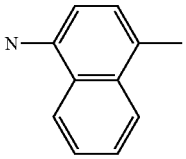 |
| 37 | 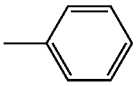 | 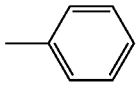 | H | 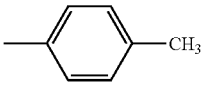 | 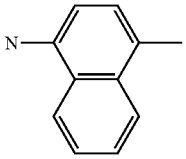 |
| 38 | 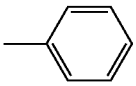 | 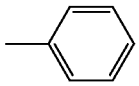 | H | 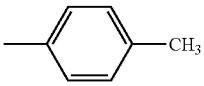 | 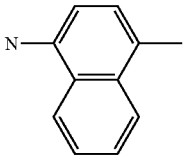 |
| 39 | 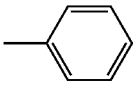 | 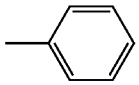 | H | 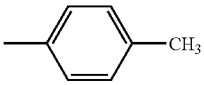 | 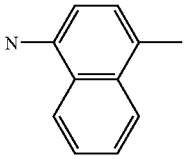 |
| 40 | 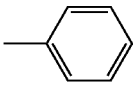 | 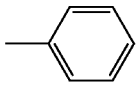 | H | 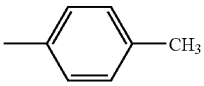 | 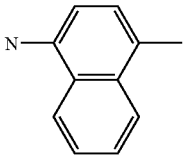 |
| 41 | 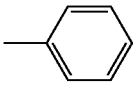 | 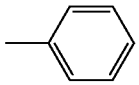 | H | 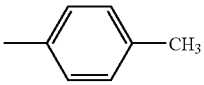 | 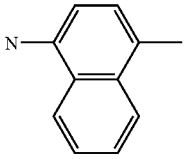 |
| 42 | 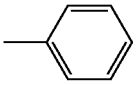 | 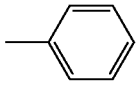 | H | 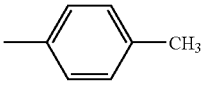 | 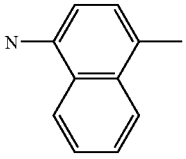 |

TABLE 6-continued
| Compound No. | n | $—(CR^2{=}CR^3)_n—$ | $R^4$ | $Ar^4$ | $Ar^5$ |
|---|---|---|---|---|---|
| 36 | 1 | CH═CH | H | 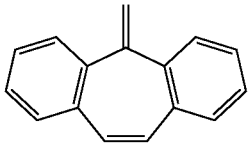 | |
| 37 | 1 | CH═CH | H | 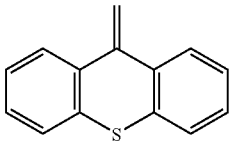 | |
| 38 | 1 | CH═CH | H | 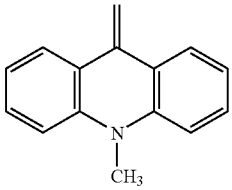 | |
| 39 | 1 | CH═CH | $—CH_3$ | H | 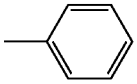 |
| 40 | 1 | CH═CH | 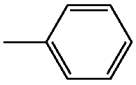 | H | 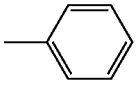 |
| 41 | 1 | 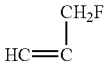 | H | H | 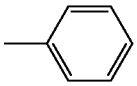 |
| 42 | 1 | 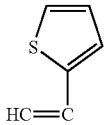 | H | H | 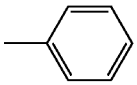 |
TABLE 7
| Compound No. | $Ar^1$ | $Ar^2$ | $R^1$ | $Ar^3$ | 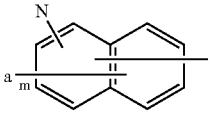 |
|---|---|---|---|---|---|
| 43 | 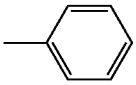 | 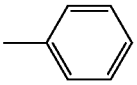 | H | 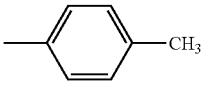 | 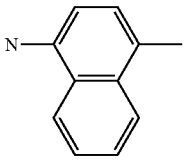 |
| 44 | 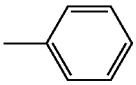 | 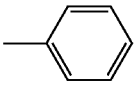 | H | 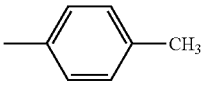 | 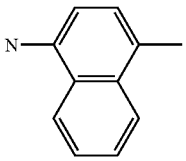 |

TABLE 7-continued
| | | | | |
|---|---|---|---|---|
| 45 | 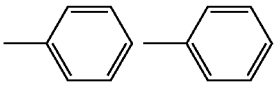 | H | 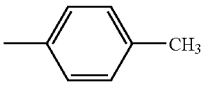 | 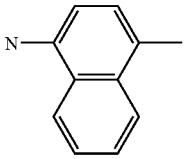 |
| 46 | 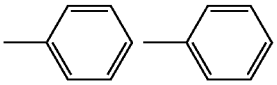 | H | 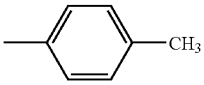 | 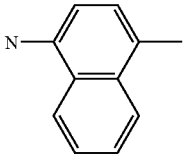 |
| 47 | 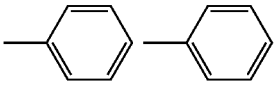 | H | 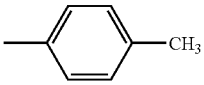 | 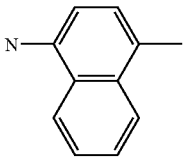 |
| 48 | 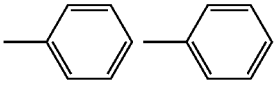 | H | 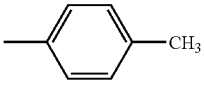 | 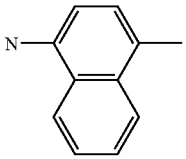 |
| 49 | 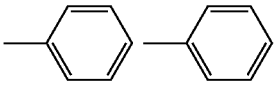 | H | 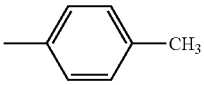 | 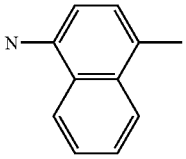 |
| Compound No. | n | $-(CR^2{=}CR^3)_n-$ | $R^4$ | $Ar^4$ | $Ar^5$ |
|---|---|---|---|---|---|
| 43 | 1 | 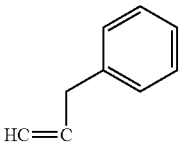 | H | H | 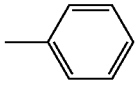 |
| 44 | 1 | 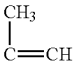 | H | H | 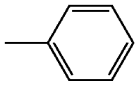 |
| 45 | 1 | 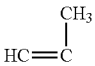 | 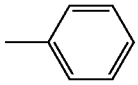 | H | 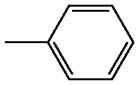 |
| 46 | 2 | CH═CH · CH═CH | H | H | 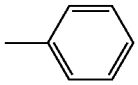 |
| 47 | 2 | CH═CH · CH═CH | H | H | 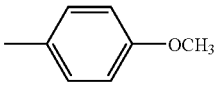 |
| 48 | 2 | CH═CH · CH═CH | H | $-CH_3$ | 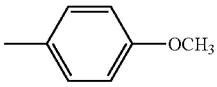 |

TABLE 7-continued
| | | | | | |
|---|---|---|---|---|---|
| 49 | 2 | CH═CH · CH═CH | H | —$CH_3$ | 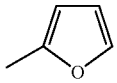 |
TABLE 8
| Compound No. | $Ar^1$ | $Ar^2$ | $R^1$ | $Ar^3$ | 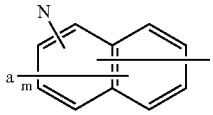 |
|---|---|---|---|---|---|
| 50 | 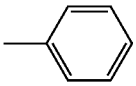 | 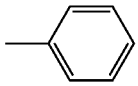 | H | 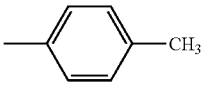 | 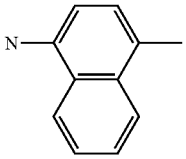 |
| 51 | 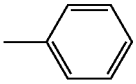 | 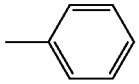 | H | 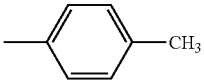 | 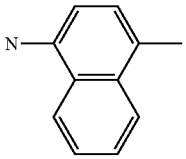 |
| 52 | 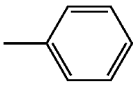 | 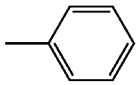 | H | 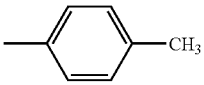 | 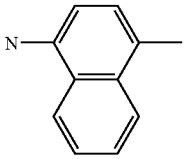 |
| 53 | 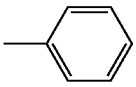 | 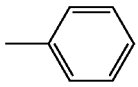 | H | 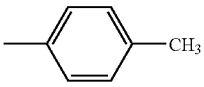 | 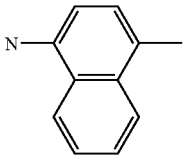 |
| 54 | 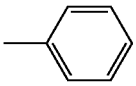 | 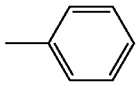 | H | 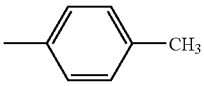 | 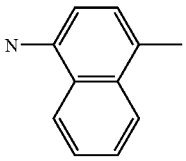 |
| 55 | 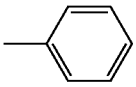 | 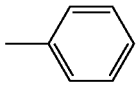 | H | 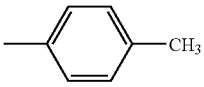 | 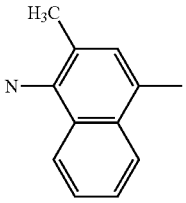 |
| 56 | 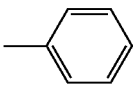 | 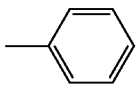 | H | 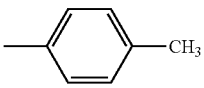 | 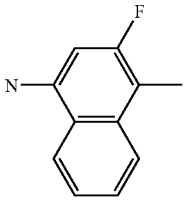 |

TABLE 8-continued
| Compound No. | n | —(CR²=CR³)ₙ— | R⁴ | Ar⁴ | Ar⁵ |
|---|---|---|---|---|---|
| 50 | 2 | CH=CH · CH=CH | H | —$CH_3$ | 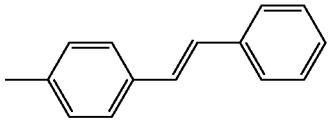 |
| 51 | 2 | CH=CH · CH=CH | H | —$CH_3$ | 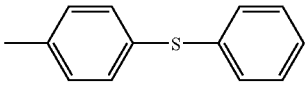 |
| 52 | 2 | 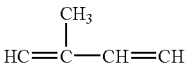 | H | H | 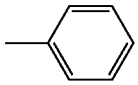 |
| 53 | 2 | 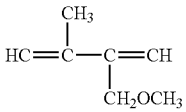 | H | H | 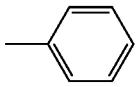 |
| 54 | 3 | —(HC=CH)₃— | H | H | 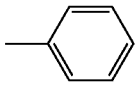 |
| 55 | 1 | CH=CH | H | H | 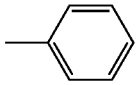 |
| 56 | 1 | CH=CH | H | H | 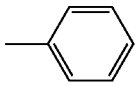 |
TABLE 9
| Compound No. | Ar¹ | Ar² | R¹ | Ar³ | 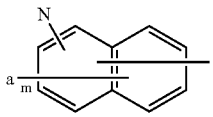 |
|---|---|---|---|---|---|
| 57 | 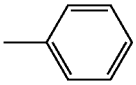 | 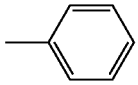 | H | 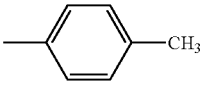 | 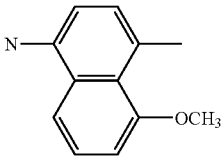 |
| 58 | 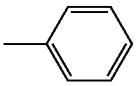 | 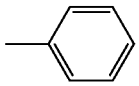 | H | 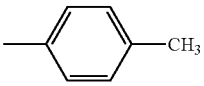 | 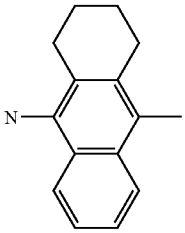 |
| 59 | 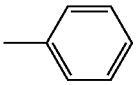 | 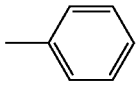 | H | 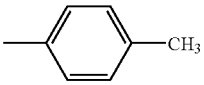 | 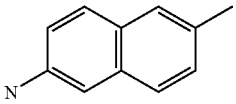 |

TABLE 9-continued
| | | | | |
|---|---|---|---|---|
| 60 | 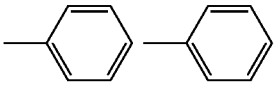 | H | 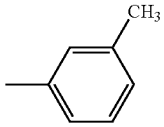 | 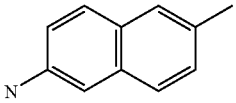 |
| 61 | 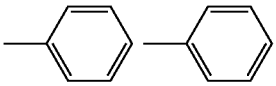 | H | 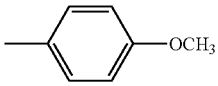 | 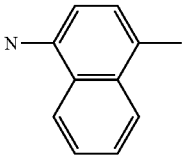 |
| 62 | 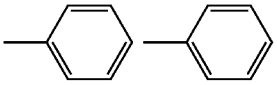 | H | 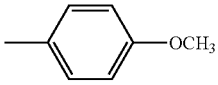 | 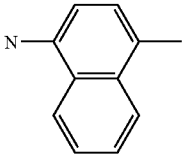 |
| 63 | 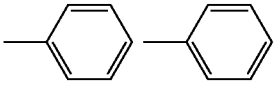 | H | 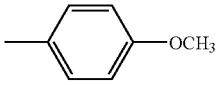 | 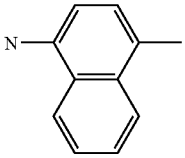 |
| Compound No. | n | $—(CR^2{=}CR^3)_n—$ | $R^4$ | $Ar^4$ | $Ar^5$ |
|---|---|---|---|---|---|
| 57 | 1 | CH=CH | H | H | 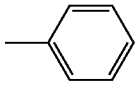 |
| 58 | 1 | CH=CH | H | H | 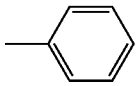 |
| 59 | 1 | CH=CH | H | H | 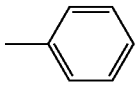 |
| 60 | 1 | CH=CH | H | H | 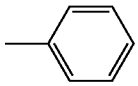 |
| 61 | 1 | CH=CH | H | H | 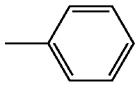 |
| 62 | 1 | CH=CH | H | H | 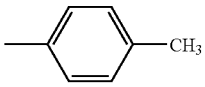 |
| 63 | 1 | CH=CH | H | $—CH_3$ | 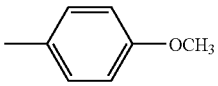 |

TABLE 10
| Compound No. | $Ar^1$ | $Ar^2$ | $R^1$ | $Ar^3$ | 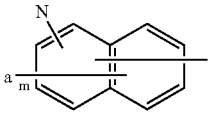 |
|---|---|---|---|---|---|
| 64 | 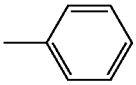 | 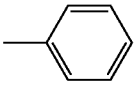 | H | 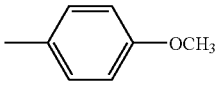 | 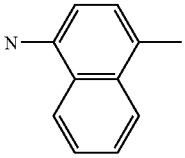 |
| 65 | 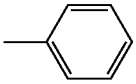 | 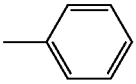 | H | 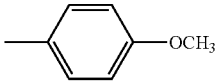 | 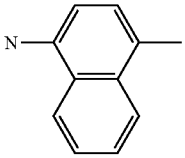 |
| 66 | 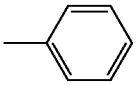 | 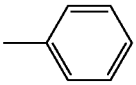 | H | 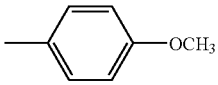 | 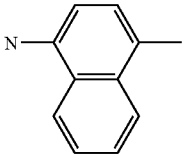 |
| 67 | 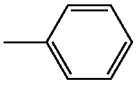 | 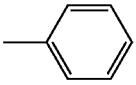 | H | 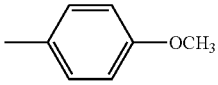 | 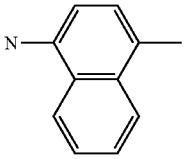 |
| 68 | 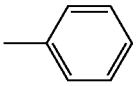 | 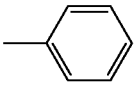 | H | 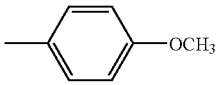 | 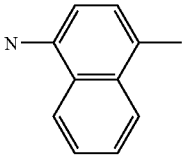 |
| 69 | 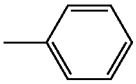 | 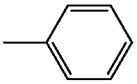 | H | 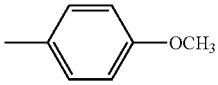 | 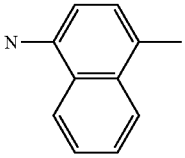 |
| 70 | 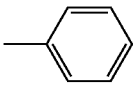 | 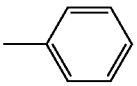 | H | 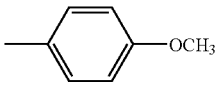 | 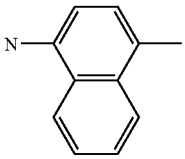 |
| Compound No. | n | $-(CR^2{=}CR^3)_n-R^4$ | $Ar^4$ | $Ar^5$ |
|---|---|---|---|---|
| 64 | 1 | CH=CH | H | H 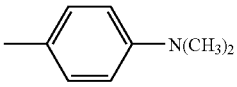 |

TABLE 10-continued
| | | | | | |
|---|---|---|---|---|---|
| 65 | 1 | CH═CH | H | H | 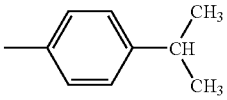 |
| 66 | 1 | CH═CH | H | —$CH_3$ | 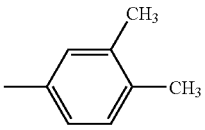 |
| 67 | 1 | CH═CH | H | H | 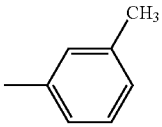 |
| 68 | 1 | CH═CH | H | H | 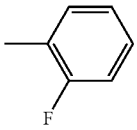 |
| 69 | 1 | CH═CH | H | H | 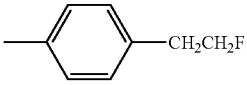 |
| 70 | 1 | CH═CH | H | H | 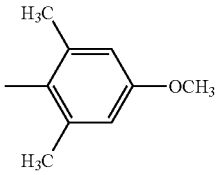 |
TABLE 11
| Compound No. | $Ar^1$ | $Ar^2$ | $R^1$ | $Ar^3$ | 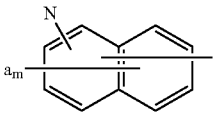 |
|---|---|---|---|---|---|
| 71 | 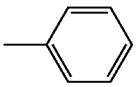 | 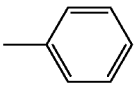 | H | 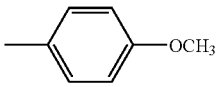 | 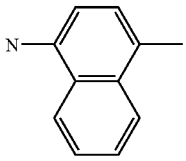 |
| 72 | 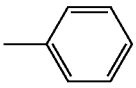 | 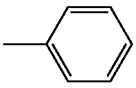 | H | 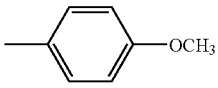 | 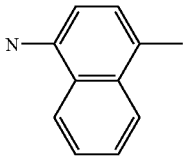 |
| 73 | 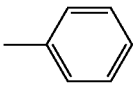 | 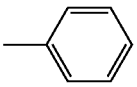 | H | 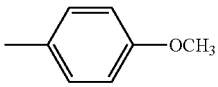 | 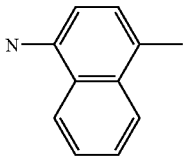 |

TABLE 11-continued
| | | | | | |
|---|---|---|---|---|---|
| 74 | 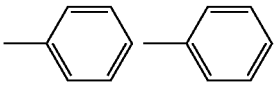 | H | 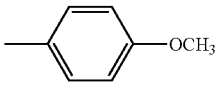 | 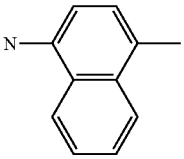 | |
| 75 | 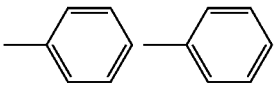 | H | 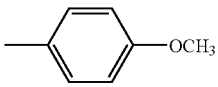 | 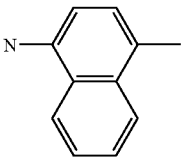 | |
| 76 | 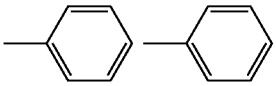 | H | 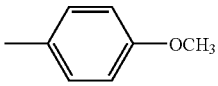 | 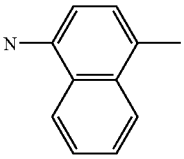 | |
| 77 | 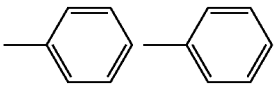 | H | 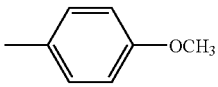 | 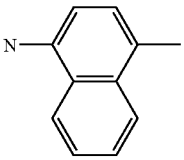 | |
| Compound No. | n | —(CR²=CR³)ₙ— | R⁴ | Ar⁴ | Ar⁵ |
|---|---|---|---|---|---|
| 71 | 1 | CH=CH | H | H | 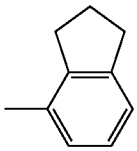 |
| 72 | 1 | CH=CH | H | H | 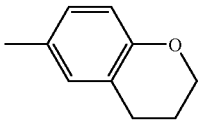 |
| 73 | 1 | CH=CH | H | H | 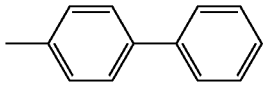 |
| 74 | 1 | CH=CH | H | H | 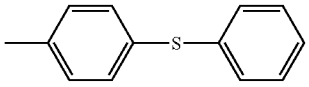 |
| 75 | 1 | CH=CH | H | H | 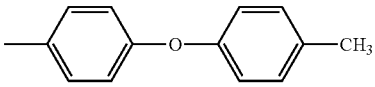 |
| 76 | 1 | CH=CH | H | H | 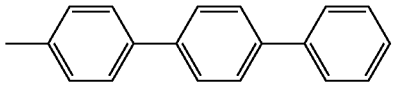 |
| 77 | 1 | CH=CH | H | H | 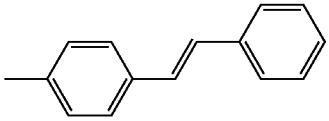 |

TABLE 12
| Compound No. | $Ar^1$ | $Ar^2$ | $R^1$ | $Ar^3$ | 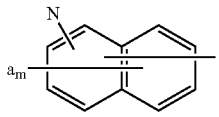 |
|---|---|---|---|---|---|
| 78 | 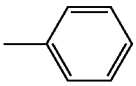 | 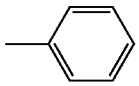 | H | 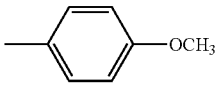 | 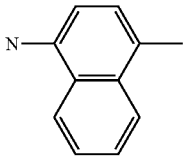 |
| 79 | 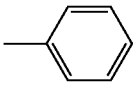 | 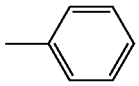 | H | 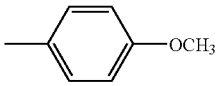 | 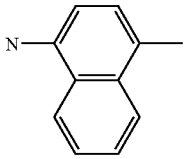 |
| 80 | 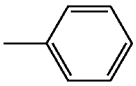 | 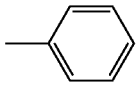 | H | 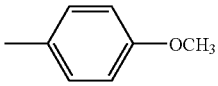 | 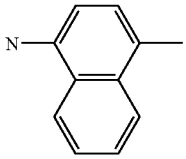 |
| 81 | 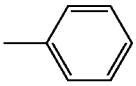 | 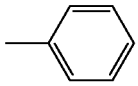 | H | 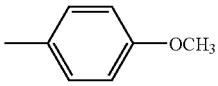 | 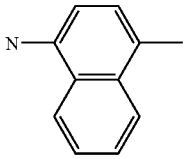 |
| 82 | 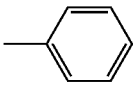 | 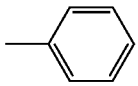 | H | 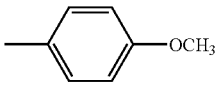 | 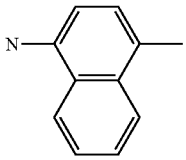 |
| 83 | 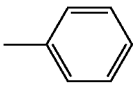 | 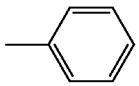 | H | 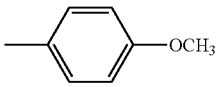 | 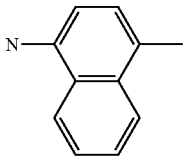 |
| 84 | 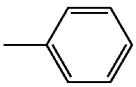 | 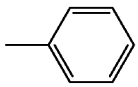 | H | 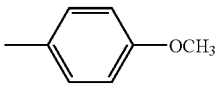 | 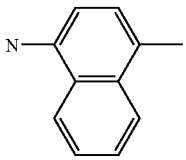 |
| Compound No. | n | $-(CR^2{=}CR^3)_n-$ | $R^4$ | $Ar^4$ | $Ar^5$ |
|---|---|---|---|---|---|
| 78 | 1 | CH=CH | H | H | 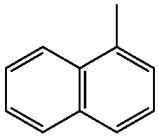 |

TABLE 12-continued
| | | | | | |
|---|---|---|---|---|---|
| 79 | 1 | CH═CH | H | H | 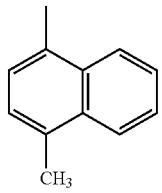 |
| 80 | 1 | CH═CH | H | H | 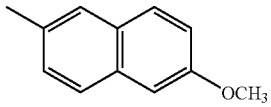 |
| 81 | 1 | CH═CH | H | H | 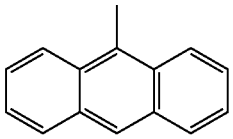 |
| 82 | 1 | CH═CH | H | H | 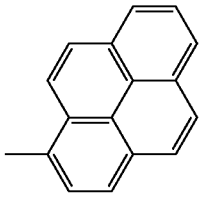 |
| 83 | 1 | CH═CH | H | H | 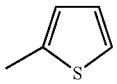 |
| 84 | 1 | CH═CH | H | H | 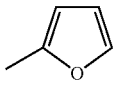 |
TABLE 13
| Compound No. | $Ar^1$ | $Ar^2$ | $R^1$ | $Ar^3$ | 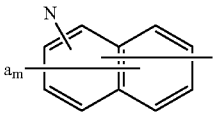 |
|---|---|---|---|---|---|
| 85 | 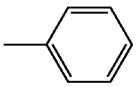 | 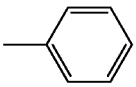 | H | 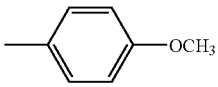 | 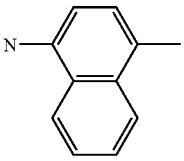 |
| 86 | 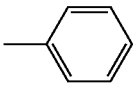 | 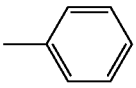 | H | 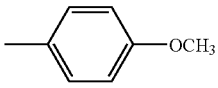 | 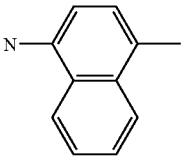 |
| 87 | 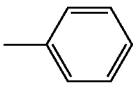 | 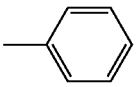 | H | 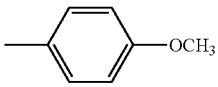 | 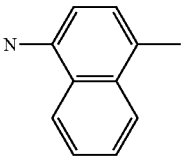 |

TABLE 13-continued

| | | | | |
|---|---|---|---|---|
| 88 | | H | $OCH_3$ | N |
| 89 | | H | $OCH_3$ | N |
| 90 | | H | $OCH_3$ | N |
| 91 | | H | $OCH_3$ | N |

| Compound No. | n | $—(CR^2=CR^3)_n—$ | $R^4$ | $Ar^4$ | $Ar^5$ |
|---|---|---|---|---|---|
| 85 | 1 | CH=CH | H | $—CH_3$ | S, $CH_3$ |
| 86 | 1 | CH=CH | H | $—CH_3$ | N, S |
| 87 | 1 | CH=CH | H | $—CH_3$ | N, $C_2H_5$ |
| 88 | 1 | CH=CH | H | | |
| 89 | 1 | CH=CH | H | $CH_3$ | $CH_3$ |
| 90 | 1 | CH=CH | H | $OCH_3$ | $OCH_3$ |
| 91 | 1 | CH=CH | H | $N(CH_3)_2$ | $N(CH_3)_2$ |

TABLE 14
| Compound No. | $Ar^1$ | $Ar^2$ | $R^1$ | $Ar^3$ | 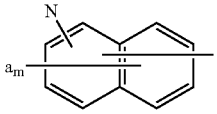 |
|---|---|---|---|---|---|
| 92 | 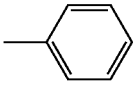 | 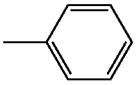 | H | 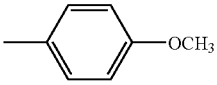 | 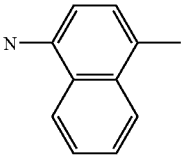 |
| 93 | 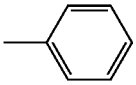 | 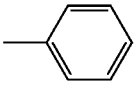 | H | 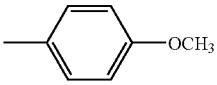 | 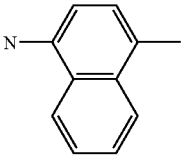 |
| 94 | 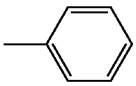 | 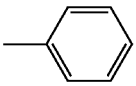 | H | 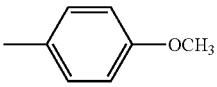 | 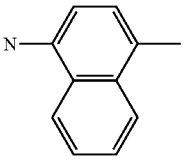 |
| 95 | 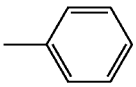 | 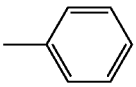 | H | 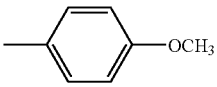 | 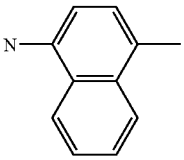 |
| 96 | 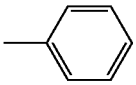 | 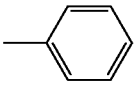 | H | 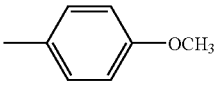 | 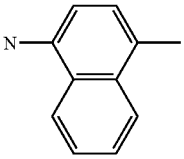 |
| 97 | 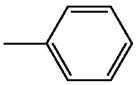 | 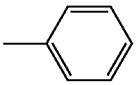 | H | 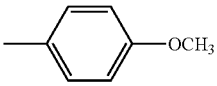 | 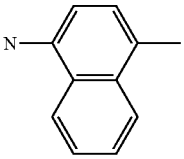 |
| 98 | 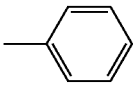 | 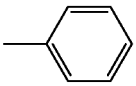 | H | 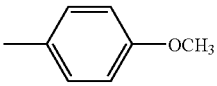 | 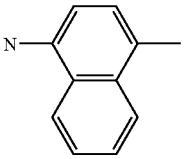 |
| Compound No. | n | $-(CR^2{=}CR^3)_n-$ | $R^4$ | $Ar^4$ | $Ar^5$ |
|---|---|---|---|---|---|
| 92 | 1 | CH=CH | H | 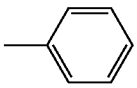 | 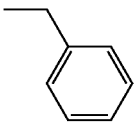 |

TABLE 14-continued
| | | | | |
|---|---|---|---|---|
| 93 | 1 | CH═CH | H | 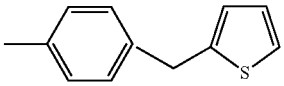 |
| 94 | 1 | CH═CH | H | 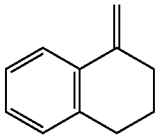 |
| 95 | 1 | CH═CH | H | 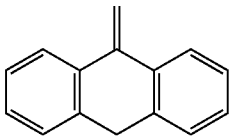 |
| 96 | 1 | CH═CH | H | 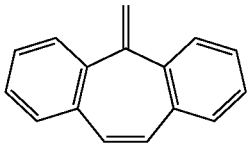 |
| 97 | 1 | CH═CH | H | 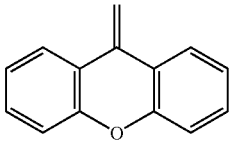 |
| 98 | 1 | CH═CH | H | 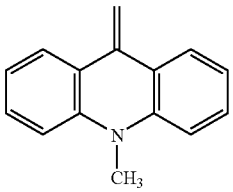 |
TABLE 15
| Compound No. | $Ar^1$ | $Ar^2$ | $R^1$ | $Ar^3$ | 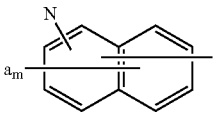 |
|---|---|---|---|---|---|
| 99 | 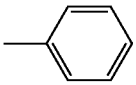 | 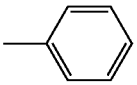 | H | 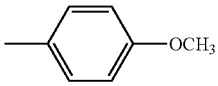 | 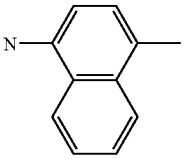 |
| 100 | 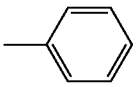 | 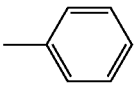 | H | 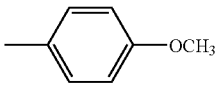 | 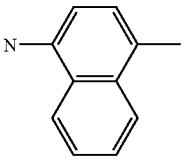 |

TABLE 15-continued
| | | | | |
|---|---|---|---|---|
| 101 | 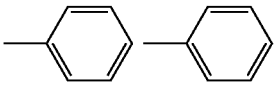 | H | 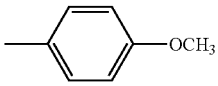 | 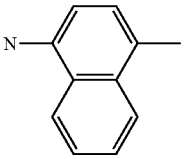 |
| 102 | 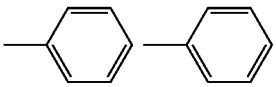 | H | 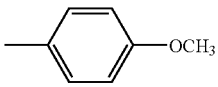 | 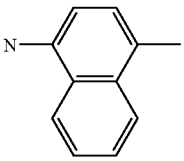 |
| 103 | 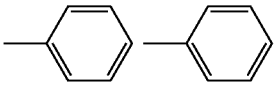 | H | 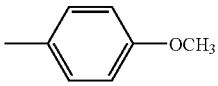 | 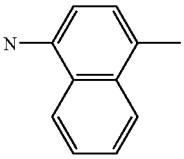 |
| 104 | 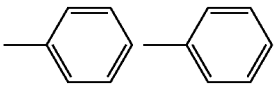 | H | 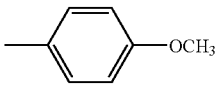 | 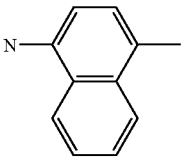 |
| 105 | 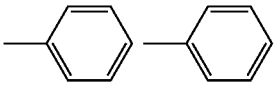 | H | 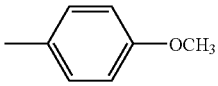 | 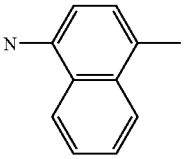 |
| Compound No. | n | $—(CR^2=CR^3)_n—$ | $R^4$ | $Ar^4$ | $Ar^5$ |
|---|---|---|---|---|---|
| 99 | 1 | CH=CH | $—CH_3$ | H | 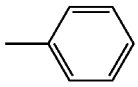 |
| 100 | 1 | CH=CH | 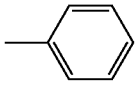 | H | 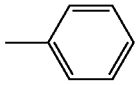 |
| 101 | 1 | 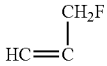 | H | H | 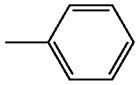 |
| 102 | 1 | 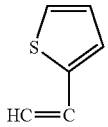 | H | H | 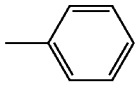 |
| 103 | 1 | 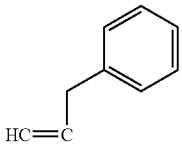 | H | H | 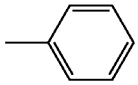 |
| 104 | 1 | 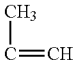 | H | H | 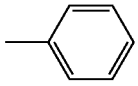 |

TABLE 15-continued
| | | | | | |
|---|---|---|---|---|---|
| 105 | 1 | $HC{=}C(CH_3)$ | 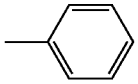 | H | 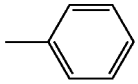 |
TABLE 16
| Compound No. | $Ar^1$ | $Ar^2$ | $R^1$ | $Ar^3$ | 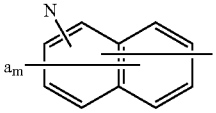 |
|---|---|---|---|---|---|
| 106 | 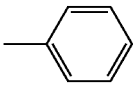 | 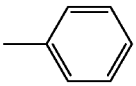 | H | 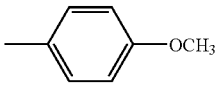 $OCH_3$ | 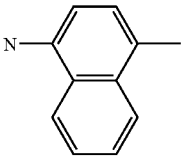 |
| 107 | 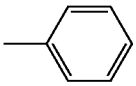 | 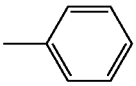 | H | 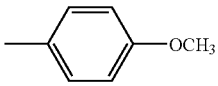 $OCH_3$ | 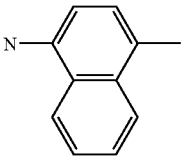 |
| 108 | 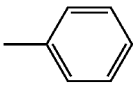 | 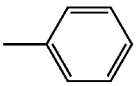 | H | 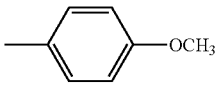 $OCH_3$ | 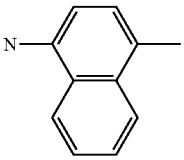 |
| 109 | 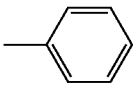 | 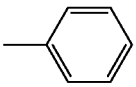 | H | 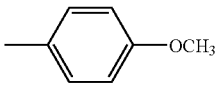 $OCH_3$ | 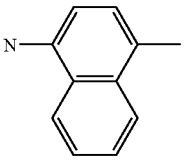 |
| 110 | 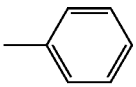 | 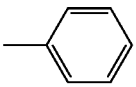 | H | 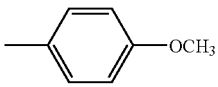 $OCH_3$ | 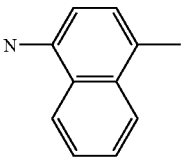 |
| 111 | 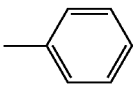 | 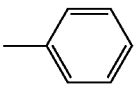 | H | 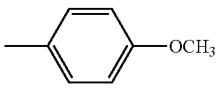 $OCH_3$ | 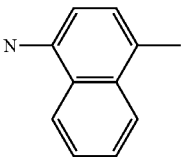 |
| 112 | 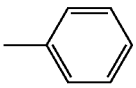 | 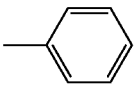 | H | 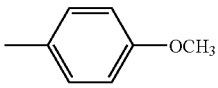 $OCH_3$ | 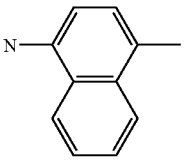 |

TABLE 16-continued
| Compound No. | n | $-(CR^2{=}CR^3)_n-$ | $R^4$ | $Ar^4$ | $Ar^5$ |
|---|---|---|---|---|---|
| 106 | 2 | CH═CH · CH═CH | H | H | 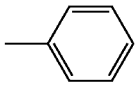 |
| 107 | 2 | CH═CH · CH═CH | H | H | 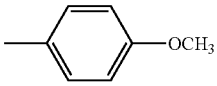 |
| 108 | 2 | CH═CH · CH═CH | H | $-CH_3$ | 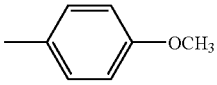 |
| 109 | 2 | CH═CH · CH═CH | H | $-CH_3$ | 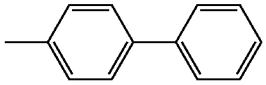 |
| 110 | 2 | CH═CH · CH═CH | H | $-CH_3$ | 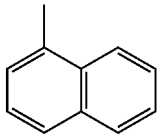 |
| 111 | 2 | CH═CH · CH═CH | H | $-CH_3$ | 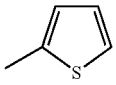 |
| 112 | 2 | CH═CH · CH═CH | H | H | 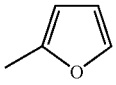 |
TABLE 17
| Compound No. | $Ar^1$ | $Ar^2$ | $R^1$ | $Ar^3$ | 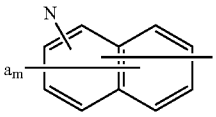 |
|---|---|---|---|---|---|
| 113 | 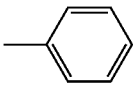 | 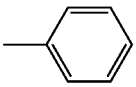 | H | 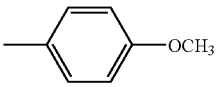 | 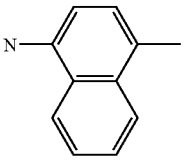 |
| 114 | 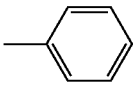 | 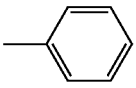 | H | 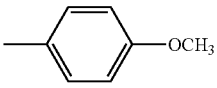 | 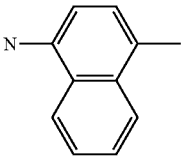 |
| 115 | 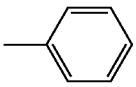 | 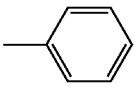 | H | 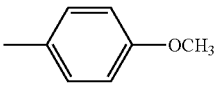 | 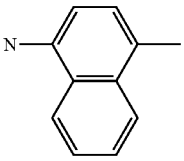 |

TABLE 17-continued
| | | | | |
|---|---|---|---|---|
| 116 | 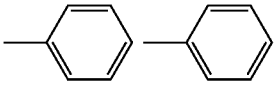 | H | 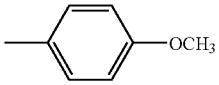 | 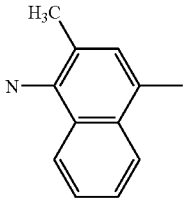 |
| 117 | 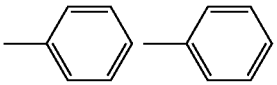 | H | 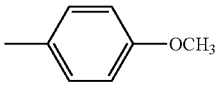 | 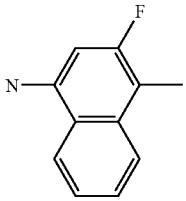 |
| 118 | 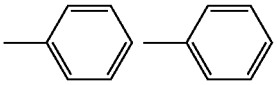 | H | 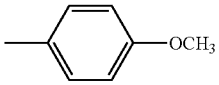 | 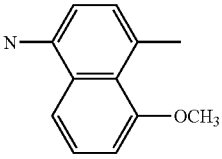 |
| 119 | 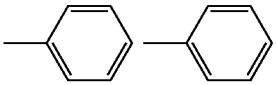 | H | 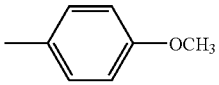 | 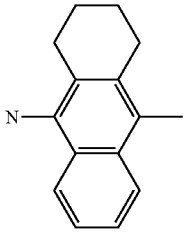 |
| Compound No. | n | $-(CR^2{=}CR^3)_n-$ | $R^4$ | $Ar^4$ | $Ar^5$ |
|---|---|---|---|---|---|
| 113 | 2 | 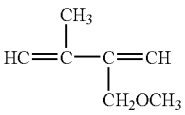 | H | H | 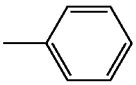 |
| 114 | 2 | 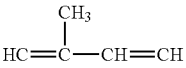 | H | H | 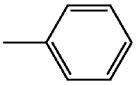 |
| 115 | 3 | $-(HC{=}CH)_3-$ | H | H | 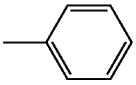 |
| 116 | 1 | CH=CH | H | H | 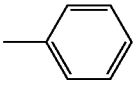 |
| 117 | 1 | CH=CH | H | H | 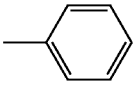 |
| 118 | 1 | CH=CH | H | H | 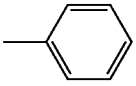 |

TABLE 17-continued
| | | | | | |
|---|---|---|---|---|---|
| 119 | 1 | CH═CH | H | H | 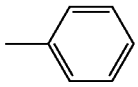 |
TABLE 18
| Compound No. | $Ar^1$ | $Ar^2$ | $R^1$ | $Ar^3$ | 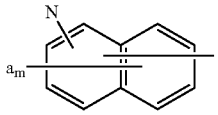 |
|---|---|---|---|---|---|
| 120 | 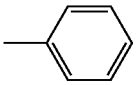 | 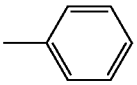 | H | 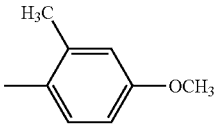 | 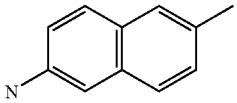 |
| 121 | 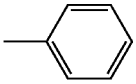 | 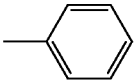 | H | 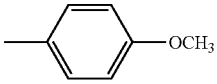 | 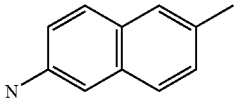 |
| 122 | 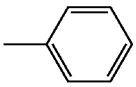 | 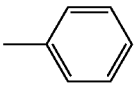 | H | 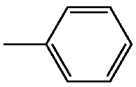 | 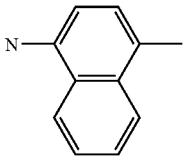 |
| 123 | 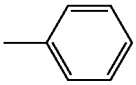 | 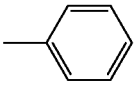 | H | 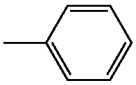 | 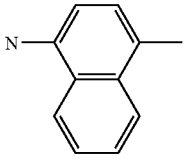 |
| 124 | 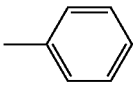 | 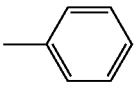 | H | 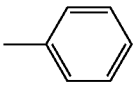 | 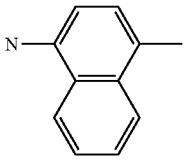 |
| 125 | 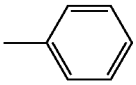 | 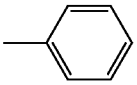 | H | 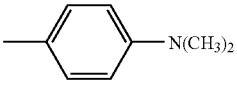 | 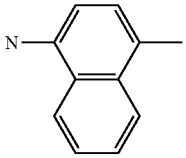 |
| 126 | 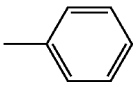 | 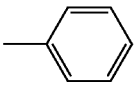 | H | 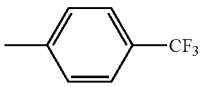 | 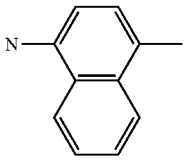 |
| Compound No. | n | $-(CR^2{=}CR^3)_n-$ | $R^4$ | $Ar^4$ | $Ar^5$ |
|---|---|---|---|---|---|
| 120 | 1 | CH═CH | H | H | 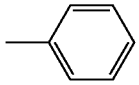 |

TABLE 18-continued
| | | | | | |
|---|---|---|---|---|---|
| 121 | 1 | CH═CH | H | H | 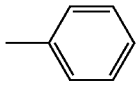 |
| 122 | 1 | CH═CH | H | H | 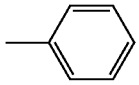 |
| 123 | 1 | CH═CH | H | —$CH_3$ | 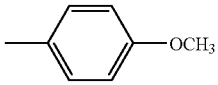 |
| 124 | 1 | CH═CH | H | 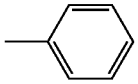 | 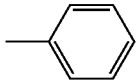 |
| 125 | 1 | CH═CH | H | H | 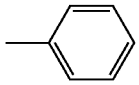 |
| 126 | 1 | CH═CH | H | H | 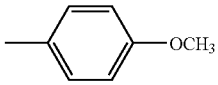 |
TABLE 19
| Compound No. | $Ar^1$ | $Ar^2$ | $R^1$ | $Ar^3$ | 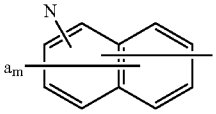 |
|---|---|---|---|---|---|
| 127 | 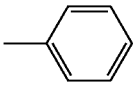 | 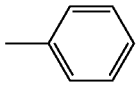 | H | 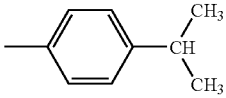 | 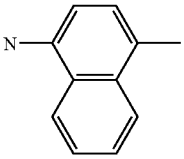 |
| 128 | 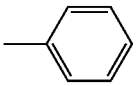 | 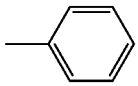 | H | 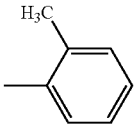 | 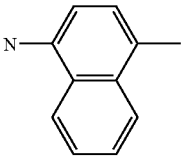 |
| 129 | 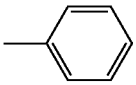 | 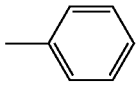 | H | 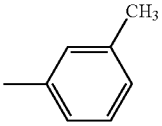 | 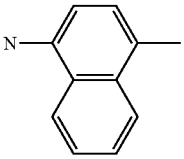 |
| 130 | 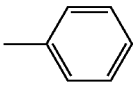 | 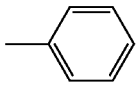 | H | 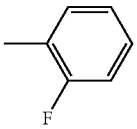 | 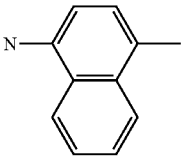 |

TABLE 19-continued
| | | | | |
|---|---|---|---|---|
| 131 | 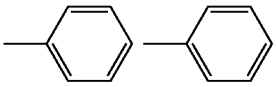 | H | 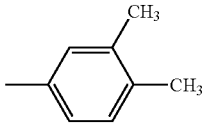 | 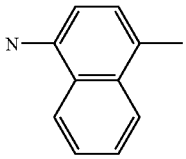 |
| 132 | 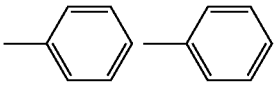 | H | 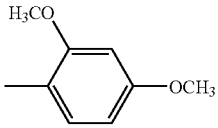 | 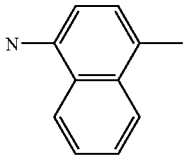 |
| 133 | 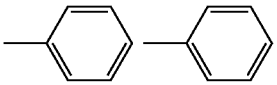 | H | 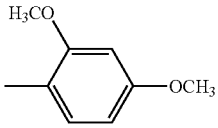 | 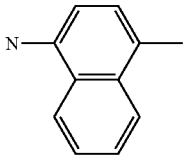 |
| Compound No. | n | $-(CR^2{=}CR^3)_n-$ | $R^4$ | $Ar^4$ | $Ar^5$ |
|---|---|---|---|---|---|
| 127 | 1 | CH=CH | H | 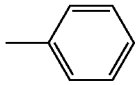 | 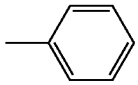 |
| 128 | 1 | CH=CH | H | H | 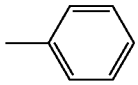 |
| 129 | 1 | CH=CH | H | H | 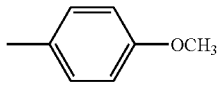 |
| 130 | 1 | CH=CH | H | 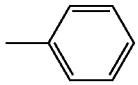 | 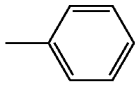 |
| 131 | 1 | CH=CH | H | H | 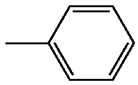 |
| 132 | 1 | CH=CH | H | $-CH_3$ | 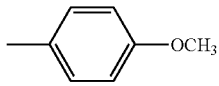 |
| 133 | 1 | CH=CH | H | 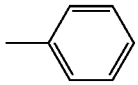 | 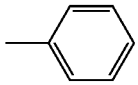 |

TABLE 20
| Compound No. | $Ar^1$ | $Ar^2$ | $R^1$ | $Ar^3$ | 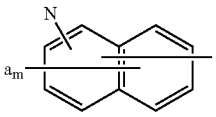 |
|---|---|---|---|---|---|
| 134 | 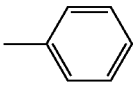 | 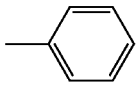 | H | 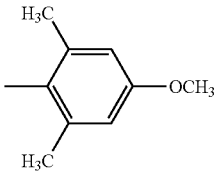 | 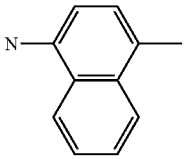 |
| 135 | 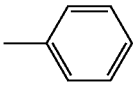 | 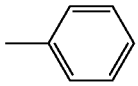 | H | 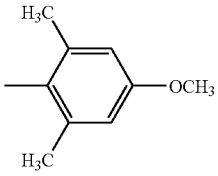 | 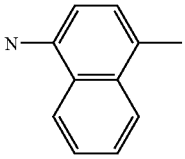 |
| 136 | 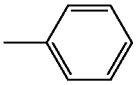 | 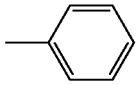 | H | 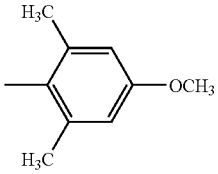 | 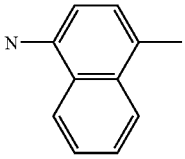 |
| 137 | 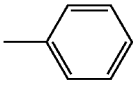 | 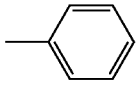 | H | 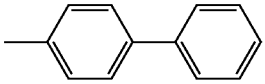 | 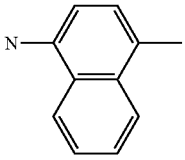 |
| 138 | 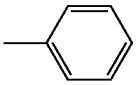 | 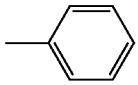 | H | 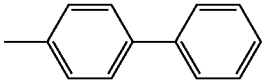 | 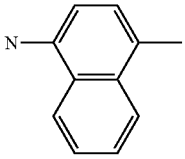 |
| 139 | 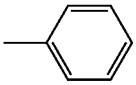 | 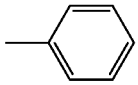 | H | 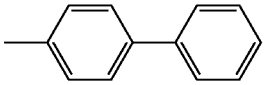 | 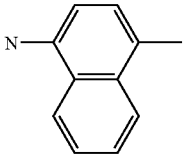 |
| 140 | 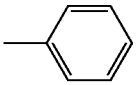 | 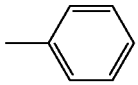 | H | 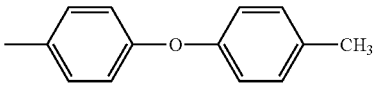 | 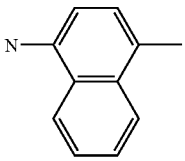 |
| Compound No. | n | $-(CR^2=CR^3)_n-$ | $R^4$ | $Ar^4$ | $Ar^5$ |
|---|---|---|---|---|---|
| 134 | 1 | CH=CH | H | H | 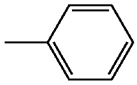 |

TABLE 20-continued
| | | | | | |
|---|---|---|---|---|---|
| 135 | 1 | CH═CH | H | H | 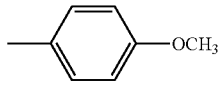 |
| 136 | 1 | CH═CH | H | 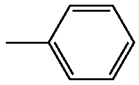 | 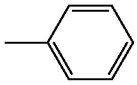 |
| 137 | 1 | CH═CH | H | H | 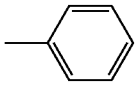 |
| 138 | 1 | CH═CH | H | —$CH_3$ | 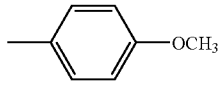 |
| 139 | 1 | CH═CH | H | 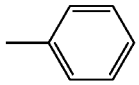 | 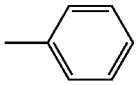 |
| 140 | 1 | CH═CH | H | H | 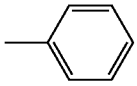 |
TABLE 21
| Compound No. | $Ar^1$ | $Ar^2$ | $R^1$ | $Ar^3$ | 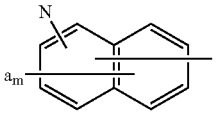 |
|---|---|---|---|---|---|
| 141 | 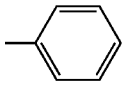 | 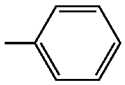 | H | 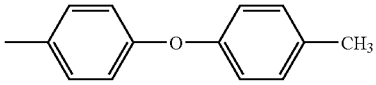 | 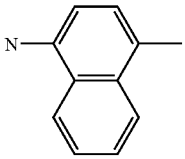 |
| 142 | 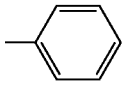 | 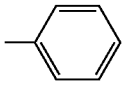 | H | 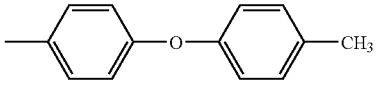 | 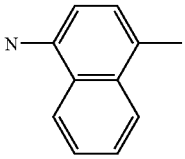 |
| 143 | 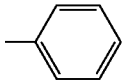 | 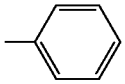 | H | 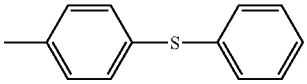 | 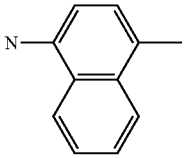 |
| 144 | 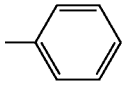 | 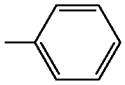 | H | 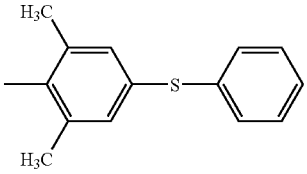 | 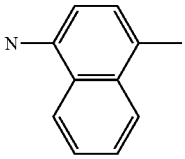 |

TABLE 21-continued
| | | | |
|---|---|---|---|
| 145 | 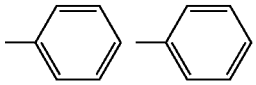 | H | 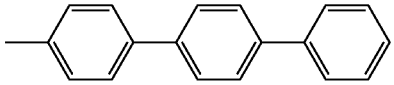 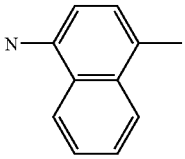 |
| 146 | 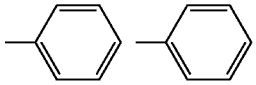 | H | 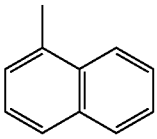 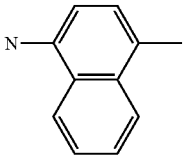 |
| 147 | 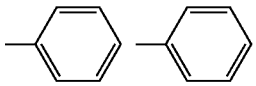 | H | 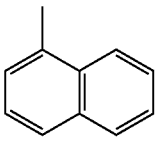 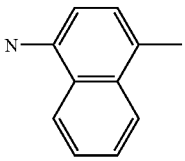 |
| Compound No. | n | $-(CR^2=CR^3)_n-$ | $R^4$ | $Ar^4$ | $Ar^5$ |
|---|---|---|---|---|---|
| 141 | 1 | CH=CH | H | H | 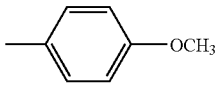 |
| 142 | 1 | CH=CH | H | $-CH_3$ | 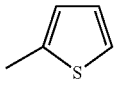 |
| 143 | 1 | CH=CH | H | H | 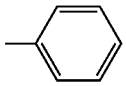 |
| 144 | 1 | CH=CH | H | $-CH_3$ | 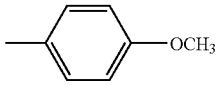 |
| 145 | 1 | CH=CH | H | $-CH_3$ | 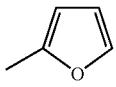 |
| 146 | 1 | CH=CH | H | H | 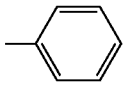 |
| 147 | 1 | CH=CH | H | $-CH_3$ | 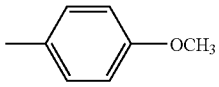 |

TABLE 22
| Compound No. | $Ar^1$ | $Ar^2$ | $R^1$ | $Ar^3$ | 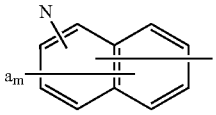 |
|---|---|---|---|---|---|
| 148 | 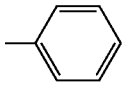 | 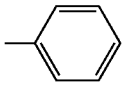 | H | 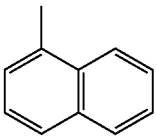 | 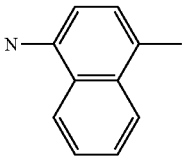 |
| 149 | 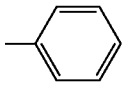 | 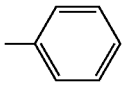 | H | 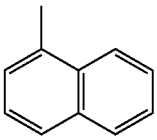 | 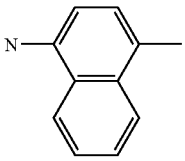 |
| 150 | 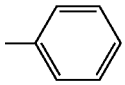 | 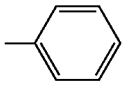 | H | 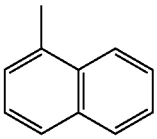 | 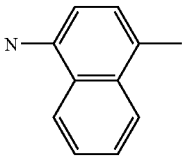 |
| 151 | 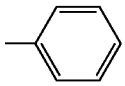 | 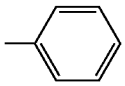 | H | 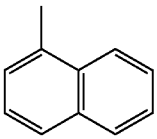 | 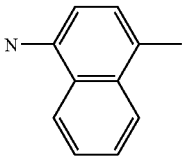 |
| 152 | 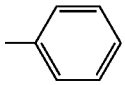 | 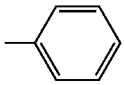 | H | 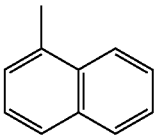 | 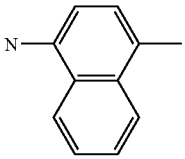 |
| 153 | 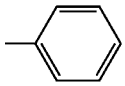 | 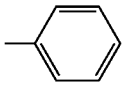 | H | 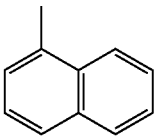 | 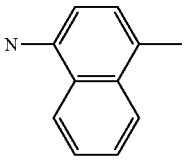 |
| 154 | 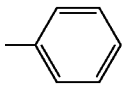 | 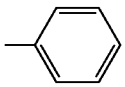 | H | 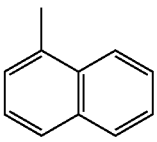 | 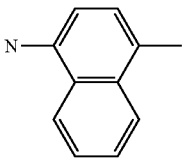 |
| Compound No. | n | $-(CR^2=CR^3)_n-$ | $R^4$ | $Ar^4$ | $Ar^5$ |
|---|---|---|---|---|---|
| 148 | 1 | CH=CH | H | H | 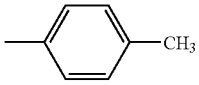 |
| 149 | 1 | CH=CH | H | $-CH_3$ | 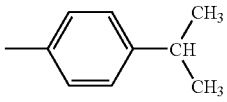 |

TABLE 22-continued
| | | | | | |
|---|---|---|---|---|---|
| 150 | 1 | CH═CH | H | H | 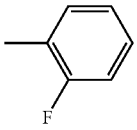 |
| 151 | 1 | CH═CH | H | —$CH_3$ | 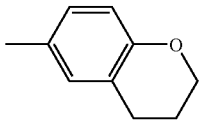 |
| 152 | 1 | CH═CH | H | —$CH_3$ | 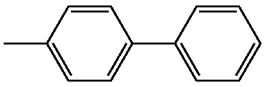 |
| 153 | 1 | CH═CH | H | —$CH_3$ | 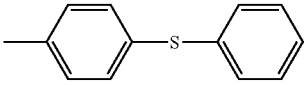 |
| 154 | 1 | CH═CH | H | H | 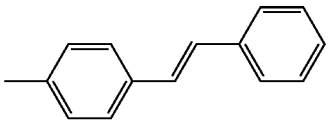 |
TABLE 23
| Compound No. | $Ar^1$ | $Ar^2$ | $R^1$ | $Ar^3$ | 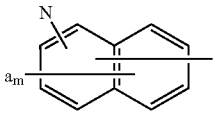 |
|---|---|---|---|---|---|
| 155 | 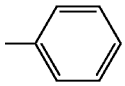 | 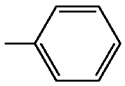 | H | 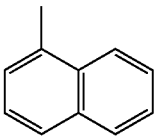 | 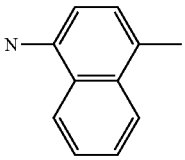 |
| 156 | 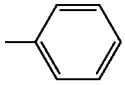 | 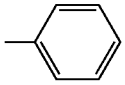 | H | 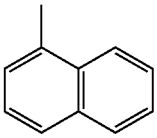 | 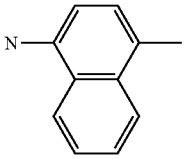 |
| 157 | 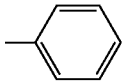 | 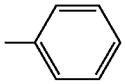 | H | 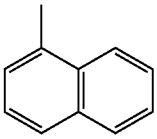 | 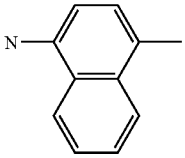 |
| 158 | 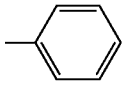 | 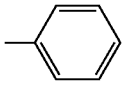 | H | 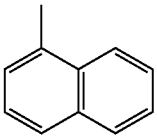 | 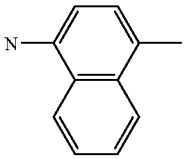 |

TABLE 23-continued
| | | | | |
|---|---|---|---|---|
| 159 | 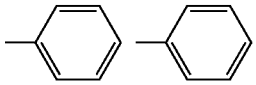 | H | 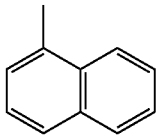 | 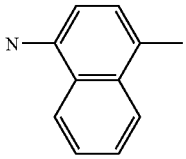 |
| 160 | 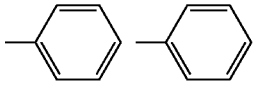 | H | 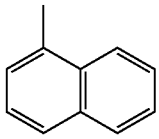 | 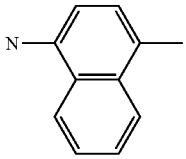 |
| 161 | 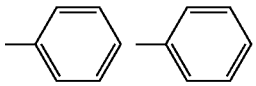 | H | 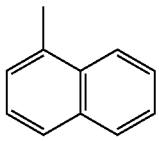 | 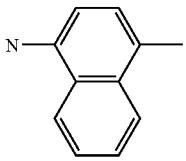 |
| Compound No. | n | $-(CR^2{=}CR^3)_n-$ | $R^4$ | $Ar^4$ | $Ar^5$ |
|---|---|---|---|---|---|
| 155 | 1 | CH═CH | H | $-CH_3$ | 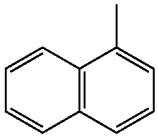 |
| 156 | 1 | CH═CH | H | $-CH_3$ | 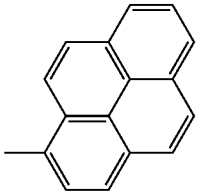 |
| 157 | 1 | CH═CH | H | $-CH_3$ | 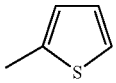 |
| 158 | 1 | CH═CH | H | H | 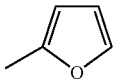 |
| 159 | 1 | CH═CH | H | 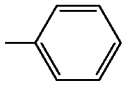 | 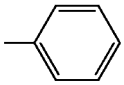 |
| 160 | 1 | CH═CH | H | 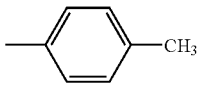 | 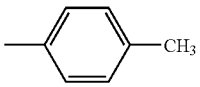 |
| 161 | 1 | CH═CH | H | 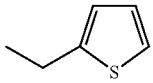 | 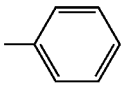 |

TABLE 24
| Compound No. | $Ar^1$ | $Ar^2$ | $R^1$ | $Ar^3$ | 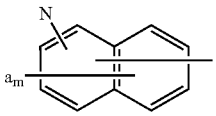 |
|---|---|---|---|---|---|
| 162 | 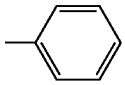 | 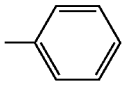 | H | 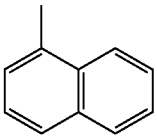 | 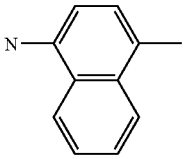 |
| 163 | 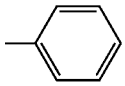 | 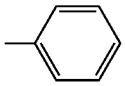 | H | 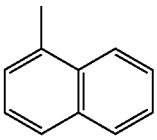 | 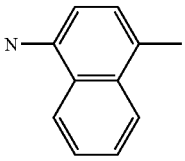 |
| 164 | 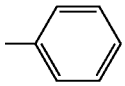 | 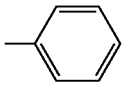 | H | 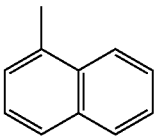 | 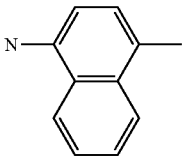 |
| 165 | 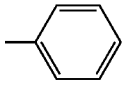 | 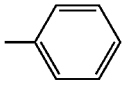 | H | 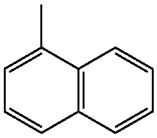 | 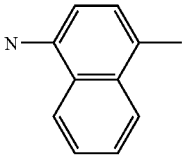 |
| 166 | 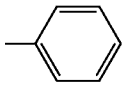 | 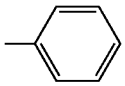 | H | 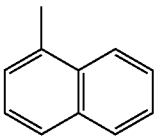 | 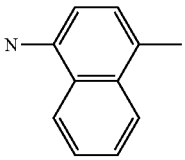 |
| 167 | 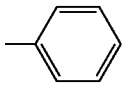 | 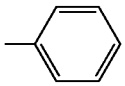 | H | 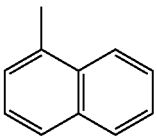 | 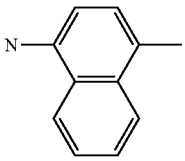 |
| 168 | 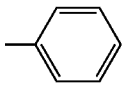 | 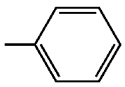 | H | 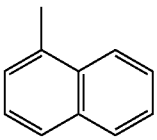 | 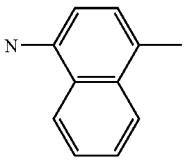 |
| Compound No. | n | $-(CR^2{=}CR^3)_n-$ | $R^4$ | $Ar^4$ | $Ar^5$ |
|---|---|---|---|---|---|
| 162 | 1 | CH=CH | H | | 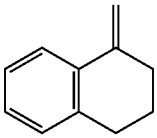 |

TABLE 24-continued
| | | | | | |
|---|---|---|---|---|---|
| 163 | 1 | CH═CH | H | | 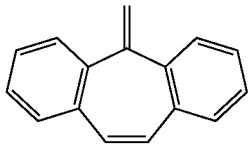 |
| 164 | 1 | CH═CH | H | | 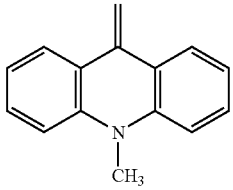 |
| 165 | 2 | CH═CH—CH═CH | H | H | 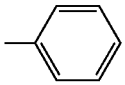 |
| 166 | 2 | CH═CH—CH═CH | H | —$CH_3$ | 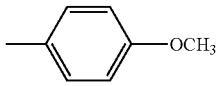 |
| 167 | 2 | CH═CH—CH═CH | H | —$CH_3$ | 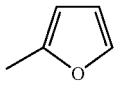 |
| 168 | 3 | $-(HC{=}CH)_3-$ | H | H | 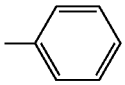 |
TABLE 25
| Compound No. | $Ar^1$ | $Ar^2$ | $R^1$ | $Ar^3$ | 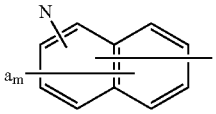 |
|---|---|---|---|---|---|
| 169 | 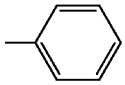 | 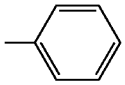 | H | 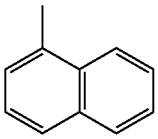 | 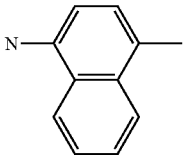 |
| 170 | 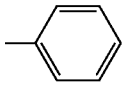 | 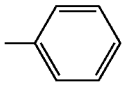 | H | 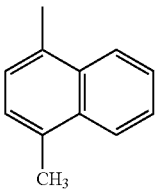 | 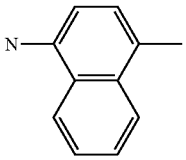 |
| 171 | 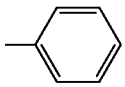 | 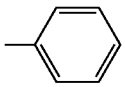 | H | 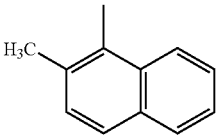 | 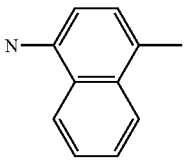 |

TABLE 25-continued
| | | | | |
|---|---|---|---|---|
| 172 | 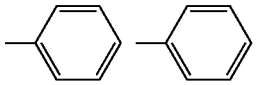 | H | 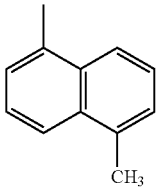 | 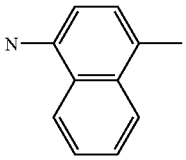 |
| 173 | 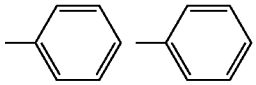 | H | 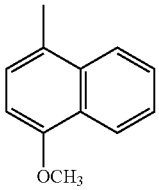 | 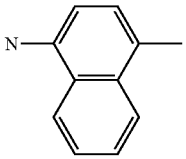 |
| 174 | 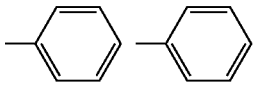 | H | 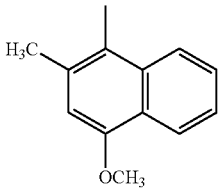 | 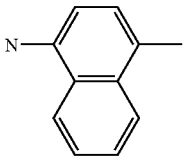 |
| 175 | 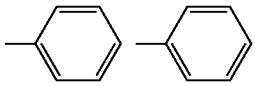 | H | 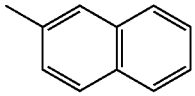 | 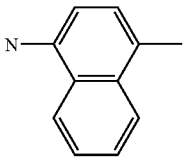 |
| Compound No. | n | $-(CR^2=CR^3)_n-$ | $R^4$ | $Ar^4$ | $Ar^5$ |
|---|---|---|---|---|---|
| 169 | 1 | CH=CH | H | H | 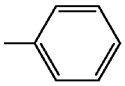 |
| 170 | 1 | CH=CH | H | H | 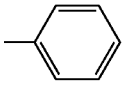 |
| 171 | 1 | CH=CH | H | H | 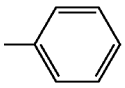 |
| 172 | 1 | CH=CH | H | H | 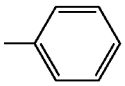 |
| 173 | 1 | CH=CH | H | H | 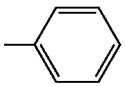 |
| 174 | 1 | CH=CH | H | H | 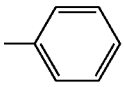 |
| 175 | 1 | CH=CH | H | H | 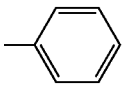 |

TABLE 26
| Compound No. | $Ar^1$ | $Ar^2$ | $R^1$ | $Ar^3$ | 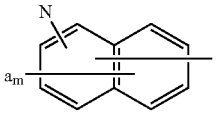 |
|---|---|---|---|---|---|
| 176 | 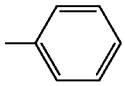 | 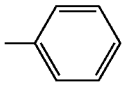 | H | 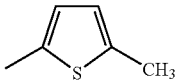 | 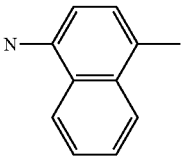 |
| 177 | 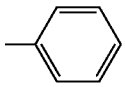 | 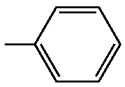 | H | 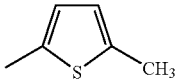 | 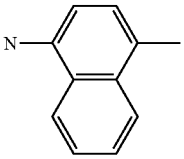 |
| 178 | 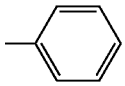 | 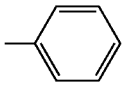 | H | 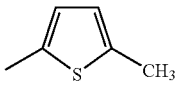 | 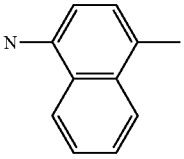 |
| 179 | 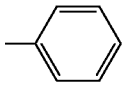 | 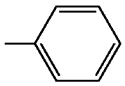 | H | 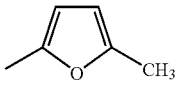 | 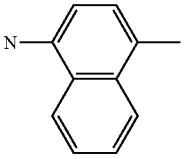 |
| 180 | 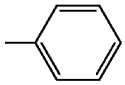 | 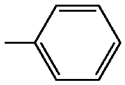 | H | 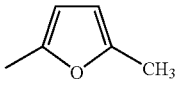 | 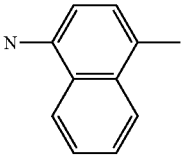 |
| 181 | 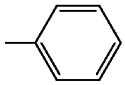 | 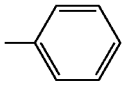 | H | 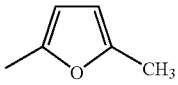 | 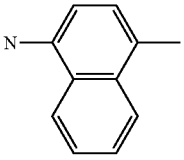 |
| 182 | 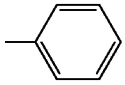 | 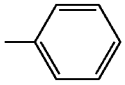 | H | 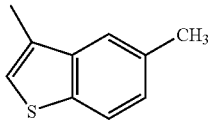 | 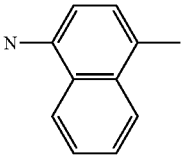 |
| Compound No. | n | $-(CR^2{=}CR^3)_n-$ | $R^4$ | $Ar^4$ | $Ar^5$ |
|---|---|---|---|---|---|
| 176 | 1 | CH═CH | H | H | 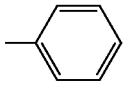 |
| 177 | 1 | CH═CH | H | H | 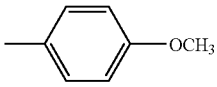 |

TABLE 26-continued
| | | | | | |
|---|---|---|---|---|---|
| 178 | 1 | CH═CH | H | 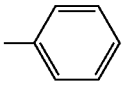 | 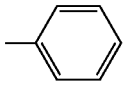 |
| 179 | 1 | CH═CH | H | H | 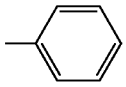 |
| 180 | 1 | CH═CH | H | —$CH_3$ | 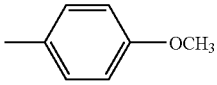 |
| 181 | 1 | CH═CH | H | 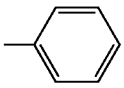 | 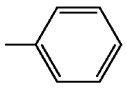 |
| 182 | 1 | CH═CH | H | H | 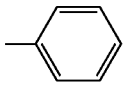 |
TABLE 27
| Compound No. | $Ar^1$ | $Ar^2$ | $R^1$ | $Ar^3$ | 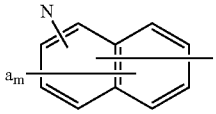 |
|---|---|---|---|---|---|
| 183 | 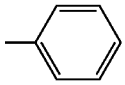 | 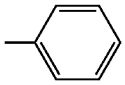 | H | 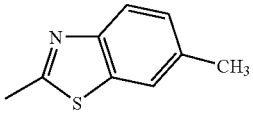 | 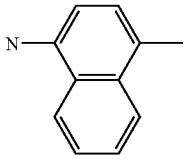 |
| 184 | 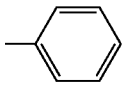 | 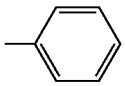 | H | 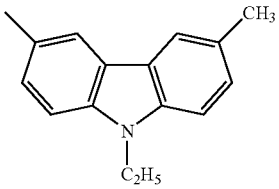 | 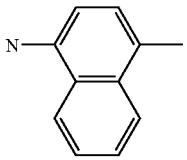 |
| 185 | 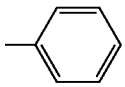 | 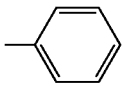 | H | 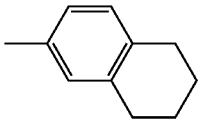 | 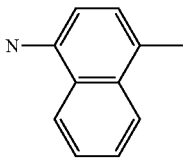 |
| 186 | 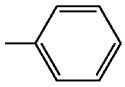 | 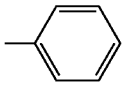 | H | 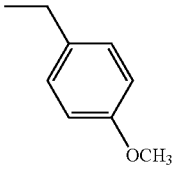 | 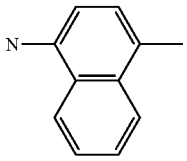 |
| 187 | 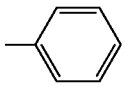 | 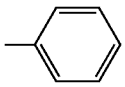 | H | 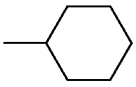 | 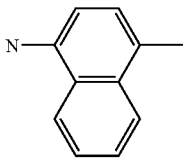 |

TABLE 27-continued
| | | | | | |
|---|---|---|---|---|---|
| 188 | 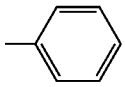 | 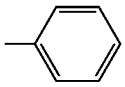 | H | 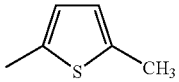 | 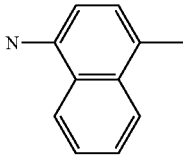 |
| 189 | 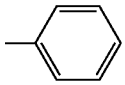 | 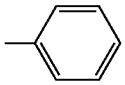 | H | 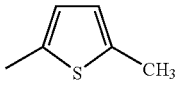 | 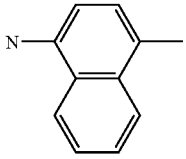 |
| Compound No. | n | $-(CR^2=CR^3)_n-$ | $R^4$ | $Ar^4$ | $Ar^5$ |
|---|---|---|---|---|---|
| 183 | 1 | CH=CH | H | $-CH_3$ | 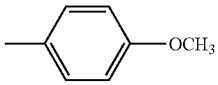 |
| 184 | 1 | CH=CH | H | 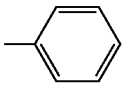 | 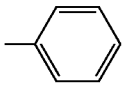 |
| 185 | 1 | CH=CH | H | H | 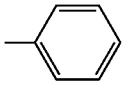 |
| 186 | 1 | CH=CH | H | H | 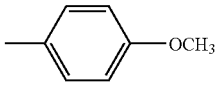 |
| 187 | 1 | CH=CH | H | 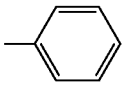 | 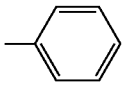 |
| 188 | 0 | — | H | H | 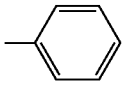 |
| 189 | 0 | — | H | H | 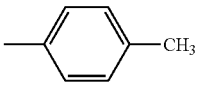 |
TABLE 28
| Compound No. | $Ar^1$ | $Ar^2$ | $R^1$ | $Ar^3$ | 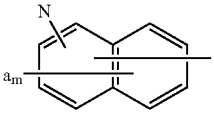 |
|---|---|---|---|---|---|
| 190 | 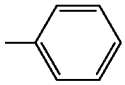 | 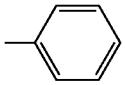 | H | 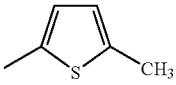 | 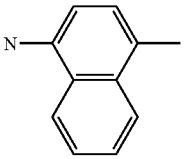 |

TABLE 28-continued
| | | | | |
|---|---|---|---|---|
| 191 | 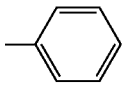 | 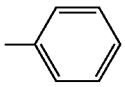 | H | 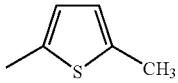 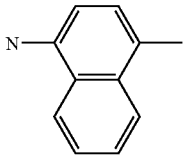 |
| 192 | 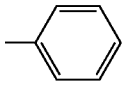 | 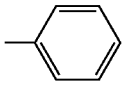 | H | 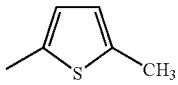 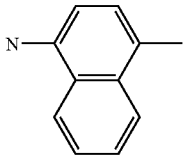 |
| 193 | 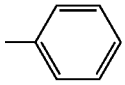 | 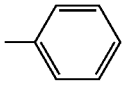 | H | 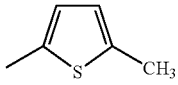 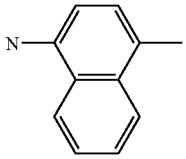 |
| 194 | 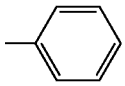 | 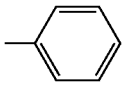 | H | 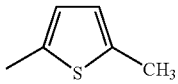 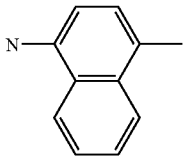 |
| 195 | 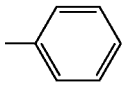 | 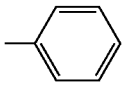 | H | 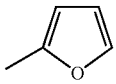 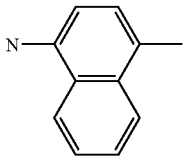 |
| 196 | 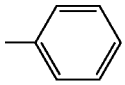 | 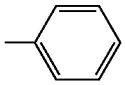 | H | 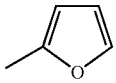 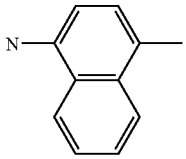 |
| Compound No. | n | $-(CR^2=CR^3)_n-$ | $R^4$ | $Ar^4$ | $Ar^5$ |
|---|---|---|---|---|---|
| 190 | 0 | — | H | H | 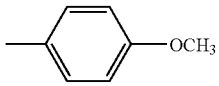 |
| 191 | 0 | — | H | H | 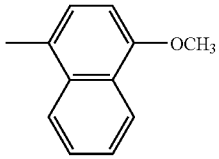 |
| 192 | 0 | — | H | H | 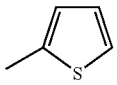 |
| 193 | 0 | — | H | H | 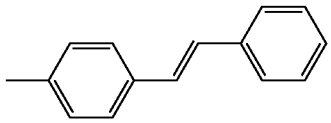 |

TABLE 28-continued
| | | | | | |
|---|---|---|---|---|---|
| 194 | 0 | — | H | 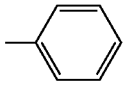 | 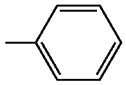 |
| 195 | 0 | — | H | H | 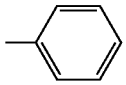 |
| 196 | 0 | — | H | H | 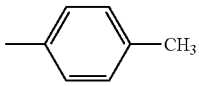 |
TABLE 29
| Compound No. | $Ar^1$ | $Ar^2$ | $R^1$ | $Ar^3$ | 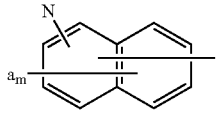 |
|---|---|---|---|---|---|
| 197 | 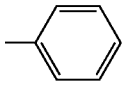 | 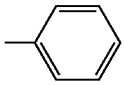 | H | 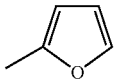 | 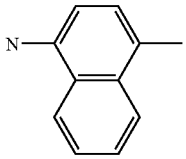 |
| 198 | 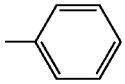 | 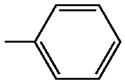 | H | 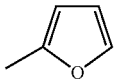 | 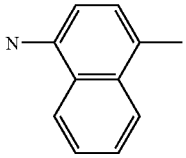 |
| 199 | 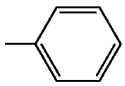 | 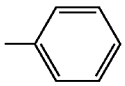 | H | 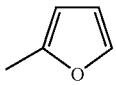 | 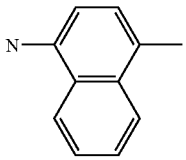 |
| 200 | 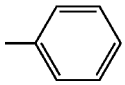 | 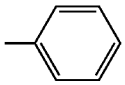 | H | 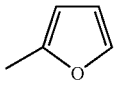 | 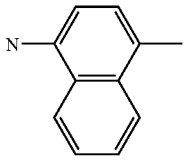 |
| 201 | 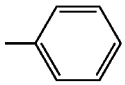 | 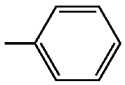 | H | 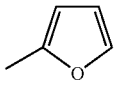 | 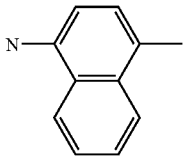 |
| 202 | 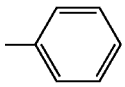 | 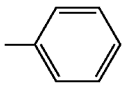 | H | 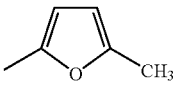 | 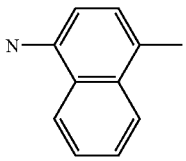 |

TABLE 29-continued

| | | | | | |
|---|---|---|---|---|---|
| 203 | | | H | | |

| Compound No. | n | $-(CR^2=CR^3)_n-$ | $R^4$ | $Ar^4$ | $Ar^5$ |
|---|---|---|---|---|---|
| 197 | 0 | — | H | H | |
| 198 | 0 | — | H | H | |
| 199 | 0 | — | H | H | |
| 200 | 0 | — | H | H | |
| 201 | 0 | — | H | | |
| 202 | 0 | — | H | H | |
| 203 | 0 | — | H | H | |

TABLE 30

| Compound No. | $Ar^1$ | $Ar^2$ | $R^1$ | $Ar^3$ | |
|---|---|---|---|---|---|
| 204 | | | H | | |
| 205 | | | H | | |

TABLE 30-continued
| | | | | |
|---|---|---|---|---|
| 206 | 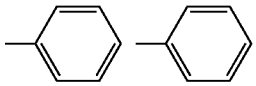 | H | 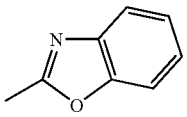 | 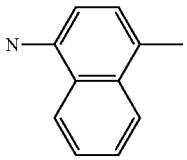 |
| 207 | 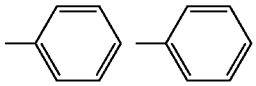 | H | 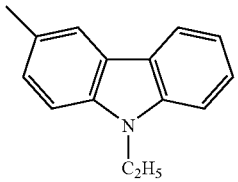 | 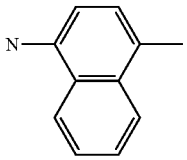 |
| 208 | 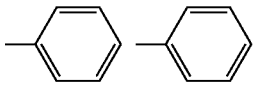 | H | 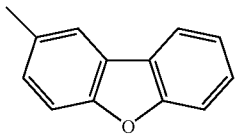 | 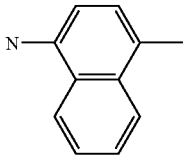 |
| 209 | 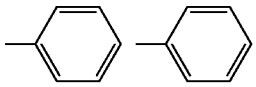 | $CH_3$ | 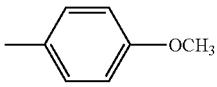 | 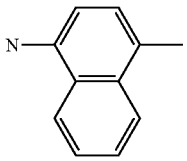 |
| 210 | 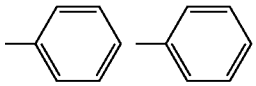 | $CH_2CF_3$ | 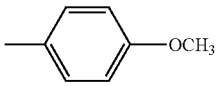 | 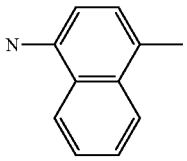 |
| Compound No. | n | $-(CR^2=CR^3)_n-$ | $R^4$ | $Ar^4$ | $Ar^5$ |
|---|---|---|---|---|---|
| 204 | 0 | — | H | H | 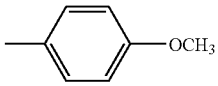 |
| 205 | 0 | — | H | 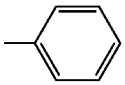 | 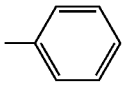 |
| 206 | 0 | — | H | H | 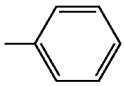 |
| 207 | 0 | — | H | H | 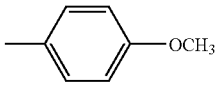 |
| 208 | 0 | — | H | 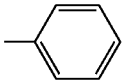 | 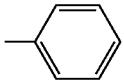 |
| 209 | 1 | CH=CH | H | H | 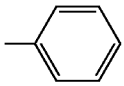 |

TABLE 30-continued
| | | | | | |
|---|---|---|---|---|---|
| 210 | 1 | CH═CH | H | H | 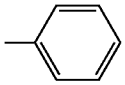 |
TABLE 31
| Compound No. | $Ar^1$ | $Ar^2$ | $R^1$ | $Ar^3$ |
|---|---|---|---|---|
| 211 | 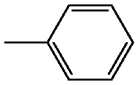 | 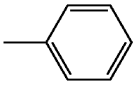 | $CH(CH_3)_2$ | 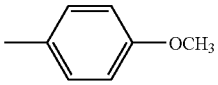 |
| 212 | 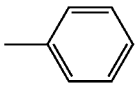 | 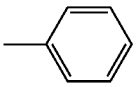 | F | 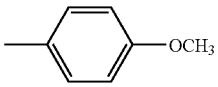 |
| 213 | 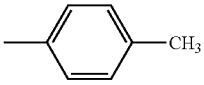 | 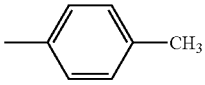 | H | 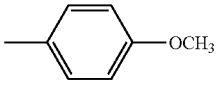 |
| 214 | 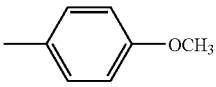 | 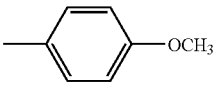 | H | 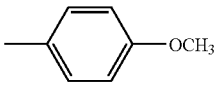 |
| 215 | 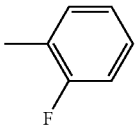 | 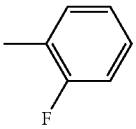 | H | 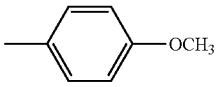 |
| 216 | 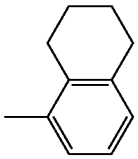 | 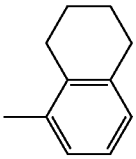 | H | 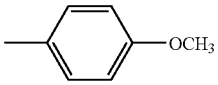 |
| 217 | 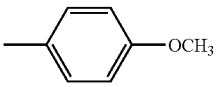 | 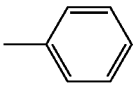 | H | 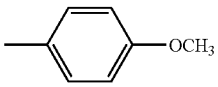 |
| Compound No. | 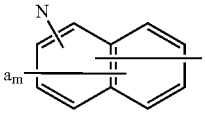 | n | $-(CR^2=CR^3)_n-$ | $R^4$ | $Ar^4$ | $Ar^5$ |
|---|---|---|---|---|---|---|
| 211 | 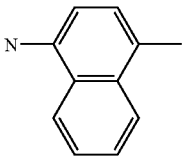 | 1 | CH═CH | H | H | 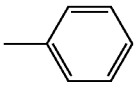 |
| 212 | 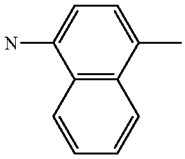 | 1 | CH═CH | H | H | 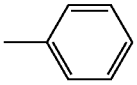 |

TABLE 31-continued
| | | | | | | |
|---|---|---|---|---|---|---|
| 213 | 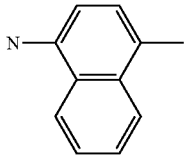 | 1 | CH=CH | H | H | 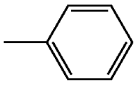 |
| 214 | 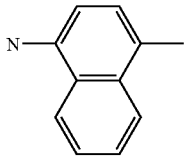 | 1 | CH=CH | H | H | 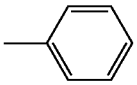 |
| 215 | 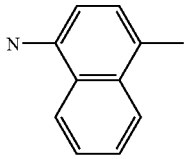 | 1 | CH=CH | H | H | 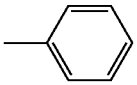 |
| 216 | 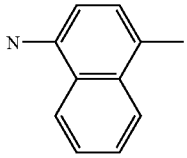 | 1 | CH=CH | H | H | 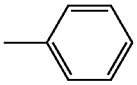 |
| 217 | 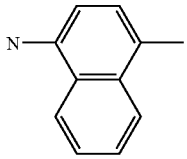 | 1 | CH=CH | H | H | 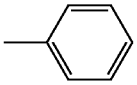 |
TABLE 32
| Compound No. | $Ar^1$ | $Ar^2$ | $R^1$ | $Ar^3$ |
|---|---|---|---|---|
| 218 | 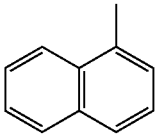 | 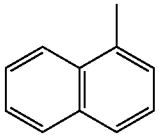 | H | 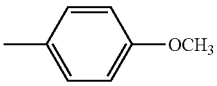 |
| 219 | 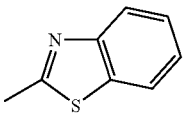 | 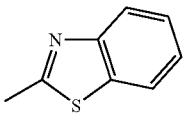 | H | 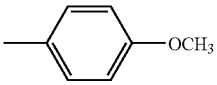 |
| 220 | 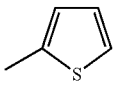 | 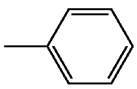 | H | 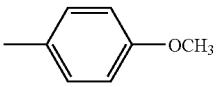 |

TABLE 32-continued

| Compound No. | 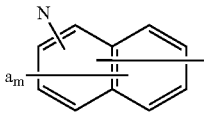 | n | $-(CR^2=CR^3)_n-$ | $R^4$ | $Ar^4$ | $Ar^5$ |
|---|---|---|---|---|---|---|
| 218 | 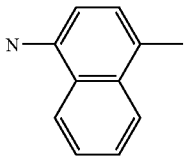 | 1 | CH=CH | H | H | 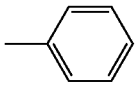 |
| 219 | 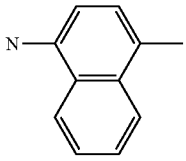 | 1 | CH=CH | H | H | 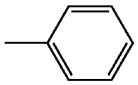 |
| 220 | 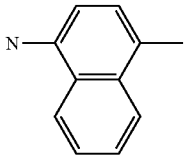 | 1 | CH=CH | H | H | 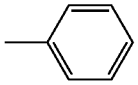 |

The organic photoconductive material, enamine compound of formula (1) may be produced, for example, as follows:

First, an aldehyde compound or a ketone compound of formula (3) is reacted with a secondary amine compound of formula (4) through dehydrating condensation to give an enamine intermediate of formula (5):

(3)

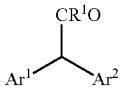

wherein $Ar^1$, $Ar^2$ and $R^1$ represent the same meanings as those defined in formula (1).

(4)

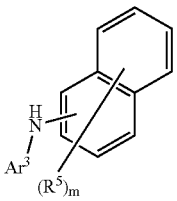

wherein $Ar^3$, $R^5$ and m represent the same as those defined in formula (1).

(5)

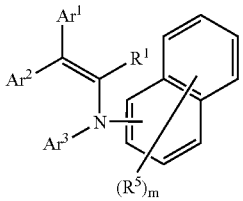

wherein $Ar^1$, $Ar^2$, $Ar^3$, $R^1$, R and m represent the same as those defined in formula (1).

The dehydrating condensation is effected, for example, as follows: an aldehyde or ketone compound of formula (3) and a secondary amine compound of formula (4) are, approximately in a ratio of 1/1 by mol, dissolved in a solvent of, for example, aromatic solvents, alcohols or ethers to prepare a solution. Specific examples of the usable solvent are toluene, xylene, chlorobenzene, butanol and diethylene glycol dimethyl ether. To the thus-prepared solution, added is a catalyst, for example, an acid catalyst such as p-toluenesulfonic acid, camphorsulfonic acid or pyridinium-p-toluenesulfonate acid, and reacted under heat. The amount of the catalyst to be added is preferably in a ratio by molar equivalent of from 1/10 to 1/1000 to the amount of the aldehyde or ketone compound of formula (3), more preferably from 1/25 to 1/500, most preferably from 1/50 to 1/200. During the reaction, water is formed and it interferes with the reaction. Therefore, the water formed is removed out of the system through azeotropic evaporation with the solvent used. As a result, the enamine intermediate of formula (5) is produced at high yield.

The enamine intermediate of formula (5) is formylated through Vilsmeier reaction or is acylated through Friedel-Crafts reaction to give an enamine-carbonyl intermediate of the following general formula (6). The formylation through Vilsmeier reaction gives an enamine-aldehyde intermediate, a type of enamine-carbonyl intermediate of formula (6) where $R^5$ is a hydrogen atom; and the acylation through Friedel-Crafts reaction gives an enamine-keto intermediate, a type of enamine-carbonyl intermediate of formula (6) where $R^5$ is a group except hydrogen atom.

(6)

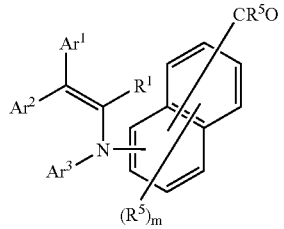

wherein $R^5$ is $R^4$ when n in formula (1) is 0, but is $R^2$ when n is 1, 2 or 3; and $Ar^1$, $Ar^2$, $Ar^3$, $R^1$, $R^2$, $R^4$, and $R^5$ represent the same as those in formula (1) and m and n are the same as defined in formula (1).

The Vilsmeier reaction is effected, for example, as follows: Phosphorus oxychloride and N,N-dimethylformamide (DMF), or phosphorus oxychloride and N-methyl-N-phenylformamide, or phosphorus oxychloride and N,N-diphenylformamide are added to a solvent such as N,N-dimethylformamide or 1,2-dichloroethane to prepare a Vilsmeier reagent. 1.0 Equivalent of an enamine intermediate of formula (5) is added to from 1.0 to 1.3 equivalents of the thus-prepared Vilsmeier reagent, and stirred for 2 to 8 hours under heat at 60 to 110° C. Next, this is hydrolyzed with an aqueous alkaline solution such as 1 to 8 N aqueous sodium hydroxide or potassium hydroxide solution. This gives an enamine-aldehyde intermediate, a type of enamine-carbonyl intermediate of formula (6) where $R^5$ is a hydrogen atom, at high yield.

The Friedel-Crafts reaction is effected, for example, as follows: From 1.0 to 1.3 equivalents of a reagent prepared from aluminum chloride and an acid chloride, and 1.0 equivalent of an enamine intermediate of formula (5) are added to a solvent such as 1,2-dichloroethane, and stirred for 2 to 8 hours at −40 to 80° C. As the case may be, the reaction system is heated. Next, this is hydrolyzed with an aqueous alkaline solution such as 1 to 8 N aqueous sodium hydroxide or potassium hydroxide solution. This gives an enamine-keto intermediate, a type of enamine-carbonyl intermediate of formula (6) where $R^5$ is a group except hydrogen atom, at high yield.

Finally, the enamine-carbonyl intermediate of formula (6) is processed with a Wittig reagent of the following general formula (7-1) or (7-2) through Wittig-Horner reaction under basic condition to obtain the organic photoconductive material of the invention, enamine compound of formula (1). In this step, when a Wittig reagent of formula (7-1) is used, it gives an enamine compound of formula (1) where n is 0; and when a Wittig reagent of formula (7-2) is used, it gives an enamine compound of formula (1) where n is 1, 2 or 3.

(7-1)

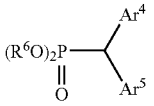

wherein $R^6$ represents an optionally-substituted alkyl group or an optionally-substituted aryl group; and $Ar^4$ and $Ar^5$ have the same meanings as those defined in formula (1).

(7-2)

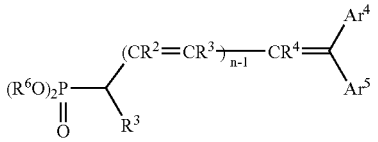

wherein $R^6$ represents an optionally-substituted alkyl group or an optionally-substituted aryl group; n indicates an integer of from 1 to 3; and $Ar^4$, $Ar^5$, $R^2$, $R^3$ and $R^4$ have the same meanings as those defined in formula (1).

The Wittig-Horner reaction is effected, for example, as follows: 1.0 Equivalent of an enamine-carbonyl intermediate of formula (6), from 1.0 to 1.20 equivalents of a Wittig reagent of formula (7-1) or (7-2), and from 1.0 to 1.5 equivalents of a metal alkoxide base such as potassium t-butoxide, sodium ethoxide or sodium methoxide are added to a solvent such as toluene, xylene, diethyl ether, tetrahydrofuran (THF), ethylene glycol dimethyl ether, N,N-dimethylformamide or dimethylsulfoxide, and stirred for 2 to 8 hours at room temperature or under heat at 30 to 60° C. This gives an enamine compound of formula (1) at high yield.

The electrophotographic photoreceptor (hereinafter this may be simply referred to as "photoreceptor") of the invention comprises, as the charge-transporting substance therein, the organic photoconductive material of formula (1) or (2) of the invention, and includes various embodiments. This is described in detail hereinunder with reference to the drawings attached hereto.

FIG. 1 is a schematic cross-sectional view showing, in a simplified manner, the constitution of an electrophotographic photoreceptor 1, one embodiment of the electrophotographic photoreceptor of the invention. The electrophotographic photoreceptor 1 is a laminate photoreceptor having a laminate-structured photosensitive layer 14 on a sheet conductive support 11 of a conductive material, in which the photosensitive layer 14 comprises a charge generation layer 15 that contains a charge-generating substance 12 and a charge transportation layer 16 that contains a charge-transporting substance 13 and a binder resin 17 to bind the charge-transporting substance 13, laminated in that order toward the outside from the conductive support 11.

The charge transportation layer 16 contains the organic photoconductive material of the invention, enamine compound of formula (1) or (2) of high charge mobility. Thus designed, the electrophotographic photoreceptor has high charge potential, high sensitivity, good responsiveness to light and good durability, of which the characteristics do not lower even when it is driven at low temperatures or at high speed. Not containing a polysilane, in addition, the photosensitive layer 14 realizes good charge-transporting ability. Thus designed, the electrophotographic photoreceptor has high reliability, of which the characteristics do not lower even when it is exposed to light.

As so mentioned hereinabove, the photosensitive layer 14 has a laminate structure that comprises a charge generation layer 15 containing a charge-generating substance 12 and a charge transportation layer 16 containing a charge-transporting substance 13. In that manner, the different layers therein shall separately have the charge-generating function and the charge-transporting function, and the optimum materials may be selected for the charge-generating function and the charge-transporting function. Thus designed, the electrophotographic photoreceptor has higher sensitivity and higher durability with increased stability in repeated use.

The conductive material to constitute the conductive support 11 may be a metal material such as aluminum, aluminum alloy, copper, zinc, stainless steel and titanium. However, the conductive support 11 is not limited to the metal material. For it, a polymer material such as polyethylene terephthalate, nylon or polystyrene, or tough paper or glass may be laminated with metal foil or coated with a metal material through vapor deposition, or a layer of a conductive polymer or a conductive compound such as tin oxide or indium oxide may be formed on it through vapor deposition or coating. Regarding its shape, the conductive support 11 is a sheet in the electrophotographic photoreceptor 1, but it is not limited to the illustrated shape. Apart from it, for example, the conductive support 11 may also be cylindrical or columnar or may be an endless belt.

If desired, the surface of the conductive support 11 may be subjected to anodic oxidation for oxide film formation thereon, surface treatment with chemicals or hot water, coloration, or roughening for irregular reflection, not having any influence on the quality of images to be formed. In an electrophotographic process using a laser for a light source for exposure, the wavelength of the laser ray is unified. In this, therefore, the laser ray applied to the electrophotographic photoreceptor may interfere with the light reflected inside the photoreceptor to give interference fringes, and the interference fringes may appear on the images formed and will be image defects. In case where the surface of the conductive support 11 is processed in the manner as above, it may prevent the image defects to be caused by the interference of the wavelength-unified laser ray.

The charge generation layer 15 contains, as the essential ingredient, a charge-generating substance 12 that absorbs light to generate charges. Substances that are effective for the charge-generating substance 12 are azo pigments such as monoazo pigments, bisazo pigments and trisazo pigments; indigo pigments such as indigo and thioindigo; perylene pigments such as perylenimide and perylenic anhydride; polycyclic quinone pigments such as anthraquinone and pyrenequinone; phthalocyanine pigments such as metal phthalocyanines and non-metal phthalocyanines; squarylium dyes, pyrylium salts, thiopyrylium salts, triphenylmethane dyes; and inorganic materials such as selenium and amorphous silicon. One or more of these charge-generating substances are used herein, either singly or as combined.

Of those charge-generating substances, preferred is oxotitanium phthalocyanine. Oxotitanium phthalocyanine is a charge-generating substance that has high charge-generating efficiency and charge-injecting efficiency. Therefore, when it absorbs light, then it generates a large number of charges and efficiently injects them into the charge-transporting substance 13, not accumulating the thus-generated charged in itself. As so mentioned hereinabove, in addition, the organic photoconductive material of formula (1) or (2) of high charge mobility is used for the charge-transporting substance 13. Therefore, the charges generated by the charge-generating substance 12 that has absorbed light are efficiently injected into the charge-transporting substance 13 and are smoothly transported, and the electrophotographic photoreceptor of this embodiment enjoys high sensitivity and high resolution power.

The charge-generating substance 12 may be combined with a sensitizing dye. The sensitizing dye includes, for example, triphenylmethane dyes such as typically methyl violet, crystal violet, night blue and victoria blue; acridine dyes such as typically erythrosine, rhodamine B, rhodamine 3R, acridine orange and flapeosine; thiazine dyes such as typically methylene blue and methylene green; oxazine dyes such as typically capri blue and meldola blue; and cyanine dyes, styryl dyes, pyrylium salt dyes or thiopyrylium salt dyes.

For forming the charge generation layer 15, for example, employable is a method of depositing a charge-generating substance 12 on the conductive support 11 in a mode of vacuum evaporation, or a method of applying a coating liquid for charge generation layer that is prepared by dispersing a charge-generating substance 12 in a solvent, onto the conductive support 11. For it, especially preferred is a coating method that comprises dispersing, in a known manner, a charge-generating substance 12 in a binder resin solution prepared by mixing a binder resin in a solvent, followed by applying the resulting coating dispersion onto the conductive support 11. The method is described below.

For the binder resin, for example, usable are one or more selected from a group consisting of resins such as polyester resins, polystyrene resins, polyurethane resins, phenolic resins, alkyd resins, melamine resins, epoxy resins, silicone resins, acrylic resins, methacrylic resins, polycarbonate resins, polyarylate resins, phenoxy resins, polyvinylbutyral resins and polyvinylformal resins, and copolymer resins containing at least two of the repetitive units that constitute these resins. Specific examples of the copolymer resins are insulating resins such as vinyl chloride-vinyl acetate copolymer resins, vinyl chloride-vinyl acetate-maleic anhydride copolymer resins and acrylonitrilestyrene copolymer resins. The binder resin for use herein is not limited to those as above, and may be any and every one generally used in the art.

The solvent includes, for example, halogenohydrocarbons such as dichloromethane and dichloroethane; ketones such as acetone, methyl ethyl ketone and cyclohexanone; esters such as ethyl acetate and butyl acetate; ethers such as tetrahydrofuran (THF) and dioxane; alkyl ethers of ethylene glycol such as 1,2-dimethoxyethane; aromatic hydrocarbons such as benzene, toluene and xylene; and aprotic polar solvents such as N,N-dimethylformamide and N,N-dimethylacetamide. Mixed solvents prepared by mixing at least two of these solvents may also be used herein.

The blend ratio of the charge-generating substance 12 to the binder resin is preferably such that the charge-generating substance 12 accounts for from 10 to 99% by weight. When the proportion of the charge-generating substance 12 is smaller than 10% by weight, the sensitivity of the charge generation layer 15 will lower. When the proportion of the charge-generating substance 12 is larger than 99% by weight, not only the mechanical strength of the charge generation layer 15 may lower but also the dispersibility of the charge-generating substance 12 may lower and coarse grains will therefore increase, and if so, the surface charge in the area except that to be erased through exposure to light decreases, and image defects, especially image fog caused by toner adhesion to the area of white background and formation of fine black dots, which is referred to as black peppers, will increase. For these reasons, the proportion of the charge-generating substance 12 is defined to be from 10 to 99% by weight.

Before dispersed in a binder resin solution, the charge-generating substance 12 may be ground by the use of a grinding machine. The grinding machine may be any of ball mill, sand mill, attritor, shaking mill and ultrasonic disperser.

The disperser that is used in dispersing the charge-generating substance 12 in a binder resin solution may be any of paint shaker, ball mill and sand mill. The condition for the dispersion operation shall be so controlled that the dispersion to be prepared is not contaminated with impurities from the parts that constitute the container by friction of the parts, and so on, and the disperser used.

For applying the coating liquid for a charge generation layer that is prepared by dispersing the charge-generating substance 12 in a binder resin solution, onto the support, for example, employable is a method of spraying, bar coating, roll coating, blade coating or ring coating the liquid onto the support, or dipping the support in the liquid. Of those coating methods, the most preferred method may be selected in consideration of the physical properties of the coating liquid and the productivity in the method. In particular, since the dipping method comprises dipping a conductive support 11 in a coating tank filled with a coating liquid followed by drawing up the conductive support 11 at a constant rate or at a gradually-varying rate to thereby form a layer on the conductive support 11, it is relatively simple and favorable in point of the productivity and the production costs, and it is much utilized in producing electrophotographic photoreceptors. The apparatus for the dipping method may be equipped with a coating liquid disperser such as typically an ultrasonic disperser for stabilizing the dispersibility of the coating liquid.

The thickness of the charge generation layer 15 is preferably from 0.05 μm to 5 μm, more preferably from 0.1 μm to 1 μm. When the thickness of the charge generation layer 15 is smaller than 0.05 μm, then the light absorption efficiency of the charge generation layer 15 may lower and the sensitivity thereof will therefore lower. When the thickness of the charge generation layer 15 is larger than 5 μm, then the charge transfer inside the charge generation layer will be in a rate-determining stage in the step of erasing the charges on the surface of the photoreceptor, and the sensitivity of the layer will therefore lower. For these reasons, the thickness of the charge generation layer 15 is defined to be from 0.05 μm to 5 μm.

The charge transportation layer 16 contains a charge-transporting substance 13 having the ability to receive and transport the charges generated by the charge-generating substance 12, in which the organic photoconductive material of formula (1) or (2) of the invention is used for the charge-generating substance 12 and this is in a binder resin 17. The organic photoconductive material of formula (1) or (2) may be one or more selected from the group consisting of Compounds in Tables 1 to 32, either singly or as combined.

The organic photoconductive material of formula (1) or (2) may be combined with any other charge-transporting substance. The other charge-transporting substance includes, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives and benzidine derivatives. It further includes polymers that have a group derived from these compounds in the backbone chain or in the side branches, for example, poly-N-vinylcarbazole, poly-1-vinylpyrene and poly-9-vinylanthracene.

However, for realizing especially higher charge-transporting ability, it is desirable that the charge-transporting substance 13 is entirely the organic photoconductive material of formula (1) or (2) of the invention.

For the binder resin 17 for the charge transportation layer 16, selected are those well compatible with the charge-transporting substance 13. Their specific examples are vinyl polymer resins such as polymethyl methacrylate resins, polystyrene resins and polyvinyl chloride resins, and their copolymer resins; and other resins such as polycarbonate resins, polyester resins, polyester carbonate resins, polysulfone resins, phenoxy resins, epoxy resins, silicone resins, polyarylate resins, polyamide resins, polyether resins, polyurethane resins, polyacrylamide resins and phenolic resins. Also usable are thermosetting resins prepared by partially crosslinking these resins. One or more of these resins may be used herein either singly or as combined. Of the resins mentioned above, especially preferred for the binder resin 17 are polystyrene resins, polycarbonate resins, polyarylate resins and polyphenylene oxides, as their volume resistivity is at least $10^{13}\Omega$ and their electric insulation is therefore good, and as their film formability and potential characteristics are also good.

In general, A/B, which is a ratio of the charge-transporting substance 13 (A) to the binder resin 17 (B) is approximately 10/12 by weight. In the electrophotographic photoreceptor 1 of the invention, however, the ratio A/B falls between 10/12 and 10/30 by weight. As so mentioned hereinabove, since the charge-transporting substance 13 contains the organic photoconductive material of formula (1) or (2) of high charge mobility of the invention, the ratio A/B may fall in a broad range of from 10/12 to 10/30 in the invention. This means that even when the proportion of the binder resin is large in the invention, as compared with other cases that uses a conventional charge-generating substance, the photoreceptor of the invention can still maintain good responsiveness to light. Accordingly, in the invention, the printing durability of the charge transportation layer 16 may be improved and the durability itself of the electrophotographic photoreceptor may be therefore improved, not detracting from the responsiveness to light of the photoreceptor. When the ratio A/B is smaller than 10/30, or that is, when the proportion of the binder resin 17 is larger than the defined range, then the viscosity of the coating liquid to form the charge transportation layer 16 in dipping will increase, and, if so, the coating rate will lower and the productivity will therefore remarkably worsen. In case where the amount of the solvent in the coating liquid is increased for preventing the viscosity of the coating liquid from increasing, it causes blushing and the charge transportation layer 16 formed will be whitened. On the other hand, when the ratio A/B is larger than 10/12, or that is, when the proportion of the binder resin 17 is smaller than the defined range, the printing durability of the charge transportation layer 16 will be lower as compared with the case where the proportion of the binder resin 17 is high, and the photoconductive layer will be much worn. For these reasons, the ratio A/B is defined to fall between 10/12 and 10/30.

If desired, some additive such as plasticizer or leveling agent may be added to the charge transportation layer 16 for improving the film formability, flexibility and the surface smoothness of the layer. The plasticizer includes, for example, dibasic acid esters, fatty acid esters, phosphates, phthalates, chloroparaffins and epoxy-type plasticizers. For the leveling agent, for example, usable is a silicone leveling agent.

Also if desired, fine particles of inorganic or organic compounds may be added to the charge transportation layer 16 for increasing the mechanical strength and improving the electric properties of the layer.

Also if desired, other various additives such as antioxidant and sensitizers may be added to the charge transportation layer 16. These improve the potential characteristics of the layer and stabilize the coating liquid for the layer. In addition, these are effective for relieving the fatigue deterioration of photoreceptors in repeated use and improving the durability thereof.

Preferred examples of the antioxidant are hindered phenol derivatives and hindered amine derivatives. Preferably, the amount of the hindered phenol derivative to be added to the layer is from 0.1 to 50% by weight of the charge-transporting substance 13. Also preferably, the amount of the hindered amine derivative to be added thereto is from 0.1 to 50% by weight of the charge-transporting substance 13. A hindered phenol derivative may be mixed with a hindered amine derivative for use herein. In this case, the overall amount of the combined hindered phenol derivative and hindered amine derivative is preferably from 0.1 to 50% by weight of the charge-transporting substance 13. When the amount of the hindered phenol derivative used, the amount of the hindered amine derivative used, or the overall amount of the combined hindered phenol derivative and hindered amine derivative is smaller than 0.1% by weight, it is ineffective for improving the stability of the coating liquid and for improving the durability of the photoreceptor. When, however, it is larger than 50% by weight, then it will have some negative influence on the photoreceptor characteristics. For these reasons, the amount of the antioxidant to be used herein is defined to fall between 0.1% by weight and 50% by weight.

Like the charge generation layer 15, the charge transportation layer 16 may be formed, for example, according to a spraying, bar coating, roll coating, blade coating, ring coating or dipping method that comprises preparing a charge transportation layer-coating liquid by dissolving or dispersing the charge-transporting substance 13 and the binder resin 17 and optionally the additives as above in a suitable solvent, followed by applying the coating liquid onto the charge generation layer 15. Of such various coating methods, especially preferred is a dipping method for various reasons mentioned above, and it is used frequently in forming the charge transportation layer 16.

The solvent to be used for the coating liquid may be one or more selected from a group consisting of aromatic hydrocarbons such as benzene, toluene, xylene and monochlorobenzene; halogenohydrocarbons such as dichloromethane and dichloroethane; ethers such as THF, dioxane and dimethoxymethyl ether; and aprotic polar solvents such as N,N-dimethylformamide. If desired, any other solvent selected from alcohols, acetonitrile, methyl ethyl ketone and others may be added to the solvent as above.

Preferably, the thickness of the charge transportation layer 16 is from 5 μm to 50 μm, more preferably from 10 μm to 40 μm. When the thickness of the charge transportation layer is smaller than 5 μm, then the charge-retaining ability of the surface of the photoreceptor may lower. When, however, the thickness of the charge transportation layer 16 is larger than 50 μm, then the resolution power of the photoreceptor may lower. For these reasons, the thickness of the charge transportation layer 16 is defined to be from 5 μm to 50 μm.

At least one electron-receiving substance and dye may be added to the photosensitive layer 14 for improving the sensitivity of the layer and for preventing increase of the residual potential and the fatigue thereof in repeated use.

The electron-receiving substance includes, for example, acid anhydrides such as succinic anhydride, maleic anhydride, phthalic anhydride and 4-chloronaphthalic anhydride; cyano compounds such as tetracyanoethylene and terephthalmalondinitrile; aldehydes such as 4-nitrobenzaldehyde; anthraquinones such as anthraquinone and 1-nitroanthraquinone; polycyclic or heterocyclic nitro compounds such as 2,4,7-trinitrofluorenone and 2,4,5,7-tetranitrofluorenone; electron-attracting materials such as diphenoquinone compounds, and polymers of such electron-attracting materials.

For the dye, herein usable are xanthene dyes, thiazine dyes, triphenylmethane dyes, quinoline pigments, and other organic photoconductive compounds such as copper phthalocyanine. The organic photoconductive compounds may function as an optical sensitizer.

A protective layer may be provided on the surface of the photosensitive layer 14. The protective layer may improve the printing durability of the photosensitive layer 14 and may prevent chemical bad influences of ozone and nitrogen oxides, which are generated in the process of charging the surface of photoreceptors through corona discharging treatment, on the photosensitive layer 14. The protective layer may be, for example, a layer of resin, inorganic filler-containing resin or inorganic oxide.

Figure 2:
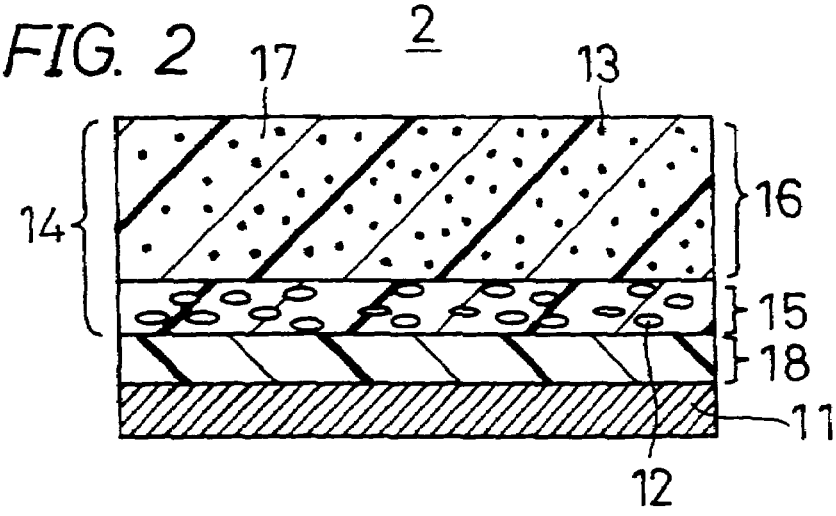
FIG. 2 is a schematic cross-sectional view showing, in a simplified manner, the constitution of an electrophotographic photoreceptor, another embodiment of the electrophotographic photoreceptor of the invention.

FIG. 2 is a schematic cross-sectional view showing, in a simplified manner, the constitution of an electrophotographic photoreceptor 2, another embodiment of the electrophotographic photoreceptor of the invention. The electrophotographic photoreceptor 2 is similar to the electrophotographic photoreceptor 1 shown in FIG. 1, and the parts that are the same in the two are represented by the same reference numeral and their description is omitted herein. One noticeable matter in this embodiment is that an interlayer 18 is provided between the conductive support 11 and the photosensitive layer 14.

When the interlayer 18 is not provided between the conductive support 11 and the photosensitive layer 14, then charges may be injected from the conductive support 11 to the photosensitive layer 14 and the chargeability of the photosensitive layer 14 is thereby lowered and, as a result, the surface charges in the area except that to be erased through exposure to light decrease and the images formed will have defects, for example, they will be fogged. In particular, when the images are formed in a process of reversal development, a toner image is formed in the part where the surface charges have decreased through exposure to light. In such a case, therefore, when the surface charges decrease for any other reason than exposure to light, then toner will adhere to the area of white background and form fine black dots to cause image fog that is referred to as black peppers, and it remarkably worsens the quality of the images formed. Specifically, in that case, the chargeability of the photosensitive layer 14 may lower in fine regions owing to the defects of the conductive support 11 or the photosensitive layer 14, therefore causing image fog such as black peppers that are to be serious image defects. As so mentioned hereinabove, when the interlayer 18 is provided between the two layers, it prevents the charge injection from the conductive layer 11 to the photosensitive layer 14, and therefore, the chargeability of the photosensitive layer 14 is prevented from lowering, the surface charges in the area except that to be erased through exposure to light are prevented from decreasing, and the image defects such as image fog are thereby prevented.

In addition, the interlayer 18 may cover the surface defects of the conductive support 11 to thereby make the support have a uniform surface, and the filmforming ability of the photosensitive layer 14 is therefore enhanced. Further, the interlayer 18 prevents the photosensitive layer 14 from being peeled off from the conductive support 11, and the adhesiveness between the conductive support 11 and the photosensitive layer 14 is thereby enhanced.

The interlayer 18 may be a resin layer of various resin materials or an alumite layer.

The resin material to form the resin layer includes, for example, various resins such as polyethylene resins, polypropylene resins, polystyrene resins, acrylic resins, polyvinyl chloride resins, polyvinyl acetate resins, polyurethane resins, epoxy resins, polyester resins, melamine resins, silicone resins, polyvinyl butyral resins and polyamide resins; copolymer resins containing at least two repetitive units of these resins; casein, gelatin, polyvinyl alcohol, and ethyl cellulose. Of those, especially preferred are polyamide resins. Also preferred are alcohol-soluble nylon resins. Preferred examples of the alcohol-soluble nylon resins are copolymer nylons prepared through copolymerization with 6-nylon, 6,6-nylon, 6,10-nylon, 11-nylon or 2-nylon; and chemically-modified nylon resins such as N-alkoxymethyl-modified nylon and N-alkoxyethyl-modified nylon.

The interlayer 18 may contain particles of metal oxide or the like. The particles may control the volume resistivity of the interlayer 18 and will be effective for further preventing the charge injection from the conductive support 11 to the photosensitive layer 14, and, in addition, they may ensure the electric properties of the photoreceptors under different conditions.

The metal oxide particles may be, for example, particles of titanium oxide, aluminum oxide, aluminum hydroxide or tin oxide.

For adding the metal oxide particles to the interlayer 18, for example, an interlayer-coating liquid is prepared by dispersing the particles in a resin solution that contains the resin as above, and this is applied onto the conductive support 11 to thereby form thereon the interlayer 18 that contains the metal oxide particles.

For the solvent of the resin solution, usable are water and various organic solvents. Especially preferred for it are single solvents such as water, methanol, ethanol or butanol; and mixed solvents such as a combination of water and alcohols, a combination of at least two different types of alcohols, a combination of acetone or dioxolane and alcohols, and a combination of a chlorine-containing solvent such as dichloroethane, chloroform or trichloroethane and alcohols.

For dispersing the particles in the resin solution, employable is any ordinary method of using ball mill, sand mill, attritor, shaking mill or ultrasonic disperser.

The ratio of the total content C of the resin and the metal oxide in the interlayer-coating liquid to the solvent content D of the coating liquid, C/D by weight preferably falls between 1/99 and 40/60, more preferably between 2/98 and 30/70. The ratio by weight of the resin to the metal oxide (resin/metal oxide) preferably falls between 90/10 and 1/99, more preferably between 70/30 and 5/95.

For applying the interlayer-coating liquid to the support, employable is a method of spraying, bar coating, roll coating, blade coating, ring coating or dipping. As so mentioned hereinabove, a dipping method is relatively simple and favorable in point of the productivity and the production costs, and it is much utilized in forming the interlayer 18.

The thickness of the interlayer 18 is preferably from 0.01 μm to 20 μm, more preferably from 0.05 μm to 10 μm. When the interlayer 18 is thinner than 0.01 μm, it could not substantially function as an interlayer 18, or that is, it could not cover the defects of the conductive support 11 to form a uniform surface, and it could not prevent the charge injection from the conductive support 11 to the photosensitive layer 14. As a result, the chargeability of the photosensitive layer 14 will lower. When the interlayer 18 is thicker than 20 μm and when such a thick interlayer 18 is formed according to a dipping method, the interlayer 18 will be difficult to form and, in addition, a uniform photoconductive layer 14 could not be formed on the interlayer 18, and the sensitivity of the photoreceptor will lower. Therefore, such a thick layer is unfavorable for the interlayer 18.

Figure 3:
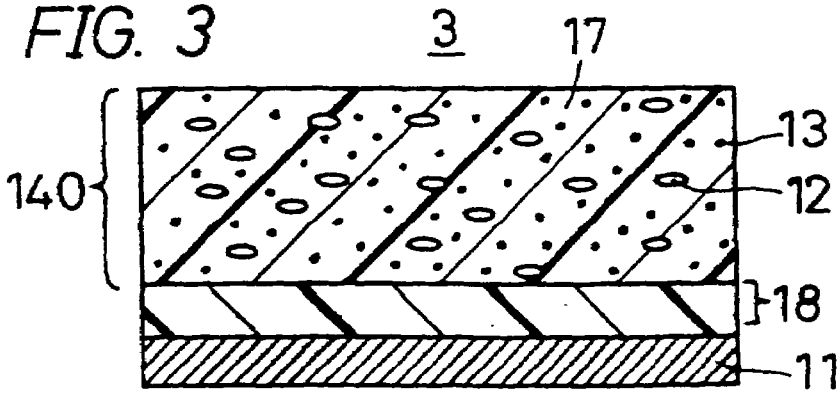
FIG. 3 is a schematic cross-sectional view showing, in a simplified manner, the constitution of an electrophotographic photoreceptor, still another embodiment of the electrophotographic photoreceptor of the invention.

FIG. 3 is a schematic cross-sectional view showing, in a simplified manner, the constitution of an electrophotographic photoreceptor 3, still another embodiment of the electrophotographic photoreceptor of the invention. The electrophotographic photoreceptor 3 is similar to the electrophotographic photoreceptor 2 shown in FIG. 2, and the parts that are the same in the two are represented by the same reference numeral and their description is omitted herein.

One noticeable matter in this embodiment is that the electrophotographic photoreceptor 3 is a singlelayered photoreceptor that has a single-layered photosensitive layer 140 containing both a charge-generating substance 12 and a charge-transporting substance 13 in a binder resin 17.

The photosensitive layer 140 is formed in the same manner as that for forming the charge transportation layer 16. For example, a charge-generating substance 12 such as that mentioned hereinabove, a charge-transporting substance 13 that contains the organic photoconductive material of formula (1) or (2) of the invention, and a binder resin 17 are dissolved or dispersed in a suitable solvent such as that mentioned hereinabove to prepare a photosensitive layer-coating liquid, and the coating liquid is applied onto the interlayer 18 according to a dipping method or the like to thereby form thereon the photosensitive layer 140.

The ratio of the charge-transporting substance 13 to the binder resin 17 in the photosensitive layer 140 may fall between 10/12 and 10/30 by weight, like the ratio A/B of the charge-transporting substance 13 to the binder resin 17 in the charge transportation layer 16.

The thickness of the photosensitive layer 140 is preferably from 5 μm to 100 μm, more preferably from 10 μm to 50 μm. When the photosensitive layer 140 is thinner than 5 μm, then the charge-retaining ability of the surface of the photoreceptor may lower. When, however, the photosensitive layer 140 is thicker than 100 μm, the productivity may lower. Accordingly, the thickness of the layer 140 is defined to fall between 5 μm and 100 μm.

Not limited to the structures shown in FIG. 1 to FIG. 3, the electrophotographic photoreceptor of the invention may have any other different layer constitution.

If desired, the layers of the photoreceptor may contain various additives such as antioxidant, sensitizer and UV absorbent. These additives may improve the potential characteristics of the photoreceptor when the layers are formed by application. In addition, they may stabilize the coating liquids for the layers. Further, they may relieve the fatigue deterioration of the photoreceptor in repeated use and may improve the durability thereof. Preferred examples of antioxidant for use herein are phenol compounds, hydroquinone compounds, tocopherol compounds and amine compounds. Preferably, the amount of the antioxidant to be used herein is from 0.1 to 50% by weight of the charge-transporting substance 13. When the amount of the antioxidant used is smaller than 0.1% by weight, it will be ineffective for improving the stability of the coating liquids and for improving the durability of the photoreceptor. When, however, the amount of the antioxidant used is larger than 50% by weight, it will have a bad influence on the photoreceptor characteristics. For these reasons, the amount of the antioxidant is defined to fall between 0.1% by weight and 50% by weight.

Next described is an image-forming apparatus that comprises the electrophotographic photoreceptor of the invention. The image-forming apparatus of the invention is not limited to the description given hereinunder.

Figure 4:
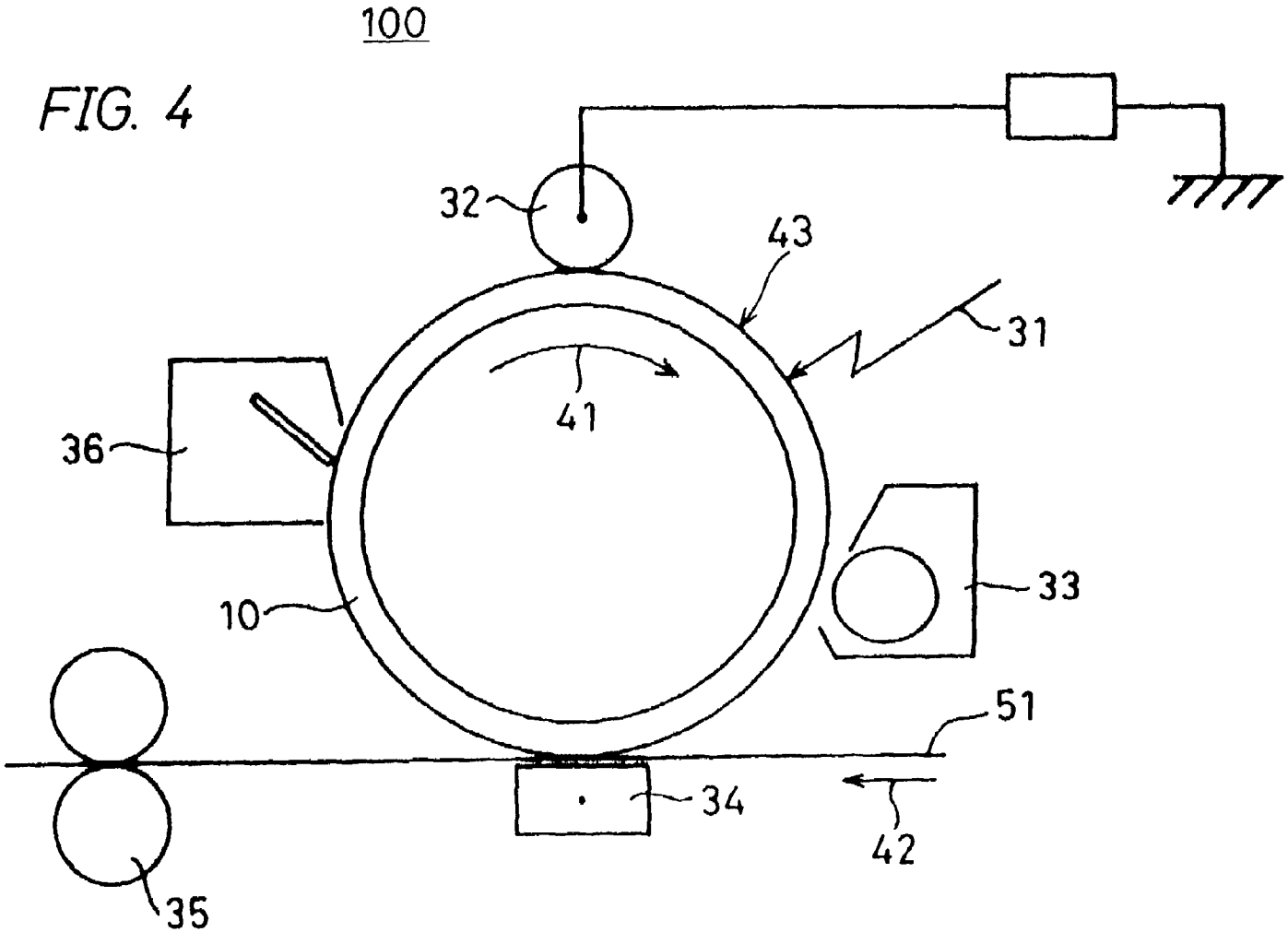
FIG. 4 is a constitutional view showing, in a simplified manner, the constitution of an image-forming apparatus comprises an electrophotographic photoreceptor of the invention.

FIG. 4 is a constitutional view showing, in a simplified manner, the constitution of an image-forming apparatus 100 that comprises an electrophotographic photoreceptor 10 of the invention.

The image-forming apparatus 100 comprises an electrophotographic photoreceptor 10 (hereinafter this will be simply referred to as "photoreceptor 10") of the invention. The photoreceptor 10 is cylindrical and is rotationally driven by a driving means (not shown) at a predetermined peripheral speed in the direction of the reference numeral 41. Around its periphery, the photoreceptor 10 is equipped with a charger 32, a semiconductor laser (not shown), a developing unit 33, a transfer charger 34 and a cleaner 36 in that order in the rotational direction of the photoreceptor 10. In addition, a fixing unit 35 is provided in the direction in which transfer paper 51 runs.

The image-forming process by the use of the imageforming apparatus 100 is described. First, the photoreceptor 10 is uniformly charged to a predetermined positive or negative potential by the contact or noncontact charger 32, at its surface 43 that faces the charger 32. Next, a laser beam 31 is radiated by a semiconductor laser (not shown), and the surface 43 of the photoreceptor 10 is exposed to it. The laser beam 31 is repeatedly scanned in the longitudinal direction of the photoreceptor 10, or that is, in the main scanning direction thereof whereby a latent image is successively formed on the surface 43 of the photoreceptor 10. Thus formed, the latent image is developed by the developing unit 33, which is provided downstream in the rotational direction from the image-forming point of the laser beam 31, and gives a toner image.

Synchronized with the exposure of the photoreceptor 10 to light, transfer paper 51 is given to the transfer charger 34 which is provided downstream in the rotational direction of the developing unit 33, and it runs in the direction of the reference numeral 42.

The toner image formed on the surface 43 of the photoreceptor 10 in the developing unit 33 is transferred onto the surface of the transfer paper 51 by the transfer charger 34. The transfer paper 51 thus having the toner image transferred thereon is conveyed to the fixing unit 35 by a conveyor belt (not shown), and the toner image is fixed on the transfer paper 51 by the fixing unit 35 to form a part of an image.

The toner remaining on the surface 43 of the photoreceptor 10 is removed by a cleaner 36 that is provided further downstream the transfer charger 34 and upstream the charger 32 in the rotational direction of the photoreceptor 10 along with an antistatic lamp (not shown). Further rotating the photoreceptor 10, the process as above is repeated and an image is thereby formed on the transfer paper 51. The transfer paper 51 thus having an image formed thereon is led out of the image-forming apparatus 100.

The electrophotographic photoreceptor 10 built in the image-forming apparatus 100 contains, as the charge-transporting substance therein, the organic photoconductive material of formula (1) or (2) of the invention, as so mentioned hereinabove. Therefore, its charge potential is high, its sensitivity is high, its responsiveness to light is good and its durability is good, and, in addition, such its characteristics do not lower even when it is driven at low temperatures or at high speed. Accordingly, the image-forming apparatus of the invention has high reliability and gives high-quality images under any conditions. In addition, since the characteristics of the photoreceptor 10 do not worsen even through exposure to light, the photoreceptor 10 exposed to light during maintenance thereof does not worsen the image quality, and the reliability of the image-forming apparatus 100 is therefore high.

EXAMPLES

The invention is described in more detail with reference to the following Examples, which, however, are not intended to restrict the scope of the invention.

Production Example 1

Production of Compound No. 1

Production Example 1

Production of Enamine Intermediate 23.3 g (1.0 equivalent) of N-(p-tolyl)-α-naphthylamine of the following structural formula (8), 20.6 g (1.05 equivalents) of diphenylacetaldehyde of the following structural formula (9), and 0.23 g (0.01 equivalents) of DL-10-camphorsulfonic acid were added to 100 ml of toluene and heated, and these were reacted for 6 hours while the side-product, water was removed out of the system through azeotropic distillation with toluene. After thus reacted, the reaction solution was concentrated to about 1/10, and gradually and dropwise added to 100 ml of hexane that was vigorously stirred, and this gave a crystal. The crystal was taken out through filtration, and washed with cold ethanol to obtain 36.2 g of a pale yellow powdery compound.

(8)

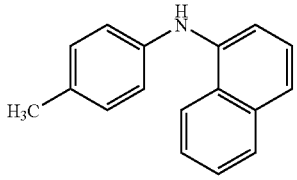

-continued (9)

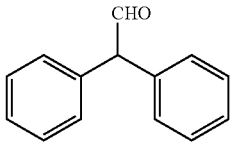

Thus obtained, the compound was analyzed through liquid chromatography-mass spectrometry (LC-MS), which gave a peak at 412.5 corresponding to the molecular ion $[M+H]^+$ of an enamine intermediate (calculated molecular weight: 411.20) of the following structural formula (10) with a proton added thereto. This confirms that the compound obtained herein is the enamine intermediate of formula (10) (yield: 88%). In addition, the data of LC-MS further confirm that the purity of the enamine intermediate obtained herein is 99.5%.

(10)

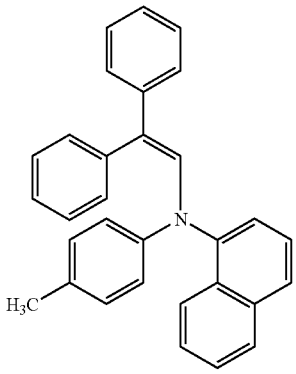

As in the above, the dehydrating condensation of N-(p-tolyl)-α-naphthylamine, a secondary amine of formula (8), and diphenylacetaldehyde, an aldehyde compound of formula (9) gives the enamine intermediate of formula (10).

Production Example 1-2

Production of Enamine-Aldehyde Intermediate 9.2 g (1.2 equivalents) of phosphorus oxychloride was gradually added to 100 ml of anhydrous N,N-dimethylformamide (DMF) and stirred for about 30 minutes to prepare a Vilsmeier reagent. 20.6 g (1.0 equivalent) of the enamine intermediate of formula (10) obtained in Production Example 1-1 was gradually added to the solution with cooling with ice. Next, this was gradually heated up to 80° C., and stirred for 3 hours while kept heated at 80° C. After thus reacted, the reaction solution was left cooled, and then this was gradually added to 800 ml of cold 4 N aqueous sodium hydroxide solution to form a precipitate. Thus formed, the precipitate was collected through filtration, well washed with water, and then recrystallized from a mixed solvent of ethanol and ethyl acetate to obtain 20.4 g of an yellow powdery compound.

Thus obtained, the compound was analyzed through LC-MS, which gave a peak at 440.5 corresponding to the molecular ion $[M+H]^+$ of an enamine-aldehyde intermediate (calculated molecular weight: 439.19) of the following structural formula (11) with a proton added thereto. This confirms that the compound obtained herein is the enamine-aldehyde intermediate of formula (11) (yield: 93%). In addition, the data of LC-MS further confirm that the purity of the enamine-aldehyde intermediate obtained herein is 99.7%.

(11)

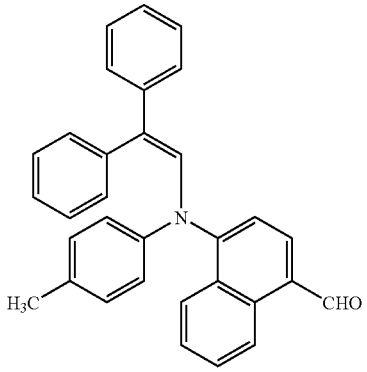

As in the above, the formylation of the enamine intermediate of formula (10) through Vilsmeier reaction gives the enamine-aldehyde intermediate of formula (11).

Production Example 1-3

Production of Compound No. 1

8.8 g (1.0 equivalent) of the enamine-aldehyde intermediate of formula (11) obtained in Production Example 1-2, and 6.1 g of diethyl cinnamylphosphonate of the following structural formula (12) were dissolved in 80 ml of anhydrous DMF, and 2.8 g (1.25 equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 10.1 g of an yellow crystal.

(12)

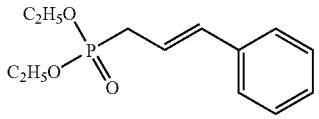

Thus obtained, the crystal was analyzed through LC-MS, which gave a peak at 540.5 corresponding to the molecular ion $[M+H]^+$ of the intended enamine compound, Compound No. 1 in Table 1 (calculated molecular weight: 539.26) with a proton added thereto.

Figure 5:
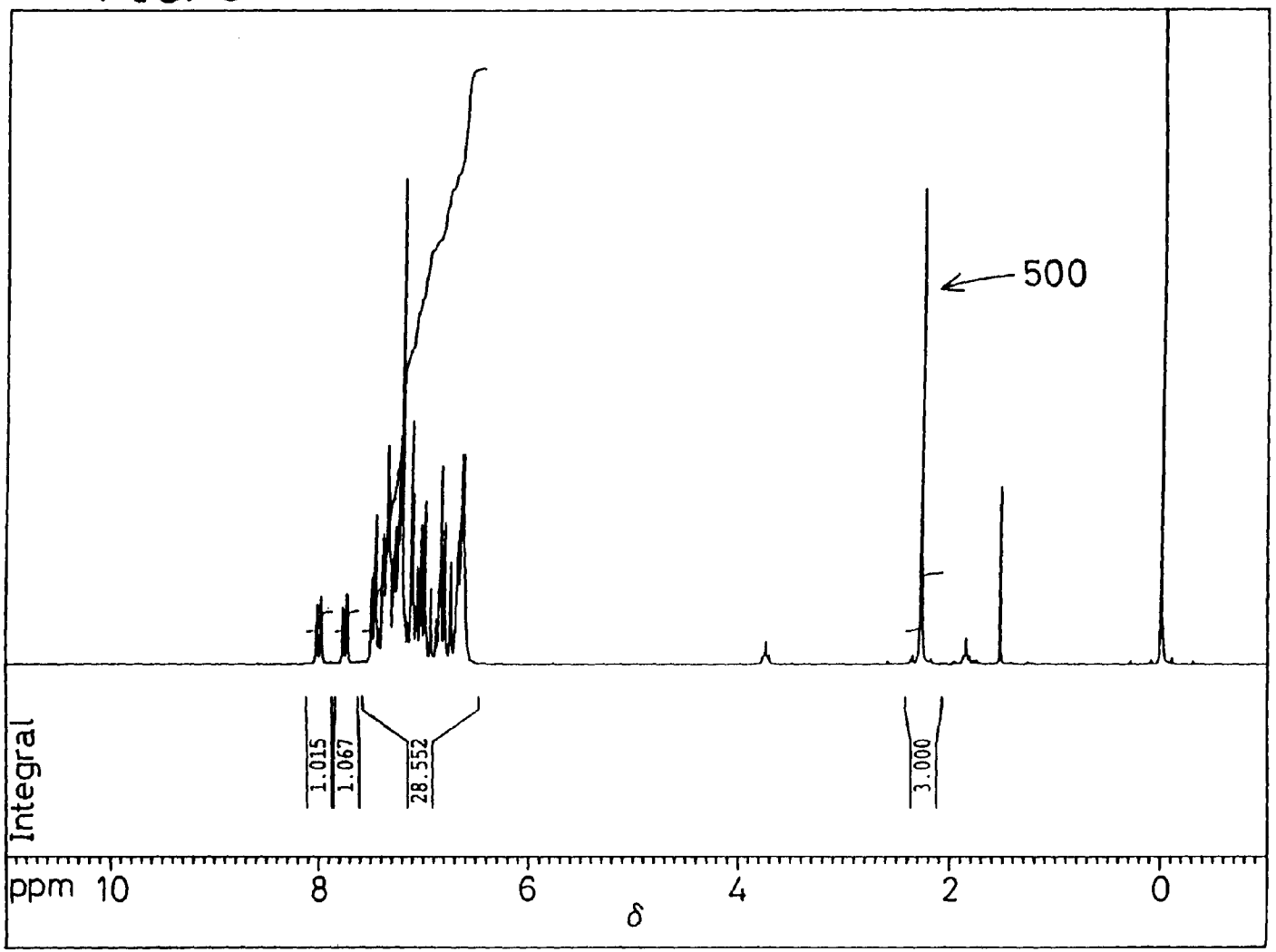
FIG. 5 is a $^{1}$H-NMR spectrum of the product in Production Example 1-3.
Figure 6:
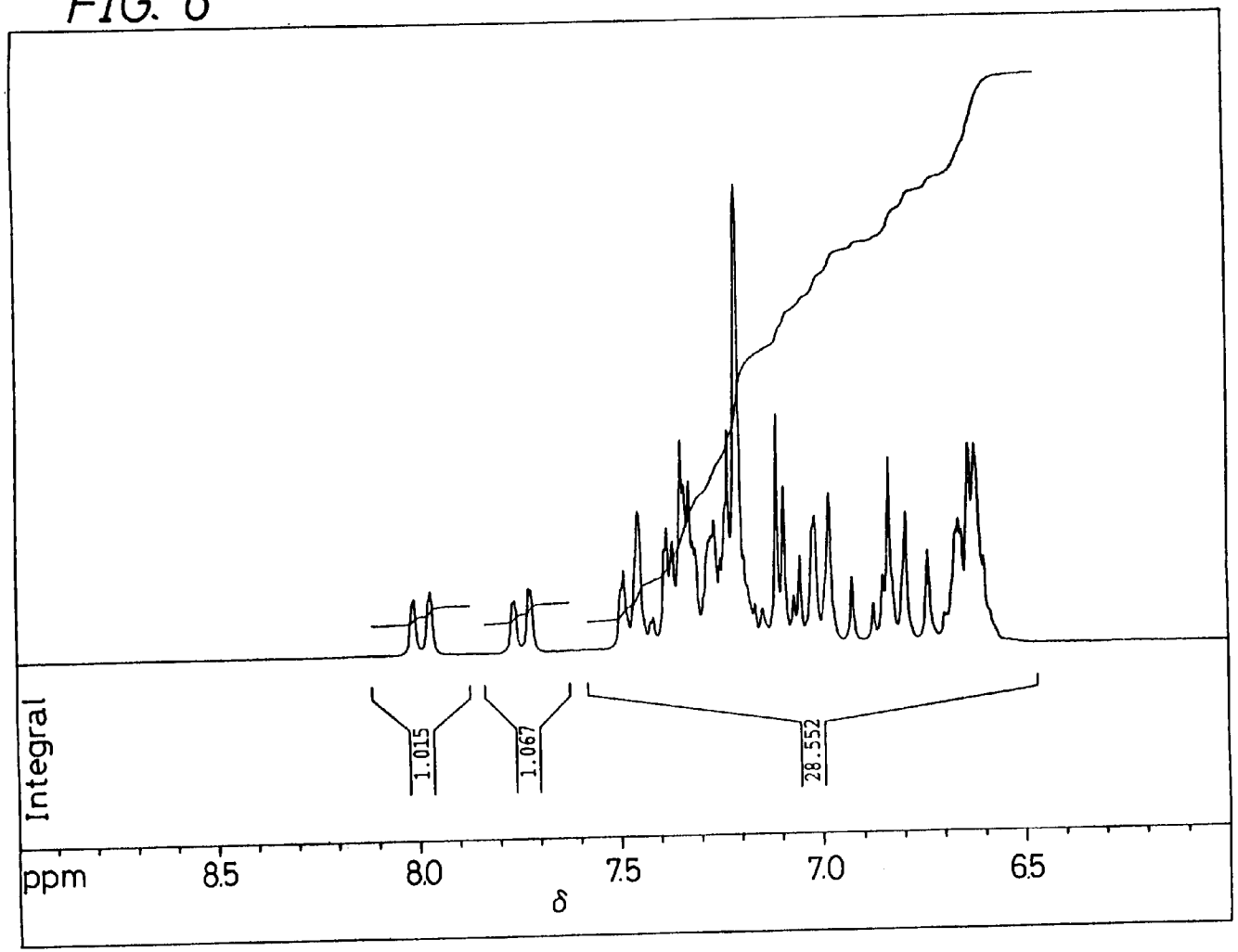
FIG. 6 is an enlarged view of the spectrum of FIG. 5 in the range of from 6 ppm to 9 ppm.
Figure 7:
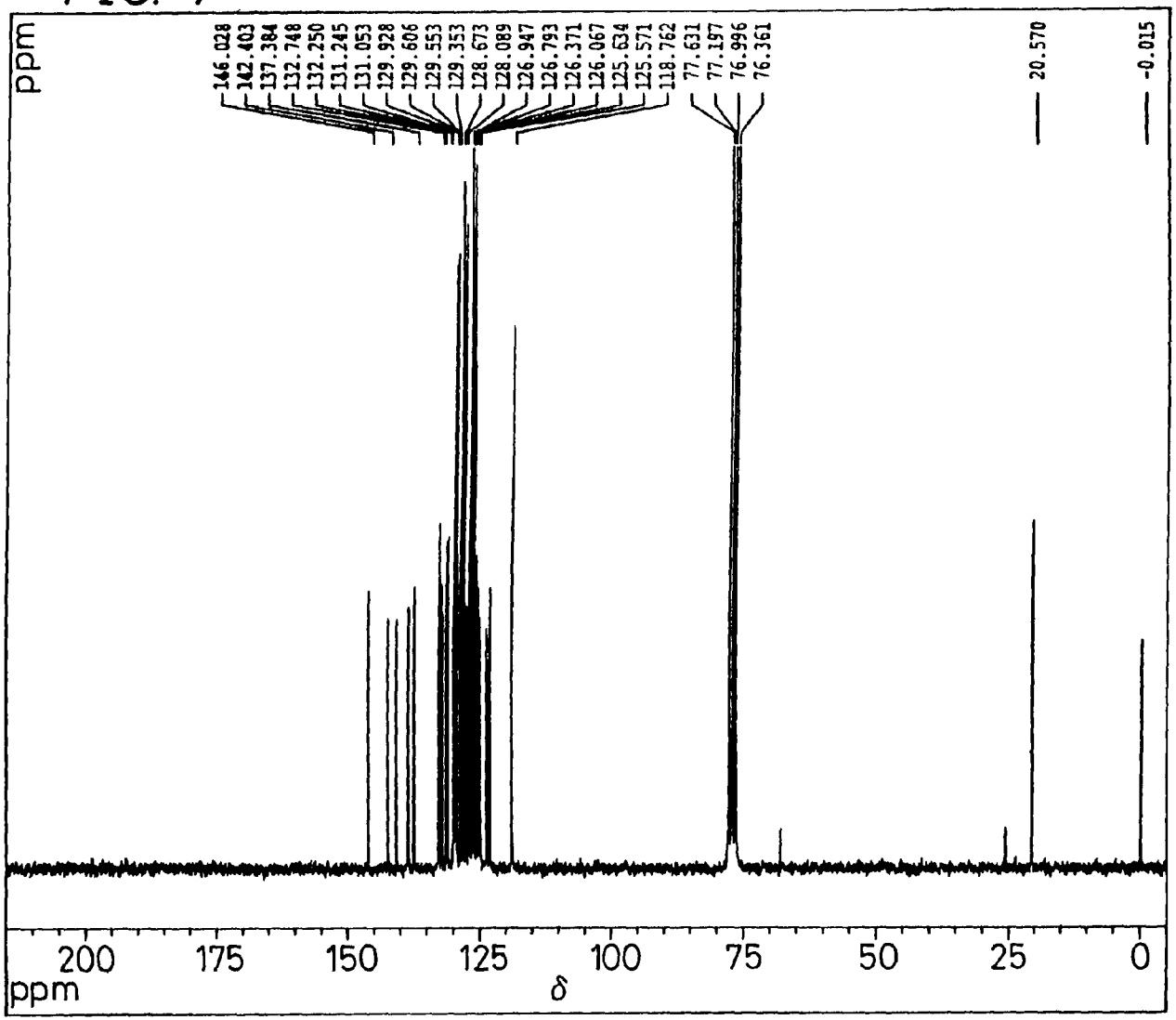
FIG. 7 is a $^{13}$C-NMR spectrum in ordinary measurement of the product in Production Example 1-3.
Figure 8:
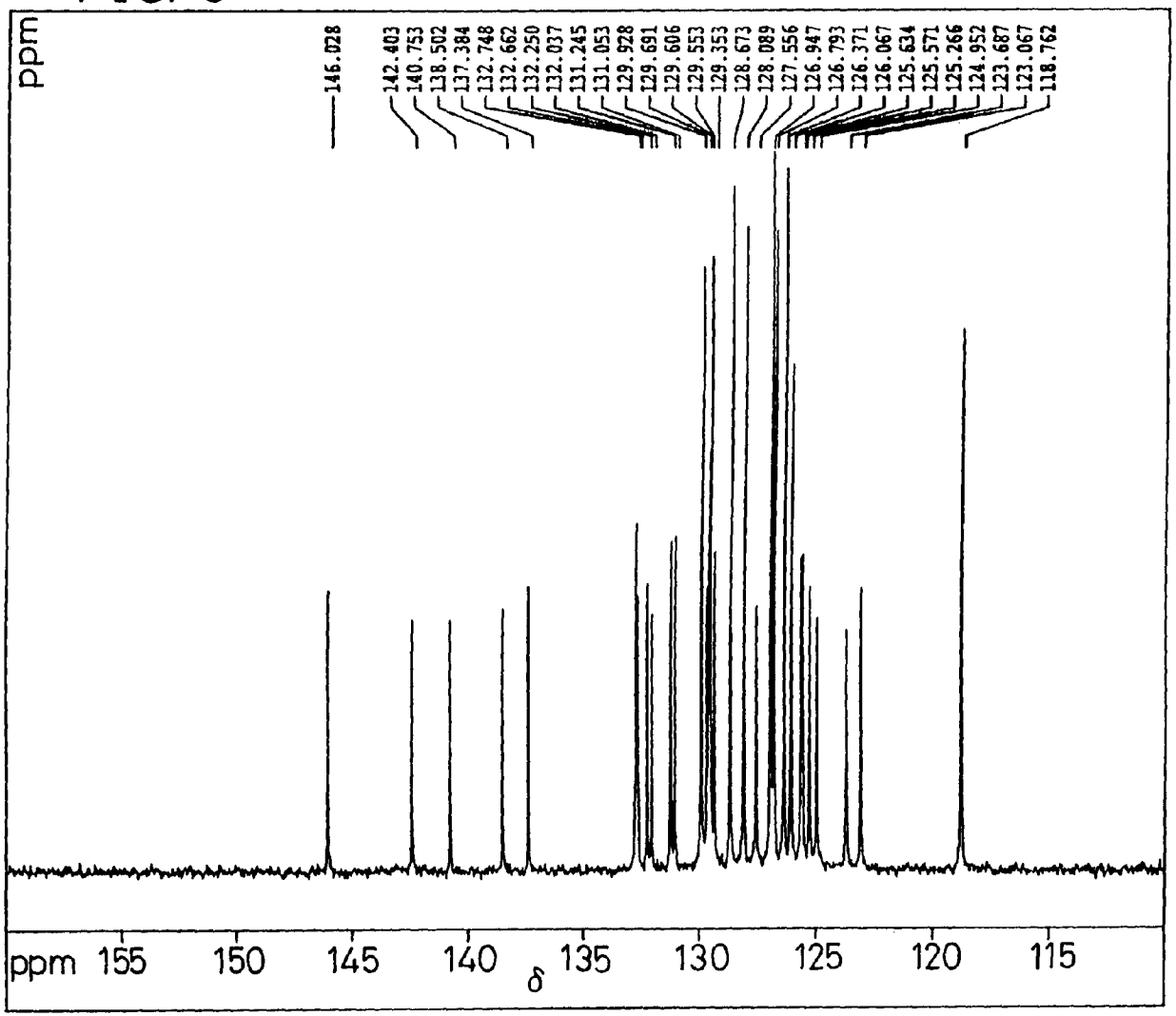
FIG. 8 is an enlarged view of the spectrum of FIG. 7 in the range of from 110 ppm to 160 ppm.
Figure 9:
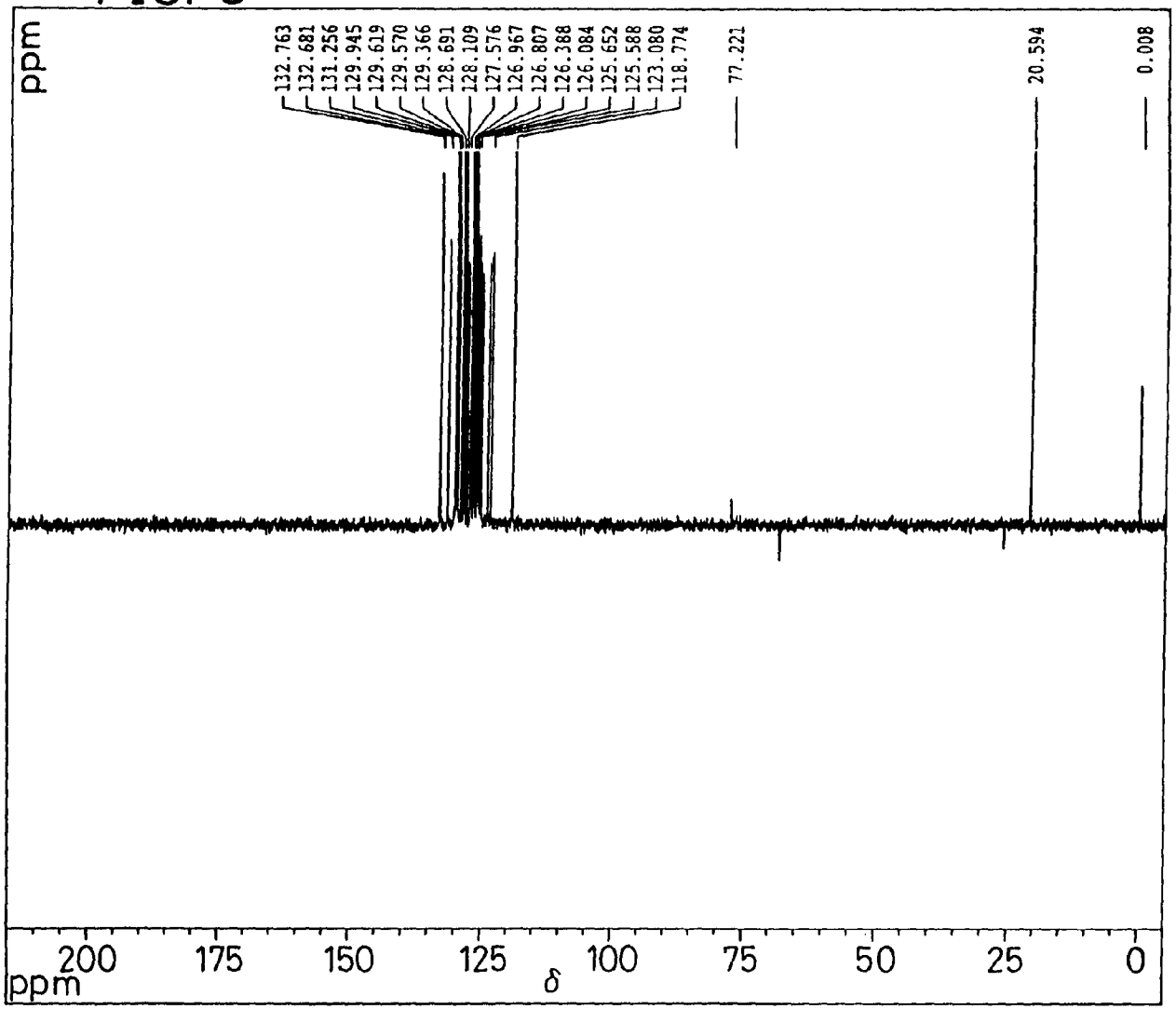
FIG. 9 is a $^{13}$C-NMR spectrum in DEPT135 measurement of the product in Production Example 1-3.
Figure 10:
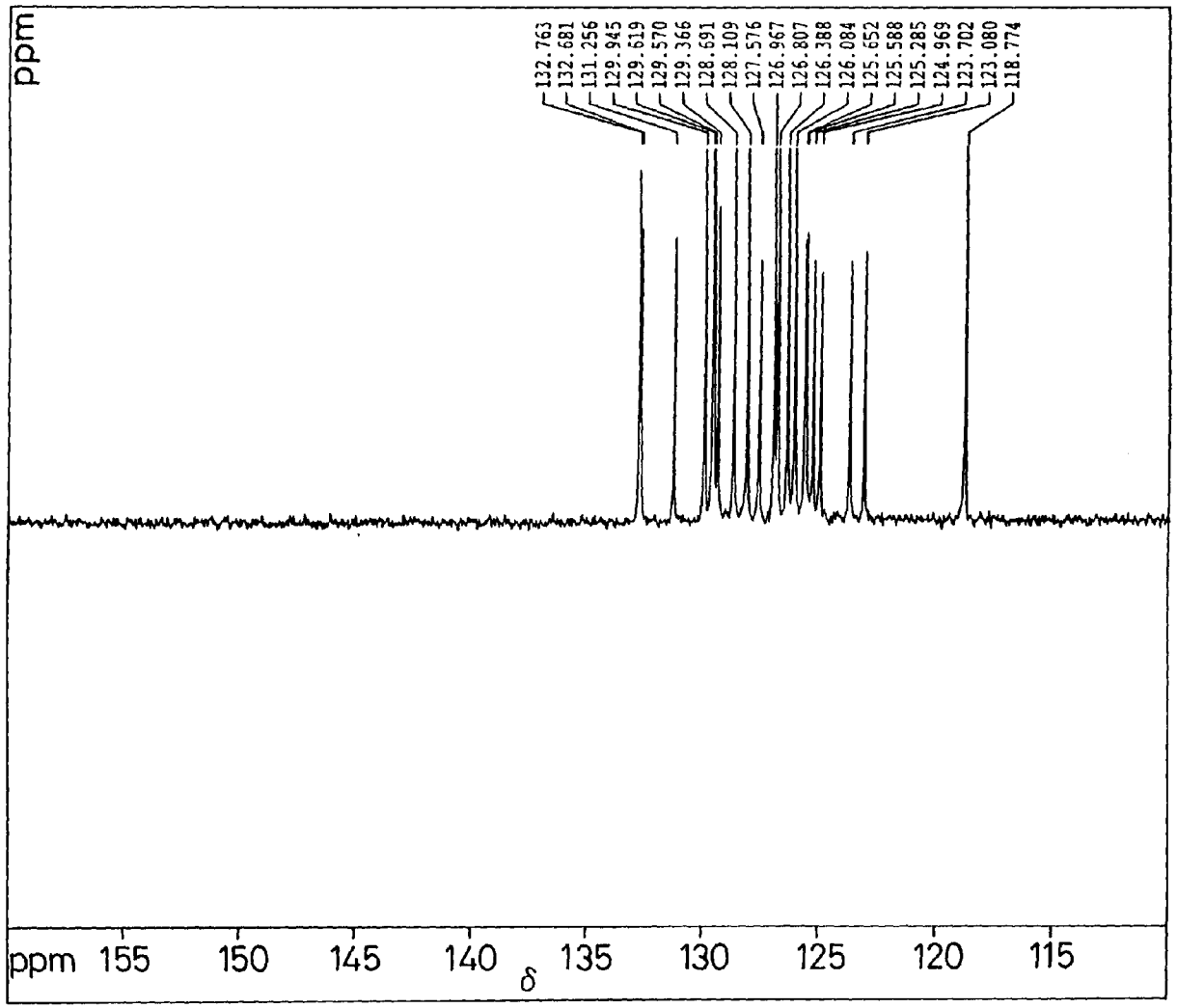
FIG. 10 is an enlarged view of the spectrum of FIG. 9 in the range of from 110 ppm to 160 ppm.

The nuclear magnetic resonance (NMR) spectrum of the crystal in heavy chloroform (chemical formula: $CDCl_3$) was measured, and this spectrum supports the structure of the enamine compound, Compound No. 1. FIG. 5 is the $^1$H-NMR spectrum of the product in this Production Example 1-3, and FIG. 6 is an enlarged view of the spectrum of FIG. 5 in the range of from 6 ppm to 9 ppm. FIG. 7 is the $^{13}$C-NMR spectrum in ordinary measurement of the product in Production Example 1-3, and FIG. 8 is an enlarged view of the spectrum of FIG. 7 in the range of from 110 ppm to 160 ppm. FIG. 9 is the $^{13}$C-NMR spectrum in DEPT135 measurement of the product in Production Example 1-3, and FIG. 10 is an enlarged view of the spectrum of FIG. 9 in the range of from 110 ppm to 160 ppm. In FIG. 5 to FIG. 10, the horizontal axis indicates the chemical shift δ (ppm) of the compound analyzed. In FIG. 5 and FIG. 6, the data written between the signals and the horizontal axis are relative integral values of the signals based on the integral value, 3, of the signal indicated by the reference numeral 500.

The data of LC-MS and the NMR spectrometry confirm that the crystal obtained herein is the enamine compound, Compound No. 1 (yield: 94%). In addition, the data of LC-MS further confirm that the purity of the enamine compound, Compound No. 1 obtained herein is 99.8%.

As in the above, the Wittig-Horner reaction of the enamine-aldehyde intermediate of formula (11) and the Wittig reagent, diethyl cinnamylphosphonate of formula (12) gives the enamine compound, Compound No. 1 shown in Table 1.

Production Example 2

Production of Compound No. 61

In the same manner as in Production Example 1 except that 4.9 g (1.0 equivalent) of N-(p-methoxyphenyl)-α-naphthylamine was used in place of 23.3 g (1.0 equivalent) of N-(p-tolyl)-α-naphthylamine of formula (8), an enamine intermediate was produced (yield: 94%) through dehydrating condensation and an enaminealdehyde intermediate was produced (yield: 85%) through Vilsmeier reaction, and this was further subjected to Wittig-Horner reaction to obtain 7.9 g of an yellow powdery compound. The equivalent relationship between the reagent and the substrate used in each reaction was the same as that in Production Example 1.

Thus obtained, the compound was analyzed through LC-MS, which gave a peak at 556.7 corresponding to the molecular ion $[M+H]^+$ of the intended enamine compound, Compound No. 61 in Table 9 (calculated molecular weight: 555.26) with a proton added thereto.

Figure 11:
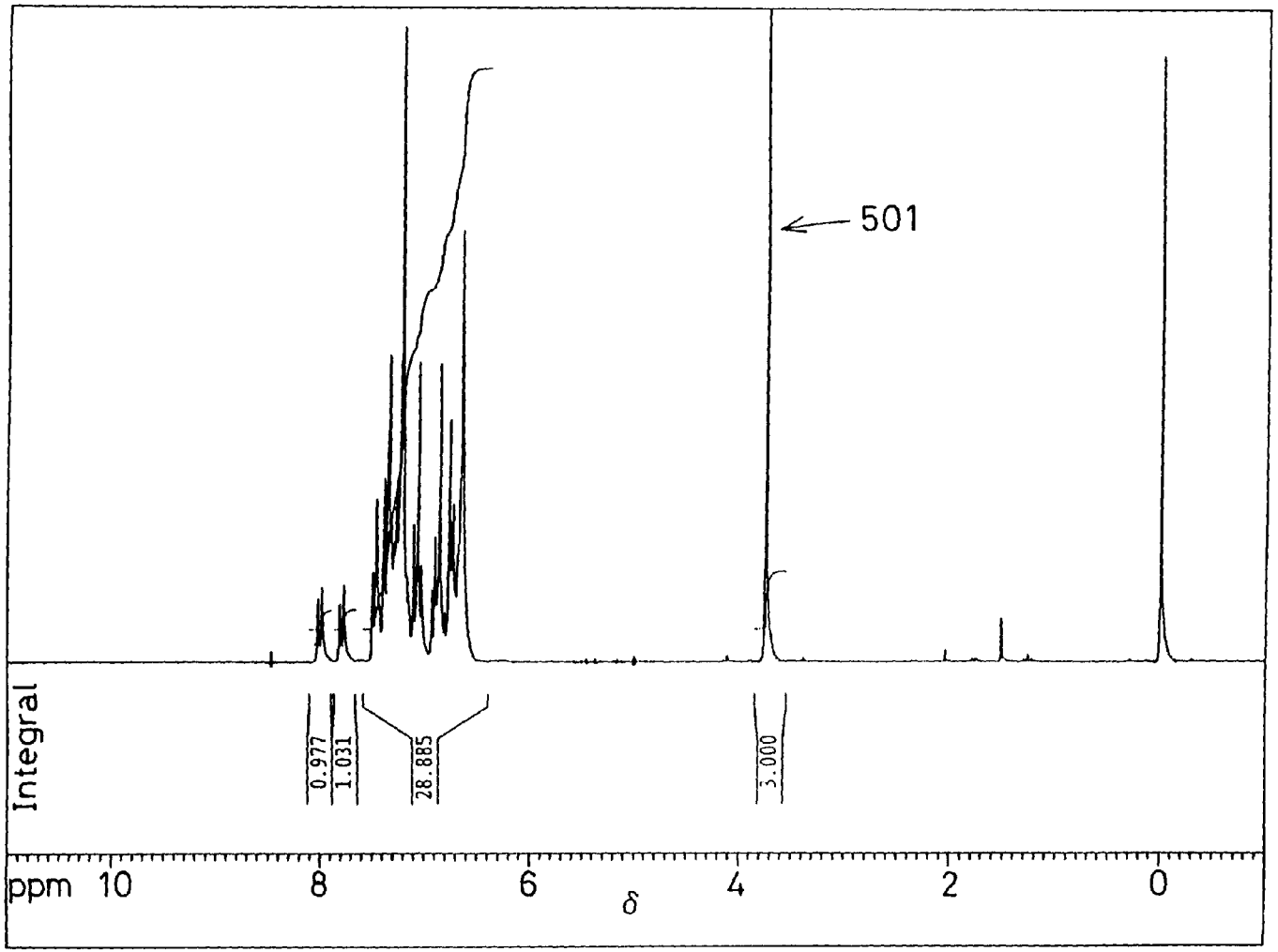
FIG. 11 is a $^{1}$H-NMR spectrum of the product in Production Example 2.
Figure 12:
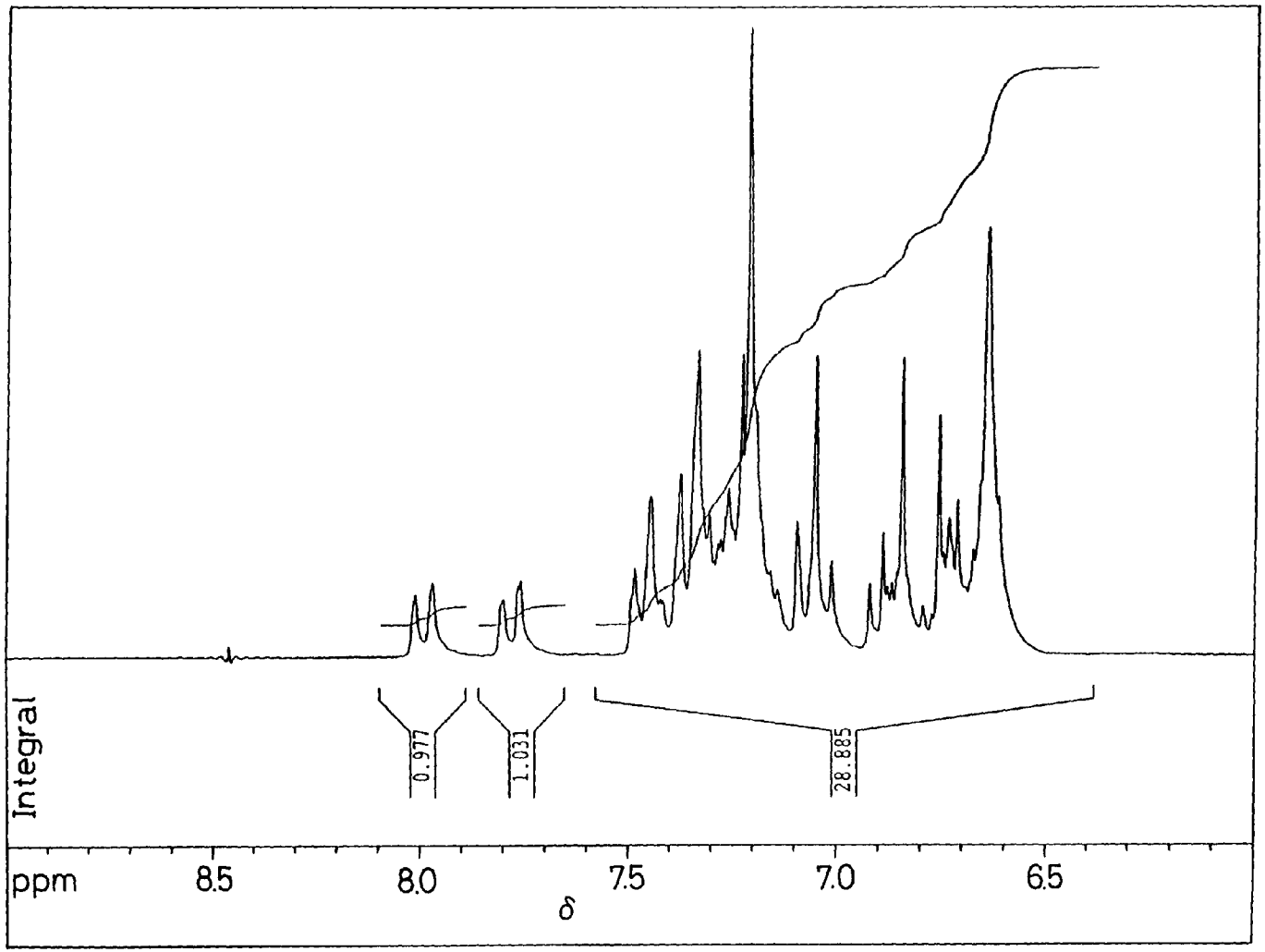
FIG. 12 is an enlarged view of the spectrum of FIG. 11 in the range of from 6 ppm to 9 ppm.
Figure 13:
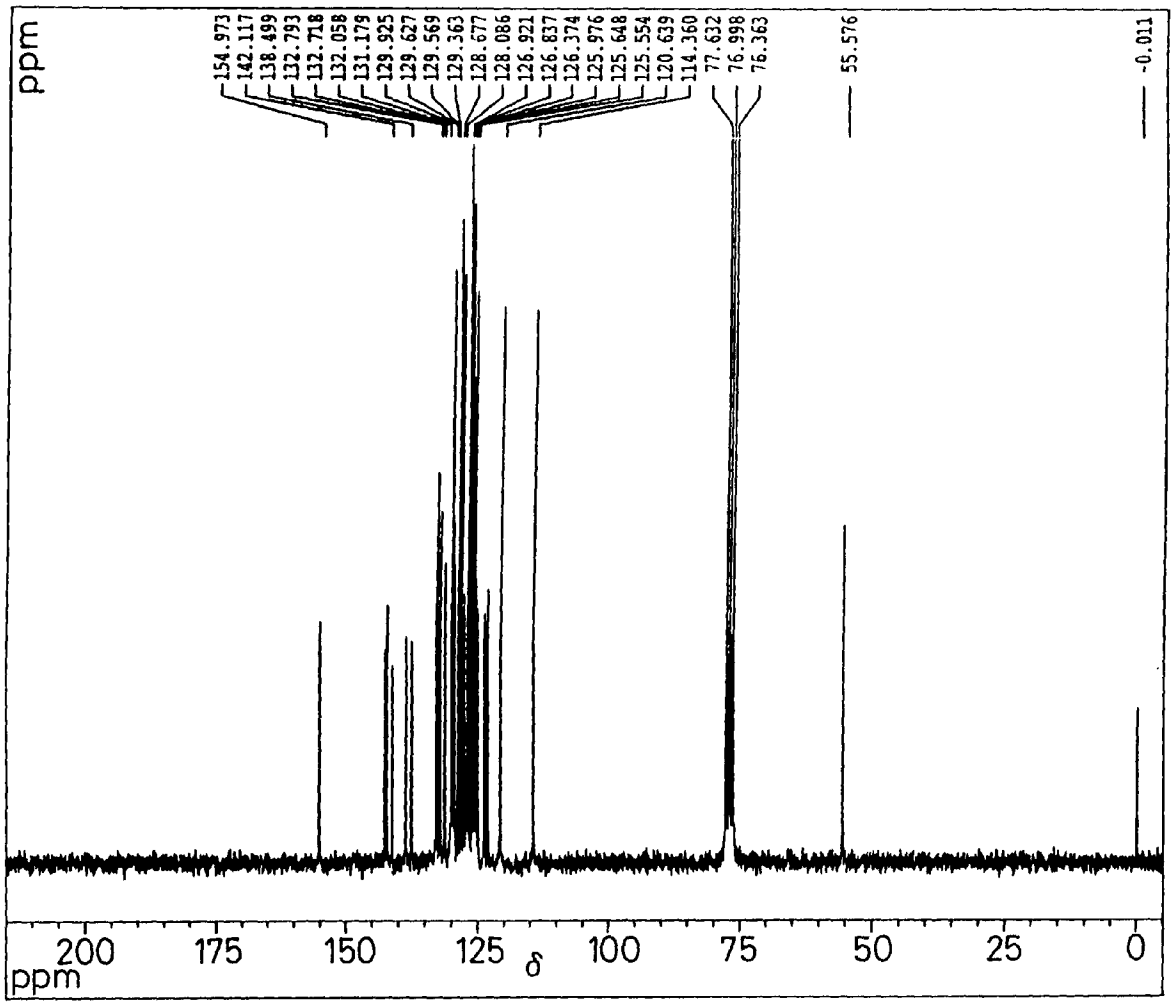
FIG. 13 is a $^{13}$C-NMR spectrum in ordinary measurement of the product in Production Example 2.
Figure 14:
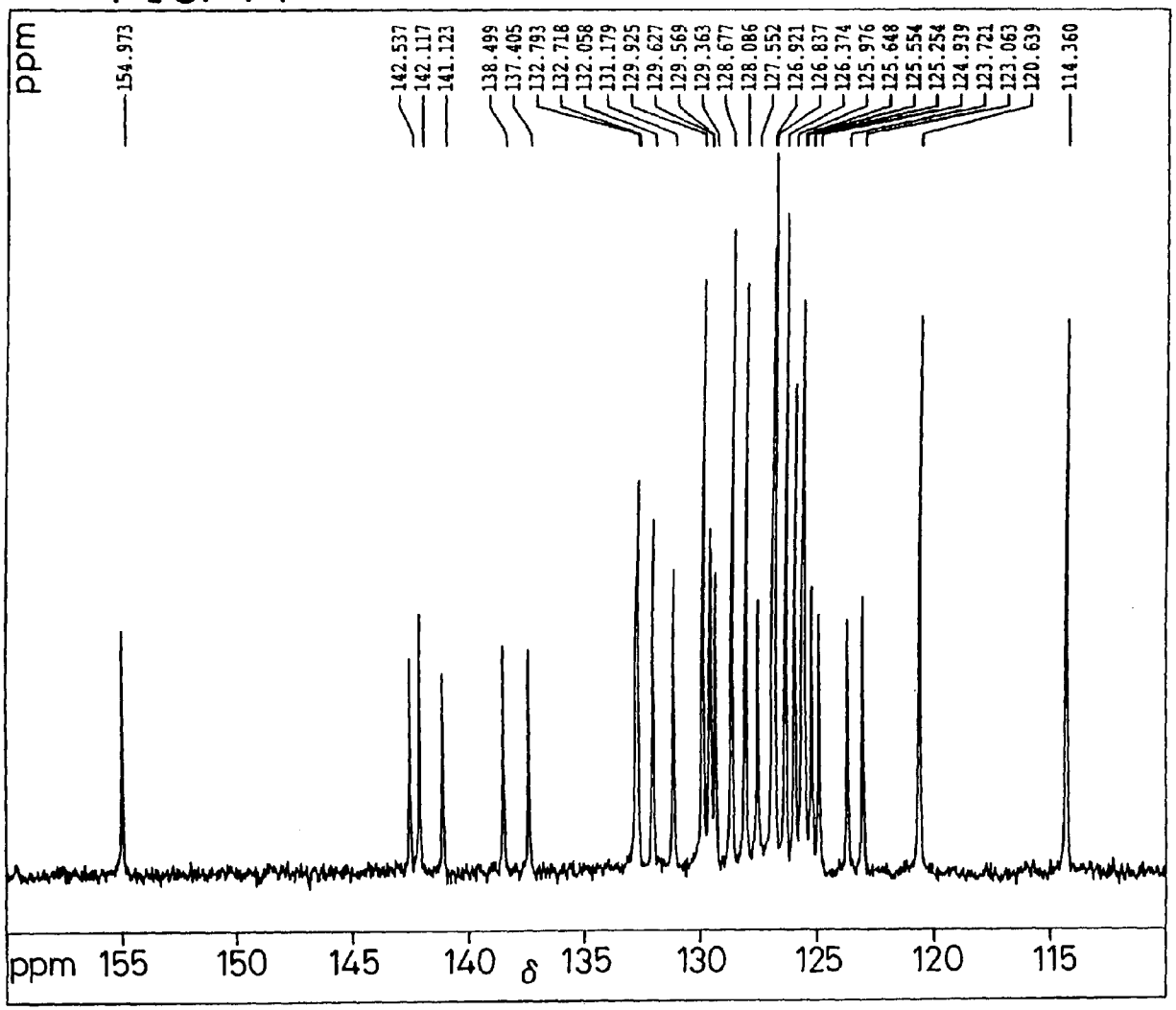
FIG. 14 is an enlarged view of the spectrum of FIG. 13 in the range of from 110 ppm to 160 ppm.
Figure 15:
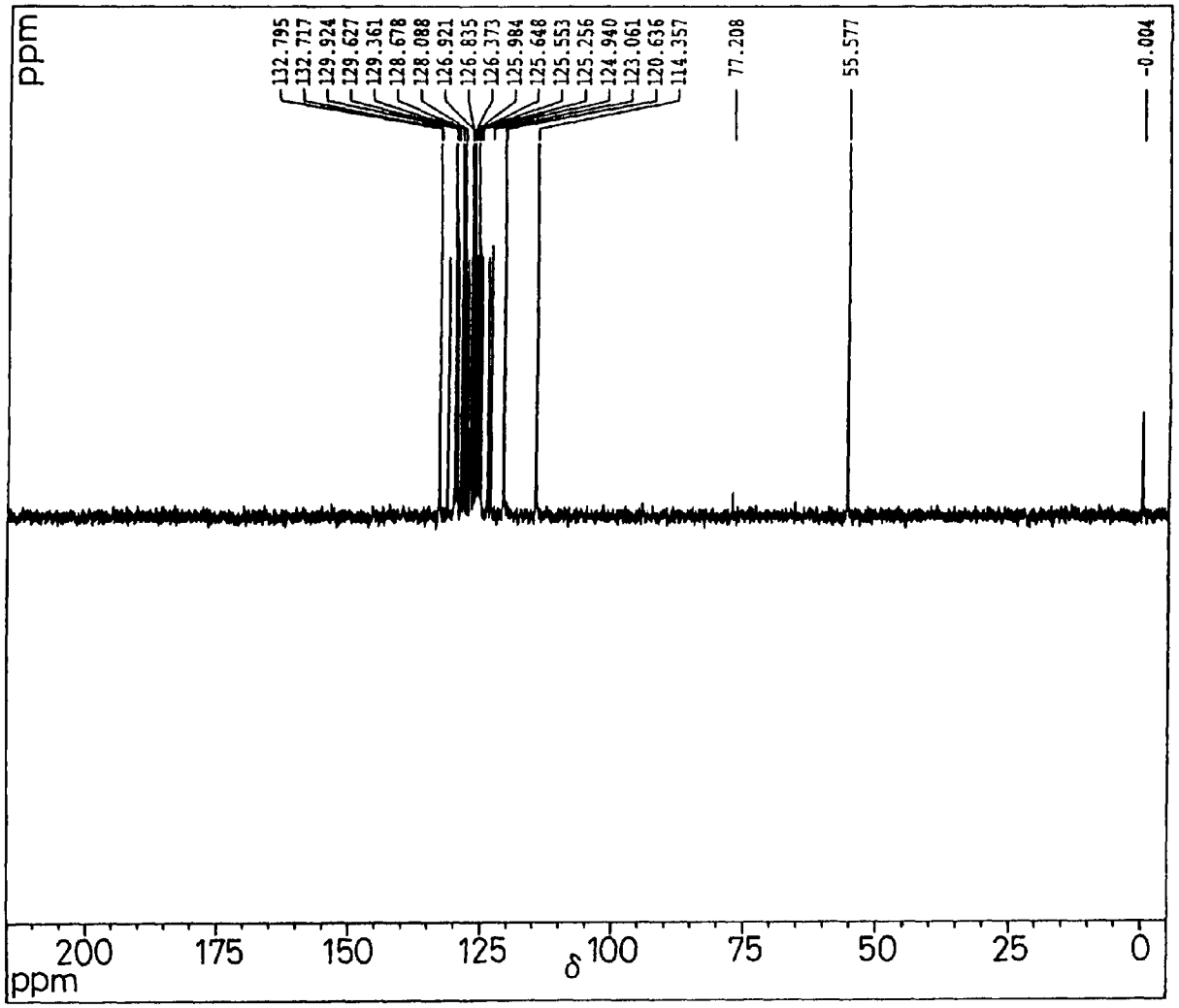
FIG. 15 is a $^{13}$C-NMR spectrum in DEPT135 measurement of the product in Production Example 2.
Figure 16:
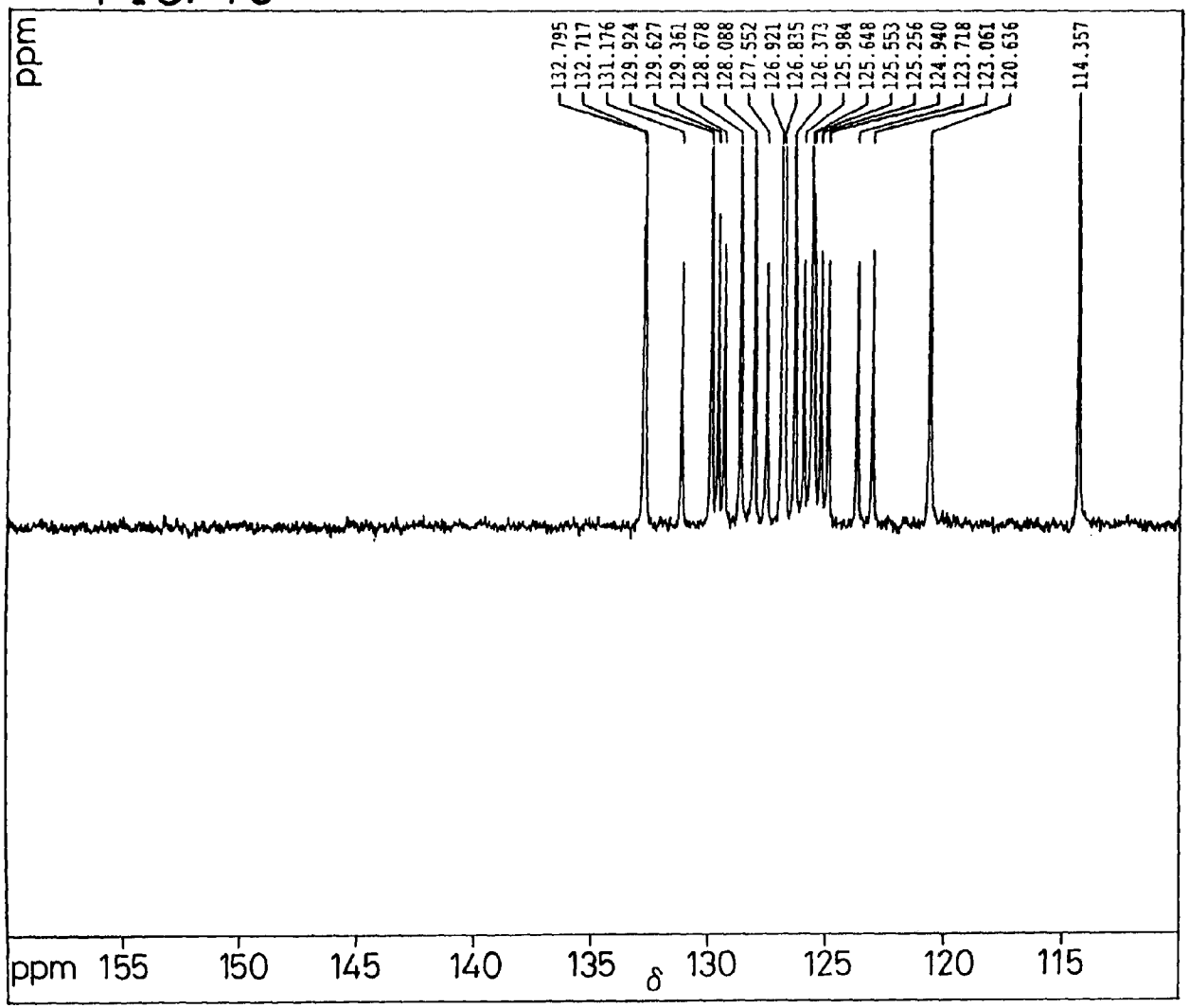
FIG. 16 is an enlarged view of the spectrum of FIG. 15 in the range of from 110 ppm to 160 ppm.

The NMR spectrum of the compound in heavy chloroform ($CDCl_3$) was measured, and this spectrum supports the structure of the enamine compound, Compound No. 61. FIG. 11 is the $^1$H-NMR spectrum of the product in this Production Example 2, and FIG. 12 is an enlarged view of the spectrum of FIG. 11 in the range of from 6 ppm to 9 ppm. FIG. 13 is the $^{13}$C-NMR spectrum in ordinary measurement of the product in Production Example 2, and FIG. 14 is an enlarged view of the spectrum of FIG. 13 in the range of from 110 ppm to 160 ppm. FIG. 15 is the $^{13}$C-NMR spectrum in DEPT135 measurement of the product in Production Example 2, and FIG. 16 is an enlarged view of the spectrum of FIG. 15 in the range of from 110 ppm to 160 ppm. In FIG. 11 to FIG. 16, the horizontal axis indicates the chemical shift δ (ppm) of the compound analyzed. In FIG. 11 and FIG. 12, the data written between the signals and the horizontal axis are relative integral values of the signals based on the integral value, 3, of the signal indicated by the reference numeral 501.

The data of LC-MS and the NMR spectrometry confirm that the compound obtained herein is the enamine compound, Compound No. 61 (yield: 92%). In addition, the data of LC-MS further confirm that the purity of the enamine compound, Compound No. 61 obtained herein is 99.0%.

As in the above, the three-stage reaction process that comprises dehydrating condensation, Vilsmeier reaction and Wittig-Horner reaction gives the enamine compound, Compound No. 61 shown in Table 9, and the overall three-stage yield of the product was 73.5%.

Production Example 3

Production of Compound No. 46

2.0 g (1.0 equivalent) of the enamine-aldehyde intermediate of formula (11) obtained in Production Example 1-2, and 1.53 g (1.2 equivalents) of a Wittig reagent of the following structural formula (13) were dissolved in 15 ml of anhydrous DMF, and 0.71 g (1.25 equivalents) of potassium t-butoxide was gradually added to the solution at room temperature, then heated up to 50° C., and stirred for 5 hours while kept heated at 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. Thus taken out, the organic layer was dried with magnesium sulfate. Solid matter was removed from the thus-dried organic layer, which was then concentrated and subjected to silica gel column chromatography to obtain 2.37 g of an yellow crystal. (13)

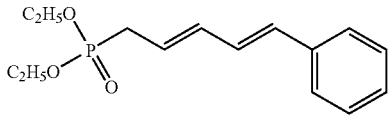

(13)

Thus obtained, the crystal was analyzed through LC-MS, which gave a peak at 566.4 corresponding to the molecular ion $[M+H]^+$ of the intended enamine compound, Compound No. 46 in Table 7 (calculated molecular weight: 565.28) with a proton added thereto. This confirms that the crystal obtained herein is the enamine compound, Compound. No. 46 (yield: 92%). In addition, the data of LC-MS further confirm that the purity of the enamine compound, Compound No. 46 is 99.8%.

As in the above, the Wittig-Horner reaction of the enamine-aldehyde intermediate of formula (11) and the Wittig reagent of formula (13) gives the enamine compound, Compound No. 46 shown in Table 7.

Comparative Production Example 1

Production of Compound of Structural Formula (14)

2.0 g (1.0 equivalent) of the enamine-aldehyde intermediate of formula (11) obtained in Production Example 1-2 was dissolved in 15 ml of anhydrous THF, and 5.23 ml (1.15 equivalents) of a THF solution of a Grignard reagent, allylmagnesium bromide prepared from allyl bromide and metal magnesium (molar concentration: 1.0 mol/liter) was gradually added to the solution at 0° C. This was stirred at 0° C. for 0.5 hours, and then checked for the reaction progress through thin-layer chromatography, in which no definite reaction product was confirmed but some different products were found. This was post-processed, extracted and concentrated in an ordinary manner. Then, the reaction mixture was isolated and purified through silica gel column chromatography.

However, the intended compound of the following structural formula (14) could not be obtained.

(14)

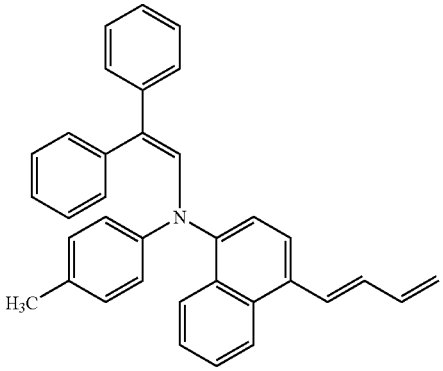

Example 1

One part by weight of a charge-generating substance 12, azo compound of the following structural formula (15) was added to a resin solution prepared by dissolving 1 part by weight of a phenoxy resin (Union Carbide's PKHH) in 99 parts by weight of THF, and then dispersed by the use of a paint shaker for 2 hours to prepare a charge generation layer-coating liquid. The charge generation layer-coating liquid was applied onto the aluminum surface of a conductive support 11, aluminum-deposited 80 μm-thick polyester film by the use of a baker's applicator, and then dried to form thereon a charge generation layer 15 having a thickness of 0.3 μm.

(15)

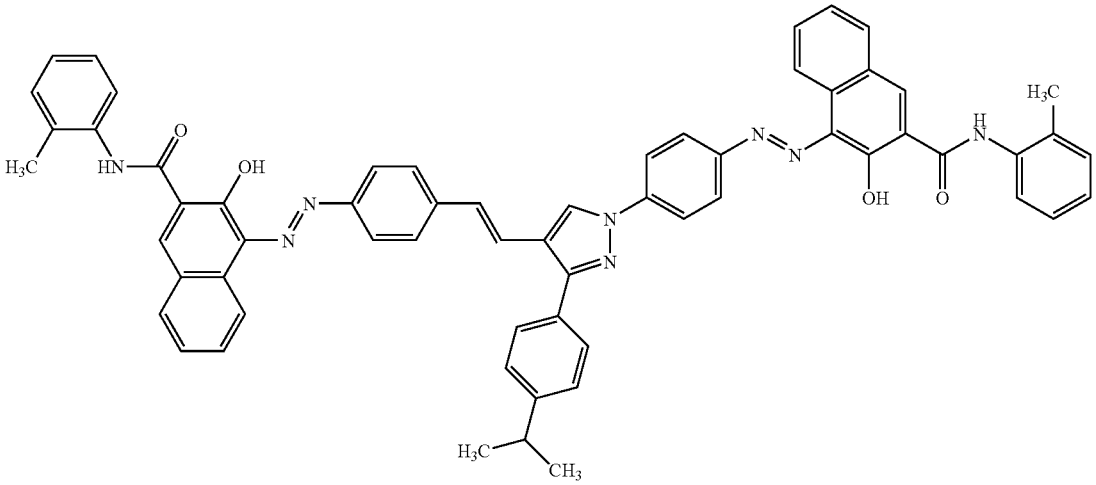

Next, 8 parts by weight of a charge-transporting substance 13, enamine compound, Compound No. 1 in Table 1, and 10 parts by weight of a binder resin 17, polycarbonate resin (Teijin's C-1400) were dissolved in 80 parts by weight of THF to prepare a charge transportation layer-coating liquid. The charge transportation layer-coating liquid was applied onto the previously-formed charge generation layer 15 by the use of a baker's applicator, and then dried to form thereon a charge transportation layer 16 having a thickness of 10 μm.

The process gave a laminate-structured electrophotographic photoreceptor having the constitution shown in FIG. 1.

Examples 2 to 6

Five different types of electrophotographic photoreceptors were fabricated in the same manner as in Example 1 except that an enamine compound, any of Compound No. 3 in Table 1, Compound No. 61 in Table 9, Compound No. 106 in Table 16, Compound No. 146 in Table 21 or Compound No. 177 in Table 26 was used for the charge-transporting substance 13 in place of Compound No. 1.

Comparative Example 1

An electrophotographic photoreceptor was fabricated in the same manner as in Example 1 except that a comparative compound A of the following structural formula (16) was used for the charge-transporting substance 13 in place of Compound No. 1.

(16)

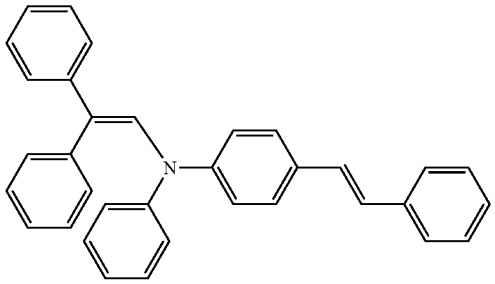

Comparative Example 2

An electrophotographic photoreceptor was fabricated in the same manner as in Example 1 except that a comparative compound B of the following structural formula (17) was used for the charge-transporting substance 13 in place of Compound No. 1.

(17)

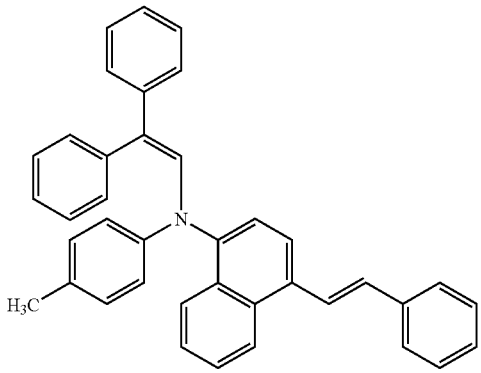

Comparative Example 3

An electrophotographic photoreceptor was fabricated in the same manner as in Example 1 except that a comparative compound C of the following structural formula (18) was used for the charge-transporting substance 13 in place of Compound No. 1.

(18)

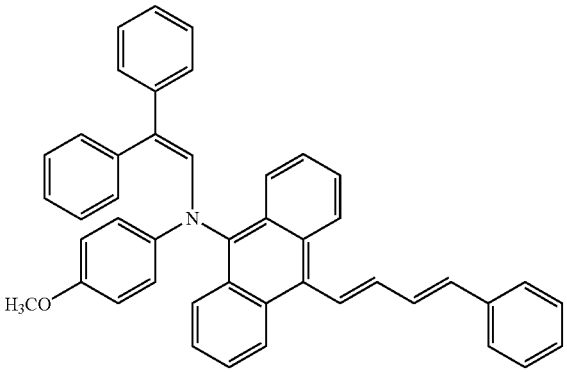

Comparative Example 4

An electrophotographic photoreceptor was fabricated in the same manner as in Example 1 except that a comparative compound D of the following structural formula (19) was used for the charge-transporting substance 13 in place of Compound No. 1.

(19)

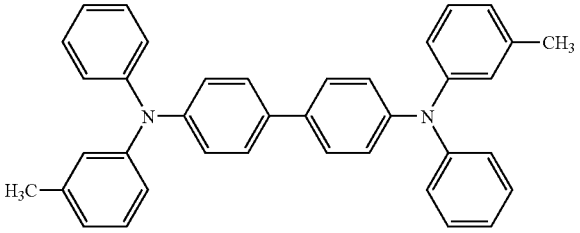

Evaluation 1

The electrophotographic photoreceptors that had been fabricated in Examples 1 to 6 and Comparative Examples 1 to 4 were analyzed by the use of a surface analyzer (Riken Keiki's AC-1) to measure their ionization potential. In addition, gold was deposited on the surface of the photosensitive layer of each electrophotographic photoreceptor, and the charge mobility of the charge-transporting substance 13 in the layer was measured at room temperature under reduced pressure according to a time-of-flight method. The data are given in Table 33. The value of the charge mobility shown in Table 33 is at a field strength of $2.5\times10^5$ V/cm.

TABLE 33

| | Charge-Transporting Substance | Ionization Potential (eV) | Charge Mobility ($cm^2/V \cdot sec$) |
|---|---|---|---|
| Example 1 | Compound No. 1 | 5.65 | $3.0 \times 10^{-4}$ |
| Example 2 | Compound No. 3 | 5.58 | $2.8 \times 10^{-4}$ |
| Example 3 | Compound No. 61 | 5.61 | $2.8 \times 10^{-4}$ |
| Example 4 | Compound No. 106 | 5.57 | $4.1 \times 10^{-4}$ |
| Example 5 | Compound No. 146 | 5.59 | $7.2 \times 10^{-4}$ |
| Example 6 | Compound No. 177 | 5.71 | $2.3 \times 10^{-4}$ |
| Comp. Example 1 | Comp. Compound A | 5.63 | $2.0 \times 10^{-5}$ |
| Comp. Example 2 | Comp. Compound B | 5.66 | $1.5 \times 10^{-5}$ |
| Comp. Example 3 | Comp. Compound C | 5.68 | $2.1 \times 10^{-5}$ |
| Comp. Example 4 | Comp. Compound D | 5.40 | $1.2 \times 10^{-6}$ |

Comparing the data in Examples 1 to 6 with those in Comparative Example 4 confirms that the charge mobility of the organic photoconductive material of formula (1) of the invention is at least 100 times higher than that of a known charge-transporting substance, triphenylamine dimer (TPD) of comparative compound D.

Comparing the data in Examples 1 to 6 with those in Comparative Examples 1 and 3 confirms that the charge mobility of the organic photoconductive material of formula (1) of the invention is at least 10 times higher than that of comparative compounds A and C which differ from formula (1) in that the naphthylene group bonding to the nitrogen atom in the functional group of enamine in formula (1) is substituted with any other arylene.

Comparing the data in Examples 1 to 6 with those in Comparative Example 2 confirms that the charge mobility of the organic photoconductive material of formula (1) of the invention is at least 10 times higher than that of comparative compound B which corresponds to formula (1) where n is 0 and $Ar^3$ is not a heterocyclic group.

Comparing the data in Examples 1 to 3 and 6 with those in Example 5 confirms that the charge mobility of the compound of formula (1) where $Ar^3$ is a naphthyl group is higher than that of the compound thereof where $Ar^3$ is not a naphthyl group.

Example 7

9 parts by weight of dendritic titanium oxide (Ishihara Sangyo's TTO-D-1) that had been surface-treated with aluminum oxide (chemical formula: $Al_2O_3$) and zirconium dioxide (chemical formula: $ZrO_2$), and 9 parts by weight of a copolymer nylon resin (Toray's CM8000) were added to a mixed solvent of 41 parts by weight of 1,3-dioxolane and 41 parts by weight of methanol, and dispersed for 12 hours by the use of a paint shaker to prepare an interlayer-coating liquid. Thus prepared, the interlayer-coating liquid was applied onto a conductive support 11, aluminum substrate having a thickness of 0.2 mm by the use of a baker's applicator, and then dried to form thereon an interlayer 18 having a thickness of 1 μm.

Next, 2 parts by weight of a charge-generating substance 12, azo compound of the following structural formula (20) was added to a resin solution prepared by dissolving 1 part by weight of a polyvinylbutyral resin (Sekisui Chemical Industry's BX-1) in 97 parts by weight of THF, and then dispersed by the use of a paint shaker for 10 hours to prepare a charge generation layer-coating liquid. The charge generation layer-coating liquid was applied onto the previously-formed interlayer 18 by the use of a baker's applicator, and dried to form thereon a charge generation layer 15 having a thickness of 0.3 μm.

The process gave a laminate-structured electrophotographic photoreceptor having the constitution shown in FIG. 2.

Examples 8 to 12

Five different types of electrophotographic photoreceptors were fabricated in the same manner as in Example 7 except that an enamine compound, any of Compound No. 3 in Table 1, Compound No. 61 in Table 9, Compound No. 106 in Table 16, Compound No. 146 in Table 21 or Compound No. 177 in Table 26 was used for the charge-transporting substance 13 in place of Compound No. 1.

Comparative Examples 5 to 7

Three different types of electrophotographic photoreceptors were fabricated in the same manner as in Example 7 except that comparative compound A of formula (16), comparative compound B of formula (17) or comparative compound D of formula (19) was used for the charge-transporting substance 13 in place of Compound No. 1.

Example 13

An interlayer-coating liquid was prepared in the same manner as in Example 7, and this was applied onto a conductive support 11, aluminum substrate having a thickness of 0.2 mm, and then dried to form thereon an interlayer 18 having a thickness of 1 μm.

Next, 1 part by weight of a charge-generating substance 12, azo compound of formula (20), 12 parts by weight of a binder resin 17, polycarbonate resin (Mitsubishi Gas Chemical's Z-400), 10 parts by weight of a charge-transporting substance 13, enamine compound, Compound No. 1 in Table 1, 5 parts by weight of 3,5-dimethyl-3',5'-di-t-butyldiphenoquinone, 0.5 parts by weight of 2,6-di-t-butyl-4-methylphenol and 65 parts by weight of THF were dispersed for 12 hours by the use of a ball mill to prepare a photosensitive layer-coating liquid. Thus prepared, the photosensitive layer-coating liquid was applied onto the previously-formed interlayer 18 by the use of a baker's applicator, and dried with hot air at 110° C. for 1 hour to form thereon a photosensitive layer 140 having a thickness of 20 μm.

(20)

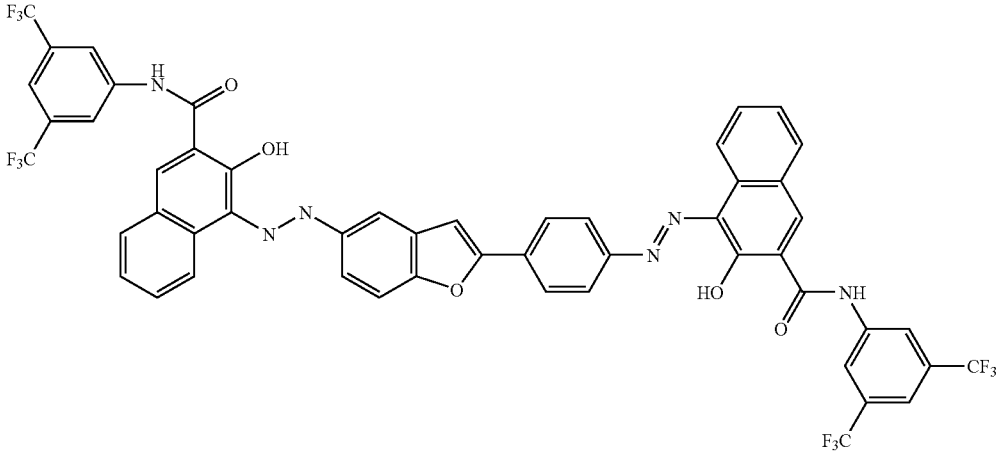

Next, 10 parts by weight of a charge-transporting substance 13, enamine compound, Compound No. 1 in Table 1, 14 parts by weight of a binder resin 17, polycarbonate resin (Mitsubishi Gas Chemical's Z200), and 0.2 parts by weight of 2,6-di-t-butyl-4-methylphenol were dissolved in 80 parts by weight of THF to prepare a charge transportation layer-coating liquid. The charge transportation layer-coating liquid was applied onto the previously-formed charge generation layer 15 by the use of a baker's applicator, and then dried to form thereon a charge transportation layer 16 having a thickness of 18 μm.

The process gave a single-layered electrophotographic photoreceptor having the constitution shown in FIG. 3.

Example 14

An electrophotographic photoreceptor was fabricated in the same manner as in Example 7 except that an X-type non-metal phthalocyanine was used for the charge-generating substance 12 in place of the azo compound of formula (20).

Examples 15 to 19

Five different types of electrophotographic photoreceptors were fabricated in the same manner as in Example 7 except that an X-type non-metal phthalocyanine was used for the charge-generating substance 12 in place of the azo compound of formula (20) and an enamine compound, any of Compound No. 3 in Table 1, Compound No. 61 in Table 9, Compound No. 106 in Table 16, Compound No. 146 in Table 21 or Compound No. 177 in Table 26 was used for the charge-transporting substance 13 in place of Compound No. 1.

Comparative Examples 8 to 10

Three different types of electrophotographic photoreceptors were fabricated in the same manner as in Example 7 except that an X-type non-metal phthalocyanine was used for the charge-generating substance 12 in place of the azo compound of formula (20) and comparative compound A of formula (16), comparative compound B of formula (17) or comparative compound D of formula (19) was used for the charge-transporting substance 13 in place of Compound No. 1.

Comparative Example 11

An electrophotographic photoreceptor was fabricated in the same manner as in Example 7 except that an X-type non-metal phthalocyanine was used for the charge-generating substance 12 in place of the azo compound of formula (20) and a comparative compound E of the following structural formula (21) was used for the charge-transporting substance 13 in place of Compound No. 1.

(21)

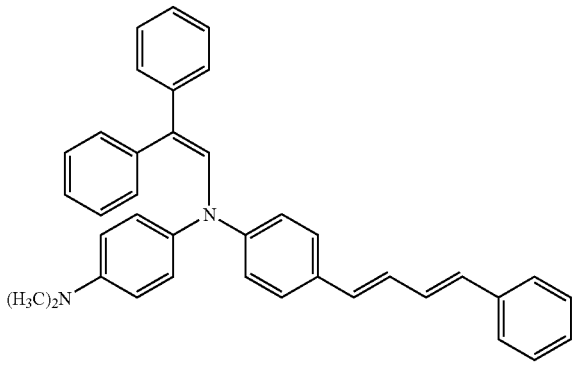

Comparative Example 12

An electrophotographic photoreceptor was fabricated in the same manner as in Example 7 except that an X-type non-metal phthalocyanine was used for the charge-generating substance 12 in place of the azo compound of formula (20) and a comparative compound F of the following structural formula (22) was used for the charge-transporting substance 13 in place of Compound No. 1.

(22)

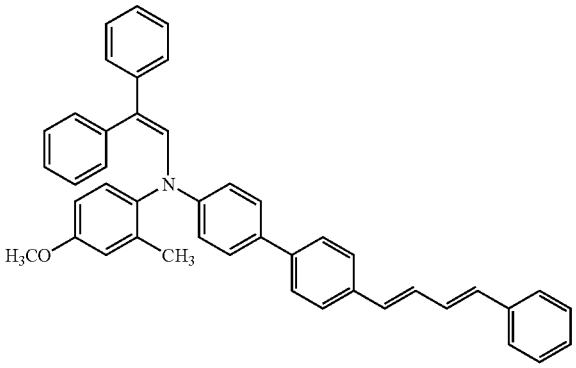

Evaluation 2

Fitted in an electrostatic copying paper tester (Kawaguchi Electric Manufacturing's EPA-8200), each electrophotographic photoreceptor fabricated in Examples 7 to 19 and Comparative Examples 5 to 12 was tested for the initial characteristics and the repetitive characteristics. The initial characteristics and the repetitive characteristics were evaluated in a normal temperature/normal humidity condition at a temperature of 22° C. and a relative humidity of 65% (22° C./65% RH) (hereinafter this is referred to as N/N condition), and in a low temperature/low humidity condition at a temperature of 5° C. and a relative humidity of 20% (5° C./20% RH) (hereinafter this is referred to as L/L condition).

The initial characteristics were evaluated as follows: A minus voltage of −5 kV was applied to the photoreceptor to charge the surface of the photoreceptor, and the surface potential of the photoreceptor in this condition was measured, and this is a charge potential of the photoreceptor, Vo (V). However, a plus potential of +5 kV was applied to the single-layered photoreceptor of Example 13. Next, the thus-charged photoreceptor surface was exposed to light. In this step, the energy needed for reducing the surface potential of the photoreceptor from the charge potential Vo to a half thereof was measured. This is a half-value exposure amount $E_{1/2}$ ($\mu J/cm^2$), and it is an index of the sensitivity of the photoreceptor. Ten seconds after the start of the exposure, the surface potential of the photoreceptor was measured. This is a residual potential Vr (V), and it is an index of the responsiveness of the photoreceptor to light. For the exposure, used was white light to give an exposure energy of 1 $\mu W/cm^2$ for the photoreceptors of Examples 7 to 13 and Comparative Examples 5 to 7 in which the charge-generating substance 12 is the azo compound of formula (20). For the photoreceptors of Examples 14 to 19 and Comparative Examples 8 to 12 in which the charge-generating substance 12 is X-type non-metal phthalocyanine, used was a 780 nm ray obtained through spectral division with a monochrometer. This ray gives an exposure energy of 1 $\mu W/cm^2$.

The repetitive characteristics were evaluated as follows: The operation of charging and exposure is one cycle. Each photoreceptor was subjected to 5000 cycles of charging and exposure, and its half-value exposure amount $E_{1/2}$, charge potential Vo and residual potential Vr were measured in the same manner as in the evaluation of the initial characteristics.

The results are given in Table 34.

TABLE 34

| | Charge | | N/N: 22° C./65% RH | | | | | | L/L: 5° C./20% RH | | | | | |
|---|---|---|---|---|---|---|---|---|---|---|---|---|---|---|
| | | Charge | Initial Characteristics | | | Repetitive Characteristics | | | Initial Characteristics | | | Repetitive Characteristics | | |
| | Charge Generating Substance | Transporting Substance | E½ (μJ/cm²) | Vo (V) | Vr (V) | E½ (μJ/cm²) | Vo (V) | Vr (V) | E½ (μJ/cm²) | Vo (V) | Vr (V) | E½ (μJ/cm²) | Vo (V) | Vr (V) |
| Ex. 7 | azo compound (20) | Compound No. 1 | 0.16 | −584 | −10 | 0.18 | −574 | −15 | 0.18 | −586 | −15 | 0.19 | −576 | −18 |
| Ex. 8 | azo compound (20) | Compound No. 3 | 0.15 | −586 | −13 | 0.16 | −576 | −17 | 0.16 | −587 | −13 | 0.18 | −579 | −19 |
| Ex. 9 | azo compound (20) | Compound No. 61 | 0.14 | −583 | −14 | 0.15 | −578 | −18 | 0.16 | −585 | −18 | 0.18 | −573 | −20 |
| Ex. 10 | azo compound (20) | Compound No. 106 | 0.14 | −586 | −13 | 0.16 | −577 | −15 | 0.16 | −584 | −16 | 0.17 | −576 | −19 |
| Ex. 11 | azo compound (20) | Compound No. 146 | 0.15 | −581 | −15 | 0.16 | −575 | −19 | 0.17 | −581 | −16 | 0.20 | −575 | −19 |
| Ex. 12 | azo compound (20) | Compound No. 177 | 0.16 | −585 | −15 | 0.19 | −573 | −18 | 0.18 | −583 | −18 | 0.22 | −572 | −23 |
| Co. Ex. 5 | azo compound (20) | Comp. Compound A | 0.20 | −578 | −35 | 0.22 | −576 | −36 | 0.42 | −579 | −50 | 0.45 | −571 | −51 |
| Co. Ex. 6 | azo compound (20) | Comp. Compound B | 0.21 | −575 | −38 | 0.24 | −577 | −42 | 0.44 | −578 | −55 | 0.48 | −577 | −59 |
| Co. Ex. 7 | azo compound (20) | Comp. Compound D | 0.21 | −591 | −42 | 0.25 | −589 | −54 | 0.45 | −581 | −55 | 0.51 | −579 | −65 |
| Ex. 13 | azo compound (20) | Compound No. 1 | 0.24 | 559 | 19 | 0.26 | 542 | 25 | 0.26 | 551 | 25 | 0.29 | 540 | 30 |
| Ex. 14 | X-type non-metal phthalocyanine | Compound No. 1 | 0.11 | −585 | −10 | 0.12 | −573 | −13 | 0.13 | −583 | −12 | 0.15 | −573 | −15 |
| Ex. 15 | X-type non-metal phthalocyanine | Compound No. 3 | 0.12 | −581 | −12 | 0.12 | −574 | −15 | 0.15 | −584 | −15 | 0.18 | −576 | −18 |
| Ex. 16 | X-type non-metal phthalocyanine | Compound No. 61 | 0.10 | −584 | −9 | 0.11 | −573 | −13 | 0.12 | −587 | −12 | 0.14 | −575 | −15 |
| Ex. 17 | X-type non-metal phthalocyanine | Compound No. 106 | 0.10 | −586 | −9 | 0.12 | −574 | −12 | 0.11 | −586 | −10 | 0.13 | −572 | −13 |
| Ex. 18 | X-type non-metal phthalocyanine | Compound No. 146 | 0.13 | −583 | −11 | 0.15 | −574 | −15 | 0.16 | −586 | −13 | 0.18 | −574 | −16 |
| Ex. 19 | X-type non-metal phthalocyanine | Compound No. 177 | 0.13 | −581 | −13 | 0.14 | −575 | −18 | 0.17 | −584 | −14 | 0.19 | −573 | −18 |
| Co. Ex. 8 | X-type non-metal phthalocyanine | Comp. Compound A | 0.15 | −586 | −25 | 0.17 | −576 | −27 | 0.36 | −580 | −45 | 0.38 | −578 | −46 |
| Co. Ex. 9 | X-type non-metal phthalocyanine | Comp. Compound B | 0.15 | −585 | −28 | 0.19 | −575 | −35 | 0.38 | −582 | −48 | 0.42 | −575 | −55 |
| Co. Ex. 10 | X-type non-metal phthalocyanine | Comp. Compound D | 0.15 | −581 | −30 | 0.19 | −575 | −40 | 0.38 | −579 | −50 | 0.45 | −570 | −59 |
| Co. Ex. 11 | X-type non-metal phthalocyanine | Comp. Compound E | 0.13 | −585 | −98 | 0.18 | −571 | −115 | 0.21 | −580 | −115 | 0.23 | −572 | −123 |
| Co. Ex. 12 | X-type non-metal phthalocyanine | Comp. Compound F | 0.15 | −587 | −22 | 0.18 | −574 | −31 | 0.35 | −582 | −49 | 0.44 | −572 | −60 |

Comparing the data in Examples 7 to 12 with those in Comparative Examples 5 to 7, and comparing the data in Examples 14 to 19 with those in Comparative Examples 8 to 12 confirms that the photoreceptors of Examples 7 to 12 and 14 to 19 in which the organic photoconductive material of formula (1) of the invention is used for the charge-transporting substance 13 have a higher sensitivity than the photoreceptors of Comparative Examples 5 to 12 in which any of comparative compound A, B, D, E or F is used for the charge-transporting substance 13 in that the half-value exposure amount $E_{1/2}$ for the former is smaller than that for the latter, and have a better responsiveness to light in that the residual potential Vr in the negative direction of the former is lower than that of the latter, or that is, the potential difference between the residual potential Vr and the standard potential of the former is smaller than that of the latter. In addition, it has been further confirmed that the photoreceptors keep these characteristics even after repeated use and even in a low temperature/low humidity (L/L) condition.

Example 20

One part by weight of a copolymer nylon resin (Toray's CM8000) and 40 parts by weight of colloidal silica were added to 80 parts by weight of methanol and dispersed for 12 hours by the use of a paint shaker to prepare an interlayer-coating liquid. Thus prepared, the interlayer-coating liquid was applied onto a conductive support 11, aluminum substrate having a thickness of 0.2 mm by the use of a baker's applicator, and then dried to form thereon an interlayer 18 having a thickness of 1.5

Next, 2 parts by weight of a charge-generating substance 12, azo compound of the following structural formula (23) and 1 part by weight of a phenoxy resin (Toto Chemical's Phenototo YP-50) were mixed with 160 parts by weight of THF, and then dispersed by the use of a paint shaker for 5 hours to prepare a charge generation layer-coating liquid. The charge generation layer-coating liquid was applied onto the previously-formed interlayer 18 by the use of a baker's applicator, and dried to form thereon a charge generation layer 15 having a thickness of 0.4 μm.

(23)

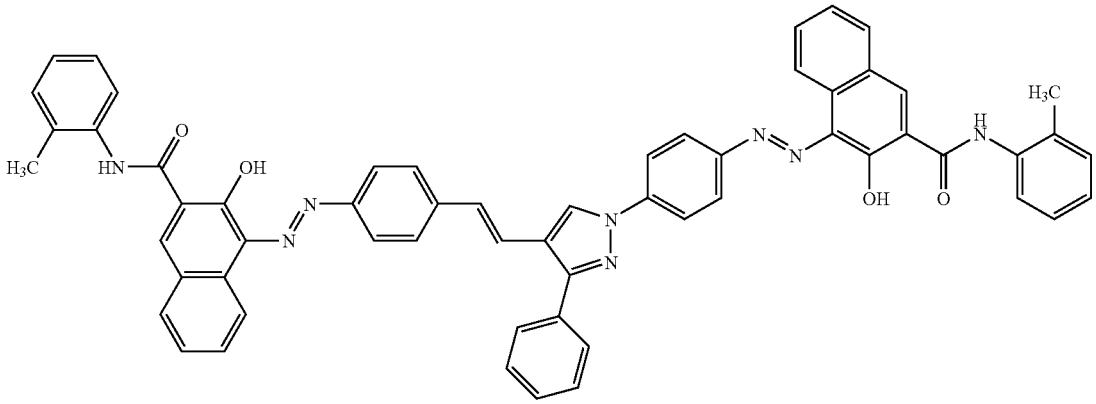

Next, 15 parts by weight of a charge-transporting substance 13, enamine compound, Compound No. 1 in Table 1, and 20 parts by weight of a binder resin 17, polycarbonate resin (Mitsubishi Gas Chemical's Z200) were dissolved in 80 parts by weight of THF to prepare a charge transportation layer-coating liquid. The charge transportation layer-coating liquid was applied onto the previously-formed charge generation layer 15 by the use of a baker's applicator, and then dried to form thereon a charge transportation layer 16 having a thickness of 25 μm.

The process gave a laminate-structured electrophotographic photoreceptor having the constitution shown in FIG. 2.

Comparative Example 13

In the same manner as in Example 20, an interlayer 18 and a charge generation layer 15 were formed.

Next, 6 parts by weight of a charge-transporting substance 13, enamine compound, Compound No. 1 in Table 1, 9 parts by weight of a polysilane of the following structural formula (24) (weight-average molecular weight Mw: $5.0\times10^4$), and 20 parts by weight of a binder resin 17, polycarbonate resin (Mitsubishi Gas Chemical's Z200) were dissolved in 80 parts by weight of dichloroethane to prepare a charge transportation layer-coating liquid. The charge transportation layer-coating liquid was used for forming a charge transportation layer 16 in the same manner as in Example 20, and an electrophotographic photoreceptor was thus fabricated herein.

(24)

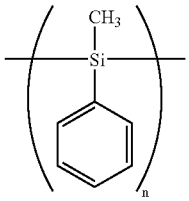

wherein n indicates a degree of polymerization.

Evaluation 3:

The electrophotographic photoreceptors fabricated in Example 20 and Comparative Example 13 were subjected to a forced light fatigue test for simulating their exposure to light during maintenance. Concretely, the test is as follows:

Fitted in an electrostatic copying paper tester (Kawaguchi Electric Manufacturing's EPA-8200), a minus voltage of −5 kV was applied to the photoreceptor to charge the surface of the photoreceptor in an N/N condition of 22° C./65% RH, and the surface potential of the photoreceptor in this condition was measured. This is a charge potential of the photoreceptor, Vo (V). Next, the thus-charged photoreceptor surface was exposed to white light with exposure energy of 1 $\mu W/cm^2$. Ten seconds after the start of the exposure, the surface potential of the photoreceptor was measured, and this is a residual potential of the photoreceptor, Vr (V).

Each photoreceptor of Example 20 and Comparative Example 13 was exposed to fluorescent light of 1000 luxes for 5 minutes. Immediately after the exposure, the charge potential Vo and the residual potential Vr of the photoreceptor were measured in the same manner as that for the non-exposed photoreceptor. The exposed photoreceptors were kept in the dark, and 5 minutes, 30 minutes, 2 hours and one day after the exposure, the charge potential Vo and the residual potential Vr of the photoreceptor were measured in the same manner as that for the non-exposed photoreceptor.

The charge potential Vo of the non-exposed photoreceptor is represented by Vo(0); and that of the exposed photoreceptor is by Vo(1). The difference between the absolute value of Vo(0) and that of Vo(1) is obtained, and it indicates a charge potential fluctuation, ΔVo (=|Vo(1)|−|Vo(0)|) of the photoreceptor tested. A larger negative value of the charge potential fluctuation ΔVo means that the charge potential Vo(1) of the exposed photoreceptor is lower in the negative direction than the charge potential Vo(0) of the non-exposed photoreceptor. In other words, this means that the potential difference between the charge potential Vo(1) and the standard potential is smaller in that case and the chargeability of the photoreceptor is lower. On the other hand, the residual potential Vr of the non-exposed photoreceptor is represented by Vr(0); and that of the exposed photoreceptor is by Vr(1). The difference between the absolute value of Vr(0) and that of Vr(1) is obtained, and it indicates a residual potential fluctuation, ΔVr (=|Vr(1)|−|Vr(0)|) of the photoreceptor tested. A larger positive value of the residual potential fluctuation ΔVr means that the residual potential Vr(1) of the exposed photoreceptor is higher in the negative direction than the residual potential Vr(0) of the non-exposed photoreceptor. In other words, this means that the potential difference between the residual potential Vr(1) and the standard potential is larger in that case.

The results are given in Table 35.

TABLE 35

| | Charge Potential Fluctuation ΔVo (V) | | | | | Residual Potential Fluctuation ΔVr (V) | | | | |
|---|---|---|---|---|---|---|---|---|---|---|
| | just after exposure | after 5 min | after 30 min | after 2 hours | after one day | just after exposure | after 5 min | after 30 min | after 2 hours | after one day |
| Example 20 | −15 | −3 | 0 | 0 | 0 | 10 | 2 | 0 | 0 | 0 |
| Comp. Ex. 13 | −52 | −35 | −29 | −27 | −27 | 203 | 175 | 168 | 160 | 161 |

Table 35 confirms that the charge potential fluctuation ΔVo of the photoreceptor of Example 20 not containing a polysilane is smaller in the negative direction than the photoreceptor of Comparative Example 13 containing a polysilane, and the residual potential fluctuation ΔVr thereof is smaller in the positive direction than the latter. This means that the characteristics such as the chargeability and the responsiveness to light of the photoreceptor of Example 20 do not worsen through exposure to light, and the photoreceptor is stable to exposure to light.

Example 21

9 parts by weight of dendritic titanium oxide (Ishihara Sangyo's TTO-D-1) that had been surface-treated with aluminum oxide ($Al_2O_3$) and zirconium dioxide ($ZrO_2$), and 9 parts by weight of a copolymer nylon resin (Toray's CM8000) were added to a mixed solvent of 41 parts by weight of 1,3-dioxolane and 41 parts by weight of methanol, and dispersed for 8 hours by the use of a paint shaker to prepare an interlayer-coating liquid. The interlayer-coating liquid was put into a dipping tank, in which a cylindrical conductive support 11 of aluminum having a diameter of 40 mm and an overall length of 340 mm was dipped and then drawn out to thereby make the conductive support 11 coated with an interlayer 18 having a thickness of 1.0 μm.

Next, 2 parts by weight of a charge-generating substance 12, oxotitanium phthalocyanine of which the crystal structure is characterized by a definite diffraction peak at least at a Bragg angle (20±0.2°) 27.20 in X-ray diffraction spectrometry with a Cu-Kα characteristic X-ray (wavelength: 1.54 Å), 1 part by weight of polyvinylbutyral (Sekisui Chemical Industry's Eslec BM-S) and 97 parts by weight of methyl ethyl ketone were mixed and dispersed by the use of a paint shaker to prepare a charge generation layer-coating liquid. The charge generation layer-coating liquid was applied onto the previously-formed interlayer 18 in the same dipping method as that for forming the interlayer 18, and a charge generation layer 15 having a thickness of 0.4 μm was thus formed on the interlayer 18.

Next, 10 parts by weight of a charge-transporting substance 13, enamine compound, Compound No. 1 in Table 1, 20 parts by weight of a binder resin 17, polycarbonate resin (Mitsubishi Engineering Plastics'.Iupilon Z200), 1 part by weight of 2,6-di-t-butyl-4-methylphenol, and 0.004 parts by weight of dimethylpolysiloxane (Shin-etsu Chemical Industry's KF-96) were dissolved in 110 parts by weight of tetrahydrofuran to prepare a charge transportation layer-coating liquid. The charge transportation layer-coating liquid was applied onto the previously-formed charge generation layer 15 in the same dipping method as that for forming the interlayer 18, and then dried at 110° C. for 1 hour to form a charge transportation layer 16 having a thickness of 23 μm.

The process gave an electrophotographic photoreceptor.

Examples 22, 23

Two different types of electrophotographic photoreceptors were fabricated in the same manner as in Example 21 except that an enamine compound, Compound No. 61 in Table 9 or Compound No. 146 in Table 21 was used for the charge-transporting substance 13 in place of Compound No. 1.

Comparative Examples 14, 15

Two different types of electrophotographic photoreceptors were fabricated in the same manner as in Example 21 except that comparative compound A of formula (16) or comparative compound B of formula (17) was used for the charge-transporting substance 13 in place of Compound No. 1.

Example 24

An electrophotographic photoreceptor was fabricated in the same manner as in Example 21 except that the amount of the binder resin 17, polycarbonate resin for the charge transportation layer 16 was 25 parts by weight.

Examples 25, 26

Two different types of electrophotographic photoreceptors were fabricated in the same manner as in Example 21 except that the amount of the binder resin 17, polycarbonate resin for the charge transportation layer 16 was 25 parts by weight, and an enamine compound, Compound No. 61 in Table 9 or Compound No. 146 in Table 21 was used for the charge-transporting substance 13 in place of Compound No. 1.

Example 27

An electrophotographic photoreceptor was fabricated in the same manner as in Example 21 except that the amount of the binder resin 17, polycarbonate resin for the charge transportation layer 16 was 10 parts by weight.

Example 28

An electrophotographic photoreceptor was fabricated in the same manner as in Example 21 except that the amount of the binder resin 17, polycarbonate resin for the charge transportation layer 16 was 31 parts by weight.

However, in forming the charge transportation layer 16, when the same amount of tetrahydrofuran as that in Example 21 was used, the polycarbonate resin could not be completely dissolved the charge transportation layer-coating liquid. Therefore, tetrahydrofuran was further added to the liquid so that the polycarbonate resin could be completely dissolved therein. Thus prepared, the charge transportation layer-coating liquid was used for forming the charge transportation layer 16.

However, since the solvent in the charge transportation layer-coating liquid was too much, the ends in the longitudinal direction of the cylindrical photoreceptor whitened owing to blushing, and therefore the characteristics of the photoreceptor could not be evaluated.

Evaluation 4:

The electrophotographic photoreceptors fabricated in Examples 21 to 27 and Comparative Examples 14, 15 were tested for the printing durability and the electric stability, in the manner mentioned below.

Each electrophotographic photoreceptors fabricated in Examples 21 to 27 and Comparative Examples 14, 15 was mounted on a digital copier (Sharp's AR-C150) of which the process speed was controlled to be 117 mm/sec. Using the machine, 40,000 copies were produced, and then the thickness d1 of the photosensitive layer was measured. The difference between the value d1 and the original thickness d0 of the fresh photosensitive layer, or that is, the thickness reduction Δd (=d0−d1) was obtained, and this is an index of the printing durability of the photoreceptor tested.

Inside the copier, a surface potentiometer (Gentec's CATE751) was fitted so as to measure the surface potential of the photoreceptor driven for image formation, and in an N/N condition of 22° C./65% RH, the surface potential of the photoreceptor just after charged, or that is, the charge potential Vo (V) thereof, and the surface potential $V_L$ (V) thereof immediately after exposed to laser light were measured. In addition, in an L/L condition of 5° C./20% RH, the surface potential $V_L$ of the photoreceptor immediately after exposed to laser light was also measured in the same manner as above. The surface potential $V_L$ measured in the N/N condition is represented by $V_L(1)$; and that measured in the L/L condition is by $V_L(2)$. The difference between $V_L(1)$ and $V_L(2)$ is a potential fluctuation $\Delta V_L$ ($=V_L(2)-V_L(1)$), and this is the index of the electric stability of the photoreceptor tested. In these tests, the surface of the photoreceptor was charged negatively.

The results are given in Table 36.

TABLE 36

| | Charge Transporting Substance | Charge Transporting Substance/Binder Resin | Film Thickness Reduction Δd (μm) | N/N Potential Characteristics Vo (V) | N/N Potential Characteristics $V_L$ (V) | L/L Potential Fluctuation $\Delta V_L$ (V) | Remarks |
|---|---|---|---|---|---|---|---|
| Example 21 | Compound No. 1 | 10/20 | 4.4 | −528 | −42 | −20 | |
| Example 22 | Compound No. 61 | 10/20 | 4.3 | −524 | −30 | −15 | |
| Example 23 | Compound No. 146 | 10/20 | 4.4 | −529 | −39 | −20 | |
| Comp. Ex. 14 | Comparative Compound A | 10/20 | 4.4 | −518 | −102 | −70 | |
| Comp. Ex. 15 | Comparative Compound B | 10/20 | 4.4 | −524 | −111 | −72 | |
| Example 24 | Compound No. 1 | 10/25 | 3.2 | −524 | −49 | −25 | |
| Example 25 | Compound No. 61 | 10/25 | 3.2 | −526 | −41 | −20 | |
| Example 26 | Compound No. 146 | 10/25 | 3.1 | −529 | −45 | −28 | |
| Example 27 | Compound No. 1 | 10/10 | 11.8 | −518 | −15 | −8 | |
| Example 28 | Compound No. 1 | 10/31 | — | — | — | — | Evaluation Impossible because of blushing. |

Comparing the data in Examples 21 to 26 with those in Comparative Examples 14, 15 confirms that the level of the surface potential $V_L$ in an N/N condition of the photoreceptors of Examples 21 to 26, in which the organic photoconductive material of the invention is used for the charge-transporting substance 13, is higher than those of Comparative Examples 14 and 15, in which comparative compound A or B is used for it, even when the binder resin content of the charge transportation layer is high, and this means that the photoreceptors of Examples 21 to 26 have good responsiveness to light. In addition, the potential fluctuation $\Delta V_L$ in the photoreceptors of Examples 21 to 26 is small, and this means that the photoreceptors have good responsiveness to light even in an L/L condition.

Comparing the data in Examples 21 to 26 with those in Example 27 confirms that the film thickness reduction Δd in the photoreceptors of Examples 21 to 26, in which A/B, which is the ratio of the charge-transporting substance (A) to the binder resin (B), falls between 10/12 and 10/30, is smaller than that in the photoreceptor of Example 27, in which the ratio A/B is 10/10, or that is, larger than 10/12 and the proportion of the binder resin is low, and this means that the photoreceptors of Examples 21 to 26 have good printing durability.

As in the above, the charge transportation layer that contains the organic photoconductive material of the invention has improved printing durability, not interfering with the responsiveness thereof to light.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An organic photoconductive material of the following general formula (1):

(1)

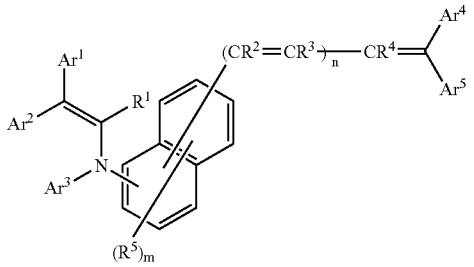

wherein $Ar^1$ and $Ar^2$ each represent an optionally-substituted aryl group or an optionally-substituted heterocyclic group; $Ar^3$ represents an optionally-substituted aryl group, an optionally-substituted heterocyclic group, an optionally-substituted aralkyl group, or an optionally-substituted alkyl group; $Ar^4$ and $Ar^5$ each represent a hydrogen atom, an optionally-substituted aryl group, an optionally-substituted heterocyclic group, an optionally-substituted aralkyl group, or an optionally-substituted alkyl group, but it is excluded that $Ar^4$ and $Ar^5$ represent hydrogen atoms at the same time; $Ar^4$ and $Ar^5$ may bond to each other via an atom or an atomic group to form a cyclic structure; $(R^5)_m$ represents an optionally-substituted alkyl group, an optionally-substituted alkoxy group, an optionally-substituted dialkylamino group, an optionally-substituted aryl group, a halogen atom, or a hydrogen atom; m indicates an integer of from 1 to 6; when m is 2 or more, the $R^5$s may be the same or different and may bond to each other to form a cyclic structure; $R^1$ represents a hydrogen atom, a halogen atom, or an optionally-substituted alkyl group; $R^2$, $R^3$ and $R^4$ each represent a hydrogen atom, an optionally-substituted alkyl group, an optionally-substituted aryl group, an optionally-substituted heterocyclic group, or an optionally-substituted aralkyl group; n indicates an integer of from 0 to 3; when n is 2 or 3, the $R^2$s may be the same or different and the $R^3$s may be the same or different, but when n is 0, $Ar^3$ is an optionally-substituted heterocyclic group.

2. The organic photoconductive material of claim 1, wherein the organic photoconductive material of formula (1) is of the following general formula (2):

(2)

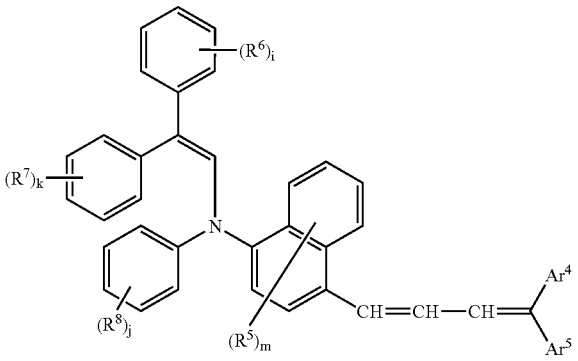

wherein $R^6$, $R^7$ and $R^8$ each represent an optionally-substituted alkyl group, an optionally-substituted alkoxy group, an optionally-substituted dialkylamino group, an optionally-substituted aryl group, a halogen atom, or a hydrogen atom; i, k and j each indicate an integer of from 1 to 5; when i is 2 or more, then the $R^6$s may be the same or different and may bond to each other to form a cyclic structure; when k is 2 or more, then the $R^7$s may be the same or different and may bond to each other to form a cyclic structure; and when j is 2 or more, then the $R^8$s may be the same or different and may bond to each other to form a cyclic structure; $Ar^4$, $Ar^5$, $R^5$, and m represent the same as those defined in formula (1).

3. An electrophotographic photoreceptor comprising:

a conductive support of a photoconductive material; and a photosensitive layer formed on the conductive support, containing a charge-generating substance and a charge-transporting substance, the charge-transporting substance comprising the organic photoconductive material of claim 2.

4. The electrophotographic photoreceptor of claim 3, wherein the charge-generating substance comprises oxotitanium phthalocyanine.

5. The electrophotographic photoreceptor of claim 3, wherein the photosensitive layer in the photoreceptor has a laminate structure comprising a charge generation layer that contains the charge-generating substance and a charge transportation layer that contains a charge-transporting substance.

6. The electrophotographic photoreceptor of claim 5, wherein the charge transportation layer contains a binder resin, and in the charge transportation layer, A/B which is a ratio of the charge-transporting substance (A) to the binder resin (B) by weight, falls between 10/12 and 10/30.

7. The electrophotographic photoreceptor of claim 3, wherein an interlayer is disposed between the conductive support and the photosensitive layer.

8. An image forming apparatus comprising:

the electrophotographic photoreceptor of claim 3.

9. An electrophotographic photoreceptor comprising:

a conductive support of a photoconductive material; and a photosensitive layer formed on the conductive support, containing a charge-generating substance and a charge-transporting substance, the charge-transporting substance comprising the organic photoconductive material of claim 1.

10. The electrophotographic photoreceptor of claim 9, wherein the charge-generating substance comprises oxotitanium phthalocyanine.

11. The electrophotographic photoreceptor of claim 9, wherein the photosensitive layer in the photoreceptor has a laminate structure comprising a charge generation layer that contains the charge-generating substance and a charge transportation layer that contains a charge-transporting substance.

12. The electrophotographic photoreceptor of claim 11, wherein the charge transportation layer contains a binder resin, and in the charge transportation layer, A/B which is a ratio of the charge-transporting substance (A) to the binder resin (B) by weight, falls between 10/12 and 10/30.

13. The electrophotographic photoreceptor of claim 9, wherein an interlayer is disposed between the conductive support and the photosensitive layer.

14. An image forming apparatus comprising:

the electrophotographic photoreceptor of claim 9.

* * * * *